US012584263B2

(12) United States Patent
Seo et al.

(10) Patent No.: US 12,584,263 B2
(45) Date of Patent: Mar. 24, 2026

(54) WASHING MACHINE AND CONTROLLING METHOD OF WASHING MACHINE

(71) Applicant: SAMSUNG ELECTRONICS CO., LTD., Suwon-si (KR)

(72) Inventors: Dongpil Seo, Suwon-si (KR); Kanghyun Lee, Suwon-si (KR); Youngjin Cho, Suwon-si (KR); Yonghan Kim, Suwon-si (KR); Jaeryong Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 206 days.

(21) Appl. No.: 18/211,885

(22) Filed: Jun. 20, 2023

(65) Prior Publication Data

US 2023/0416971 A1 Dec. 28, 2023

Related U.S. Application Data

(63) Continuation of application No. PCT/KR2023/006977, filed on May 23, 2023.

(30) Foreign Application Priority Data

Jun. 28, 2022 (KR) ..... 10-2022-0079297
Aug. 23, 2022 (KR) ..... 10-2022-0105766
(Continued)

(51) Int. Cl.
*D06F 39/08* (2006.01)
*D06F 23/02* (2006.01)
(Continued)

(52) U.S. Cl.
CPC ..... *D06F 39/081* (2013.01); *D06F 23/02* (2013.01); *D06F 34/04* (2020.02); *D06F 34/20* (2020.02);
(Continued)

(58) Field of Classification Search
CPC ..... D06F 39/081; D06F 23/02; D06F 34/04; D06F 34/20; D06F 34/28; D06F 39/085;
(Continued)

(56) References Cited

U.S. PATENT DOCUMENTS 8,336,343 B2 * 12/2012 Chung ..... D06F 39/085 68/12.19
8,985,128 B2 * 3/2015 Pyo ..... A47L 15/4246 134/186
(Continued)

FOREIGN PATENT DOCUMENTS

CN 203411820 U 1/2014
CN 111254650 A 6/2020
(Continued)

OTHER PUBLICATIONS

Machine translation of JP-2014212821-A (Year: 2014).*
(Continued)

*Primary Examiner* — Michael E Barr
*Assistant Examiner* — Thomas Bucci
(74) *Attorney, Agent, or Firm* — STAAS & HALSEY LLP

(57) ABSTRACT

A washing machine including a housing; a tub arranged inside the housing; a drain case connected to the tub and configured to receive water from the tub; a filter detachably installed in the drain case and configured to filter material from the water; a pump connected to the drain case; and a controller configured to, while the filter is dismounted from the drain case, control the pump to discharge the water in the drain case to outside of the drain case.

18 Claims, 43 Drawing Sheets

(30) Foreign Application Priority Data

Oct. 11, 2022 (KR) ..... 10-2022-0130089
Jan. 13, 2023 (KR) ..... 10-2023-0005242

(51) Int. Cl.

| | |
|---|---|
| ***D06F 34/04*** | (2020.01) |
| ***D06F 34/20*** | (2020.01) |
| ***D06F 34/28*** | (2020.01) |
| ***D06F 39/10*** | (2006.01) |
| ***D06F 39/12*** | (2006.01) |
| *D06F 103/42* | (2020.01) |
| *D06F 105/08* | (2020.01) |

(52) U.S. Cl.
CPC ..... *D06F 34/28* (2020.02); *D06F 39/085* (2013.01); *D06F 39/10* (2013.01); *D06F 39/12* (2013.01); *D06F 2103/42* (2020.02); *D06F 2105/08* (2020.02)

(58) Field of Classification Search
CPC ..... D06F 39/10; D06F 39/12; D06F 2103/42; D06F 2105/08; D06F 34/05; D06F 34/30; D06F 34/32; D06F 34/34; D06F 39/08; D06F 2101/20; D06F 2105/58; B01D 35/02
USPC ..... 68/12.02
See application file for complete search history.

(56) References Cited

U.S. PATENT DOCUMENTS

| | | | | |
|---|---|---|---|---|
| 9,896,797 | B2 * | 2/2018 | Shin | D06F 58/22 |
| 11,634,854 | B2 | 4/2023 | Nakashima et al. | |
| 2013/0074554 | A1 | 3/2013 | Chun et al. | |
| 2023/0212809 | A1 | 7/2023 | Cho et al. | |

FOREIGN PATENT DOCUMENTS

| | | | | |
|---|---|---|---|---|
| CN | 212152811 | U | 12/2020 | |
| DE | 28 27 254 | A1 | 1/1980 | |
| EP | 2 034 083 | A2 | 3/2009 | |
| EP | 2151518 | A2 * | 2/2010 | D06F 39/10 |
| EP | 2 103 728 | B1 | 3/2013 | |
| EP | 2 151 518 | B1 | 9/2014 | |
| JP | 2007-222259 | A | 9/2007 | |
| JP | 2010-35748 | | 2/2010 | |
| JP | 4905443 | B2 | 3/2012 | |
| JP | 2014-212821 | | 11/2014 | |
| JP | 2014212821 | A * | 11/2014 | D06F 23/06 |
| JP | 2015-66328 | | 4/2015 | |
| JP | 2015066328 | A * | 4/2015 | |
| JP | 6328845 | B2 | 4/2018 | |
| KR | 92-12150 | U | 7/1992 | |
| KR | 0129222 | | 9/1995 | |
| KR | 0127626 | Y1 | 7/1998 | |
| KR | 2001-0094547 | | 11/2001 | |
| KR | 10-2007-0113432 | | 11/2007 | |
| KR | 10-0778693 | | 11/2007 | |
| KR | 100778693 | B1 * | 11/2007 | D06F 39/10 |
| KR | 10-2008-0002469 | A | 1/2008 | |
| KR | 10-2009-0098673 | | 9/2009 | |
| KR | 10-2010-0082519 | | 7/2010 | |
| KR | 10-1030216 | B1 | 4/2011 | |
| KR | 10-1236194 | B1 | 2/2013 | |
| KR | 10-1248745 | B1 | 3/2013 | |
| KR | 10-2013-0034311 | | 4/2013 | |
| KR | 10-1270613 | | 6/2013 | |
| KR | 10-1634172 | B1 | 6/2016 | |
| KR | 10-2020-0056291 | | 5/2020 | |
| WO | WO 2018/086931 | A1 | 5/2018 | |
| WO | WO 2023/128144 | A1 | 7/2023 | |

OTHER PUBLICATIONS

Machine translation of KR-100778693-B1 (Year: 2007).*
Machines translation of JP-2015066328-A (Year: 2015).*
International Search Report Sep. 4, 2023 in International Patent Application No. PCT/KR2023/006977.
Written Opinion of the International Searching Authority dated Sep. 4, 2024 in International Patent Application No. PCT/KR2023/006977.
Extended European Search Report dated Apr. 8, 2025 for European Application No. 23831733.3.

* cited by examiner

WASHING MACHINE AND CONTROLLING METHOD OF WASHING MACHINE

CROSS-REFERENCE TO RELATED APPLICATIONS

This application is a continuation application, filed under 35 U.S.C. § 111(a), of International Application PCT/KR2023/006977 filed on May 23, 2023, and is based on and claims priority under 35 U.S.C. § 119 to Korean Patent Application Nos. 10-2022-0079297, filed on Jun. 28, 2022, 10-2022-0105766, filed on Aug. 23, 2022, 10-2022-0130089, filed on Oct. 11, 2022, 10-2023-0005242, filed on Jan. 13, 2023, respectively, in the Korean Intellectual Property Office, the disclosures of which are incorporated by reference herein in their entireties.

BACKGROUND

1. Field

The present disclosure relates to a washing machine having a filter and a method for controlling the washing machine.

2. Description of the Related Art

A washing machine is an apparatus for washing laundry put inside of the tub through friction by stirring the laundry, water, and a detergent together by using a driving force of a driving motor.

Operations that are performed by the washing machine include, regardless of the type of the washing machine, a washing operation for washing laundry put into the tub by supplying a detergent and water to the tub and rotating the drum, a rinsing operation for rinsing the laundry by supplying water to the tub and rotating the drum, and a dehydrating operation for dehydrating water of the laundry by discharging water from the tub and rotating the drum.

The washing machine includes a drain device configured to discharge water stored in the tub to the outside of the washing machine while performing the washing operation, the rinsing operation, and/or the dehydrating operation. The drain device is configured to again discharge water discharged from the tub to the tub while performing the washing operation and/or the rinsing operation.

In the drain device, a filter for filtering foreign materials included in water flowing from the tub may be provided. The filter may be detachable from the drain device.

SUMMARY

Aspects of embodiments of the disclosure will be set forth in part in the description which follows and, in part, will be apparent from the description, or may be learned by practice of the presented embodiments.

According to an embodiment of the disclosure, a washing machine may include a housing; a tub arranged inside the housing; a drain case connected to the tub and configured to receive water from the tub; a filter detachably installed in the drain case and configured to filter material from the water; a pump connected to the drain case; and a controller configured to, while the filter is dismounted from the drain case, control the pump to discharge the water in the drain case to outside of the drain case.

According to an embodiment of the disclosure, the pump is a drain pump configured to discharge the water received in the drain case from the tub to outside of the housing.

According to an embodiment of the disclosure, the pump is a remaining water pump, the washing machine further includes a drain pump arranged in the drain case and configured to discharge the water received in the drain case, and the remaining water pump is configured to be driven independently from the drain pump.

According to an embodiment of the disclosure, the washing machine further includes a drain guide configured to guide water pumped by the drain pump; and a remaining water guide arranged separately from the drain guide and configured to guide water pumped by the remaining water pump.

According to an embodiment of the disclosure, the remaining water pump is installed in the drain case.

According to an embodiment of the disclosure, the remaining water pump is installed in the housing.

According to an embodiment of the disclosure, the washing machine further includes a remaining water space formed inside the drain case and positioned below the filter in a direction of gravity.

According to an embodiment of the disclosure, a bottom of the drain case includes a portion formed to be inclined downward toward the remaining water space.

According to an embodiment of the disclosure, the drain case includes an inlet through which the water is received from the tub, and a drain opening through which the water is discharged to outside of the drain case, and the remaining water space is closer to the drain opening than the inlet of the drain case.

According to an embodiment of the disclosure, the washing machine further includes a sensor configured to detect installation of the filter in the drain case, wherein the controller is configured to operate the pump based on a detection, by the sensor, of dismounting of the filter from the drain case.

According to an embodiment of the disclosure, the controller is configured to stop operating the pump based on a detection, by the sensor, of coupling of the filter to the drain case.

According to an embodiment of the disclosure, the washing machine further includes a communication module configured to communicate with a user terminal, wherein the controller is configured to operate the pump based on reception, through the communication module, of a command for operating the pump from the user terminal.

According to an embodiment of the disclosure, the washing machine further includes an input device configured to receive a command from a user to operate the pump, wherein the controller is configured to operate the pump based on reception, through the input device, of the command from the user to operate the pump.

According to an embodiment of the disclosure, the washing machine further includes a cover arranged on a front surface of the housing and configured to be movable to provide access to the drain case through the front surface of the housing, wherein the input device is adjacent to the cover.

According to an embodiment of the disclosure, the input device is configured to receive a command from the user to stop operating the pump, and the controller is configured to stop operating the pump based on reception, through the input device, of the command from the user to stop operating the pump.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
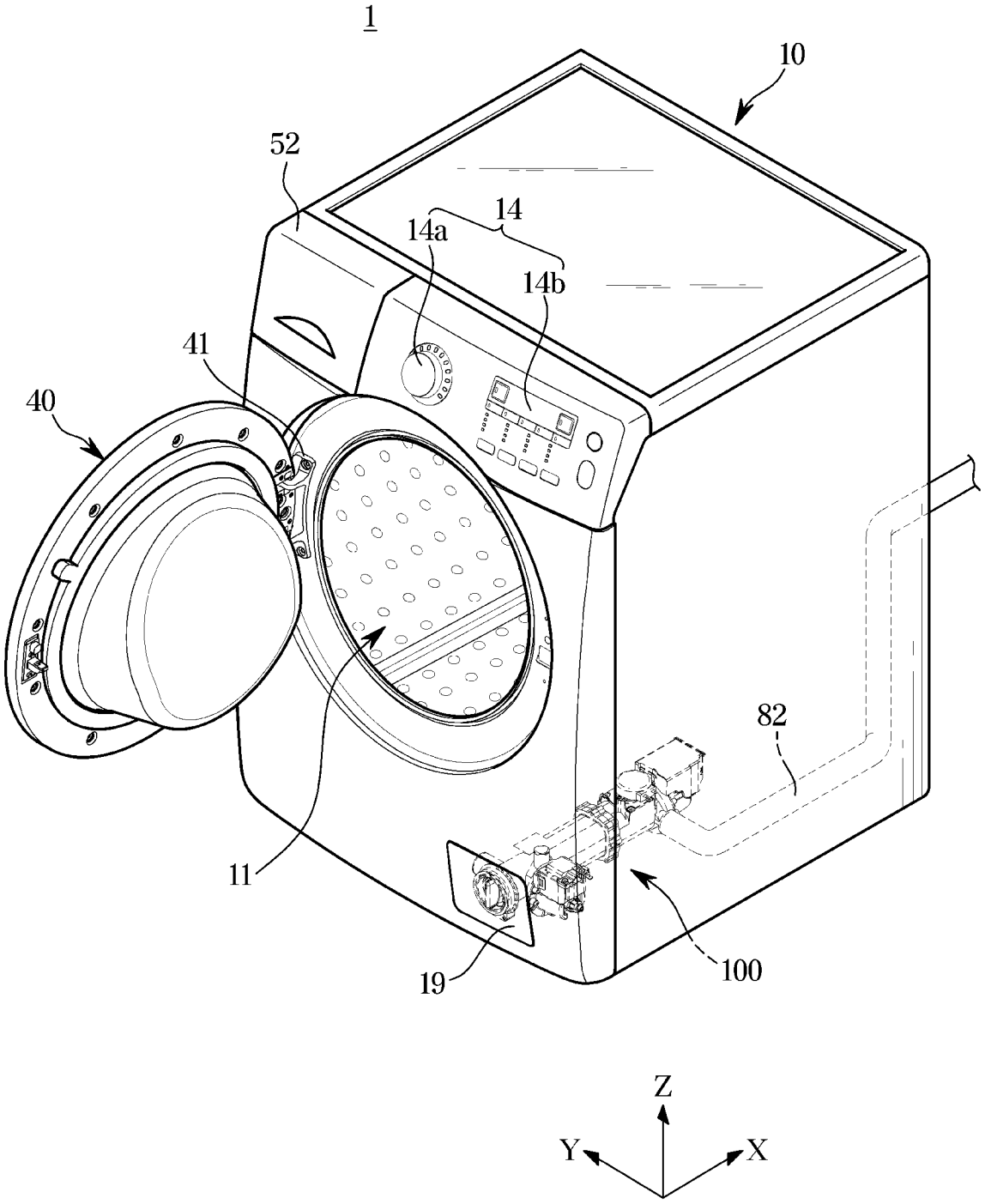
FIG. 1 shows a washing machine according to an embodiment of the disclosure.

It should be appreciated that various embodiments of the disclosure and the terms used therein are not intended to limit the technological features set forth herein to particular embodiments and include various changes, equivalents, or replacements for a corresponding embodiment.

With regard to the description of the drawings, similar reference numerals may be used to refer to similar or related elements.

It is to be understood that a singular form of a noun corresponding to an item may include one or more of the things, unless the relevant context clearly indicates otherwise.

As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases.

The term "and/or" includes any and all combinations of one or more of associated listed items.

As used herein, such terms as "1st" and "2nd," or "first" and "second" may be used to simply distinguish a corresponding component from another, and does not limit the components in other aspect (for example, importance or order).

It is to be understood that if a certain component (for example, a first component) is referred to, with or without the term "operatively" or "communicatively", as "coupled with," "coupled to," "connected with," or "connected to" another component (for example, a second component), it means that the component may be coupled with the other component directly (for example, wiredly), wirelessly, or via a third element.

It is to be understood that the terms such as "including" or "having," etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

It is to be understood that if a certain component is referred to as being "coupled with," "coupled to," "supported on" or "in contact with" another component, it means that the component may be coupled with the other component directly or indirectly via a third component.

It will also be understood that when a certain component is referred to as being "on" or "over" another component, it can be directly on the other component or intervening components may also be present.

A washing machine according to various embodiments of the disclosure may be an example of a clothes treating apparatus.

The washing machine according to various embodiments of the disclosure may include a top-loading washing machine, wherein an inlet through which laundry is put into the top-loading washing machine is provided upward, or a front-loading washing machine, wherein an inlet through which laundry is put into the front-loading washing machine is provided forward. The washing machine according to various embodiments of the disclosure may include another loading type of washing machine, other than the top-loading washing machine and the front-loading washing machine.

The top-loading washing machine may wash laundry by using water streams generated by a rotating body such as a pulsator. The front-loading washing machine may wash laundry by rotating a drum to repeatedly raise and drop the laundry. The front-loading washing machine may include a lift for raising laundry. The washing machine according to various embodiments of the disclosure may include a washing machine using another washing method, other than a washing machine using the above-described washing method.

Embodiments of the disclosure may provide a washing machine capable of preventing surroundings from being contaminated while a filter device is managed.

Technical aspects of the disclosure are not limited to those described above, and other technical aspects not described herein will also be clearly understood by a person who has a common knowledge in the technical field to which the disclosure pertains from the following detailed description.

Hereinafter, a washing machine according to various embodiments of the disclosure will be described in detail with reference to the accompanying drawings.

Figure 2:
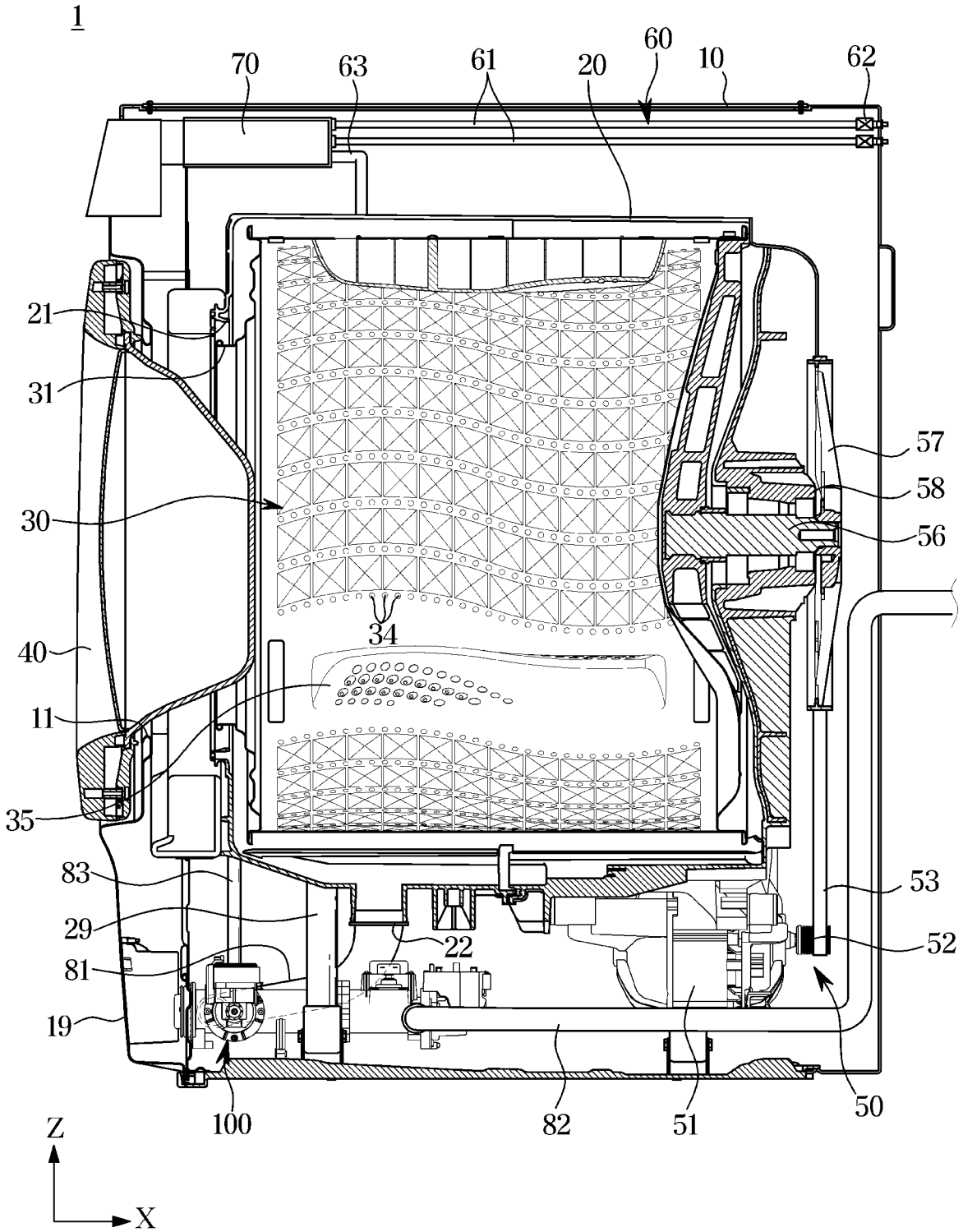
FIG. 2 shows a cross section of the washing machine shown in FIG. 1 according to an embodiment of the disclosure.

FIG. 1 shows a washing machine according to an embodiment of the disclosure. FIG. 2 shows a cross section of the washing machine shown in FIG. 1.

Referring to FIGS. 1 and 2, a washing machine 1 according to various embodiments of the disclosure may include a housing 10 accommodating various components therein.

The housing 10 may include a housing opening 11 for allowing an access to inside of a drum 30. A tub 20 may include a tub opening 21 corresponding to the housing opening 11. The drum 30 may include a drum opening 31 corresponding to the housing opening 11 and the tub opening 21. Laundry may be put into or withdrawn from the drum 30 through the housing opening 11, the tub opening 21, and the drum opening 31. The housing opening 11 may be formed substantially toward a front direction. The tub opening 21 may be formed substantially toward the front direction. The drum opening 31 may be formed substantially toward the front direction.

The washing machine 1 may include a control panel 14. The control panel 14 may be provided on the housing 10. The control panel 14 may include an inputter **14*a* for receiving an operation command from a user, and a display 14*b* for displaying operation information of the washing machine 1. The control panel 14 may provide a user interface for enabling a user to interact with the washing machine 1**.

Figure 7:
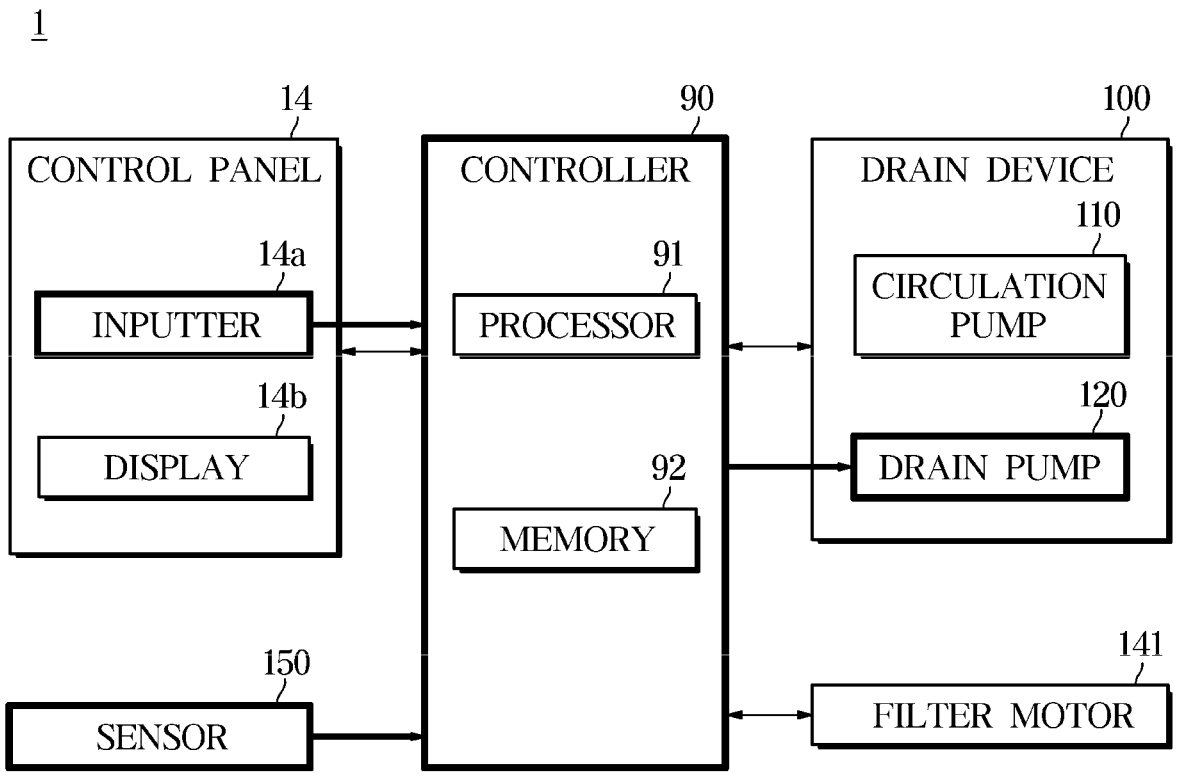
FIG. 7 is a control block diagram of a washing machine including the drain device shown in FIG. 3 according to an embodiment of the disclosure.

The inputter **14*a* may provide an electrical output signal corresponding to a user input to a controller 90 (see FIG. 7). The inputter 14*a*** may include, for example, a power button, an operation button, a course selection dial (or a course selection button), and a washing/rinsing/dehydrating setting button. The input button may include, for example, a tact switch, a push switch, a slide switch, a toggle switch, a micro switch, a touch switch, etc.

The display **14*b* may receive a signal from the controller 90, and display information corresponding to the received signal. The display 14*b* may include a screen for displaying an operation time of the washing machine 1 and a washing course selected by rotating the course selection dial (or pressing the course selection button), and an indicator for displaying a washing setting/rinsing setting/dehydrating setting selected by the setting button. The display 14*b*** may include, for example, a Liquid Crystal Display (LCD) panel, a Light Emitting Diode (LED) panel, etc.

The washing machine 1 may include a door 40 for opening or closing the housing opening 11 provided in the housing 10. The door 40 may be rotatably mounted on the housing 10 by a hinge 41. At least one portion of the door 40 may be transparent or translucent to show the inside of the housing 10.

The washing machine 1 may include the tub 20 provided inside the housing 10 to store water. The tub 20 may be supported on an inner surface of the housing 10. The tub 20 may have a substantially cylindrical shape of which one side opens.

The tub 20 may be elastically supported from the housing 10 by a damper 29. The damper 29 may connect the tub 20 to the housing 10. While vibrations generated according to a rotation of the drum 30 are transferred to the tub 20 and/or the housing 10, the damper 29 may absorb vibration energy between the tub 20 and the housing 10 to attenuate the vibrations.

The washing machine 1 may include the drum 30 accommodating laundry. The drum 30 may be rotatably provided inside the tub 20. The drum 30 may perform washing, rinsing, and/or dehydrating while rotating inside the tub 20. The drum 30 may include a through hole 34 that connects an inside space of the drum 30 to an inside space of the tub 20. The drum 30 may have a substantially cylindrical shape of which one side opens. On an inner circumferential surface of the drum 30, a plurality of lifters 35 may be provided to raise and drop laundry according to a rotation of the drum 30.

The washing machine 1 may include a driver 50 configured to rotate the drum 30. The driver 50 may include a driving motor 51, and a rotating shaft 56 for transferring a driving force generated in the driving motor 51 to the drum 30. The rotating shaft 56 may penetrate the tub 20 and be connected to the drum 30. The driver 50 may rotate the drum 30 forward and backward to perform a washing operation, a rinsing operation, and/or a dehydrating operation.

The drum 30 may be connected to the driving motor 51 through the rotating shaft 56, and according to connection types of the rotating shaft 56 and the driving motor 51, there may be a direct driving type in which the rotating shaft 56 is connected directly to the driving motor 51 to rotate the drum 30, and an indirect driving type in which pulleys 52 and 57 are connected between the driving motor 51 and the rotating shaft 56 to drive the drum 30. FIG. 2 shows a case in which the washing machine 1 is an indirect driving type. However, the washing machine 1 according to various embodiments of the disclosure may be a direct driving type.

The washing machine 1 according to various embodiments of the disclosure may be an indirect driving type. One end of the rotating shaft 56 may be connected to a rear portion of the drum 30, and another end of the rotating shaft 56 may be connected to a shaft pulley 57 to obtain a driving force from the driving motor 51. At a rotating shaft of the driving motor 51, a motor pulley 52 may be formed. A driving belt 53 may be provided between the motor pulley 52 and the shaft pulley 57 such that the rotating shaft 56 is driven by the driving belt 53.

The driving motor 51 may be positioned below the tub 20. The driving belt 53 may drive the rotating shaft 56 while rotating in a clockwise or counterclockwise direction in an up-down direction of the tub 20.

In the rear portion of the tub 20, a bearing housing 58 may be installed to rotatably support the rotating shaft 56. The bearing housing 58 may be made of an aluminum alloy. The bearing housing 58 may be inserted into the rear portion of the tub 20 upon injection-molding of the tub 20.

A water supply device 60 may supply water to the tub 20. The water supply device 60 may include a water supply pipe 61, and a water supply valve 62 provided in the water supply pipe 61. The water supply pipe 61 may be connected to an external water supply source. The water supply pipe 61 may extend to a detergent supply device 70 and/or the tub 20 from the external water supply source. Water may be supplied to the tub 20 via the detergent supply device 70. Water may be supplied to the tub 20 not via the detergent supply device 70.

The water supply valve 62 may open or close the water supply pipe 61 in response to an electrical signal from the controller 90. The water supply valve 62 may allow or block supply of water from the external water supply source to the tub 20. The water supply valve 62 may include, for example, a solenoid valve that is opened or closed in response to an electrical signal.

The washing machine 1 may include the detergent supply device 70 configured to supply a detergent to the tub 20. The detergent supply device 70 may supply a detergent to the inside of the tub 20 during a water supply process. Water supplied through the water supply pipe 61 may be mixed with a detergent via the detergent supply device 70. The water mixed with the detergent may be supplied to the inside of the tub 20. The detergent supply device 70 may be connected to the tub 20 through a connection pipe 63. The detergent may include a conditioner for dryer, a deodorant, a sterilizer, or an air freshener, as well as a washing detergent.

The washing machine 1 may include a drain device 100. The drain device 100 may be configured to discharge water accommodated in the tub 20 to outside. The drain device 100 may be connected to the tub 20.

The washing machine 1 may include a connecting guide 81 connecting the tub 20 to the drain device 100 such that water stored in the tub 20 enters the drain device 100. The connecting guide 81 may guide water discharged from the tub 20 to the drain device 100. In a lower portion of the tub 20, a drain 22 for discharging water stored in the tub 20 to the outside of the tub 20 may be formed. The drain 22 may be connected to the connecting guide 81.

The washing machine 1 may include a drain guide 82 extending from the drain device 100 to the outside of the housing 10 to discharge water entered into the drain device 100 to the outside of the housing 10. The drain guide 82 may guide water entered into the drain device 100 to the outside of the housing 10. The drain guide 82 may guide water pumped by the drain pump 120.

The washing machine 1 may include a circulation guide 83 extending from the drain device 100 to the tub 20 to circulate water entered into the drain device 100 to the tub 20. The circulation guide 83 may guide water entered into the drain device 100 to the tub 20.

In a lower portion of a front surface of the housing 10, a cover 19 covering the drain device 100 may be provided. A user may access the drain device 100 by opening the cover 19.

Figure 3:
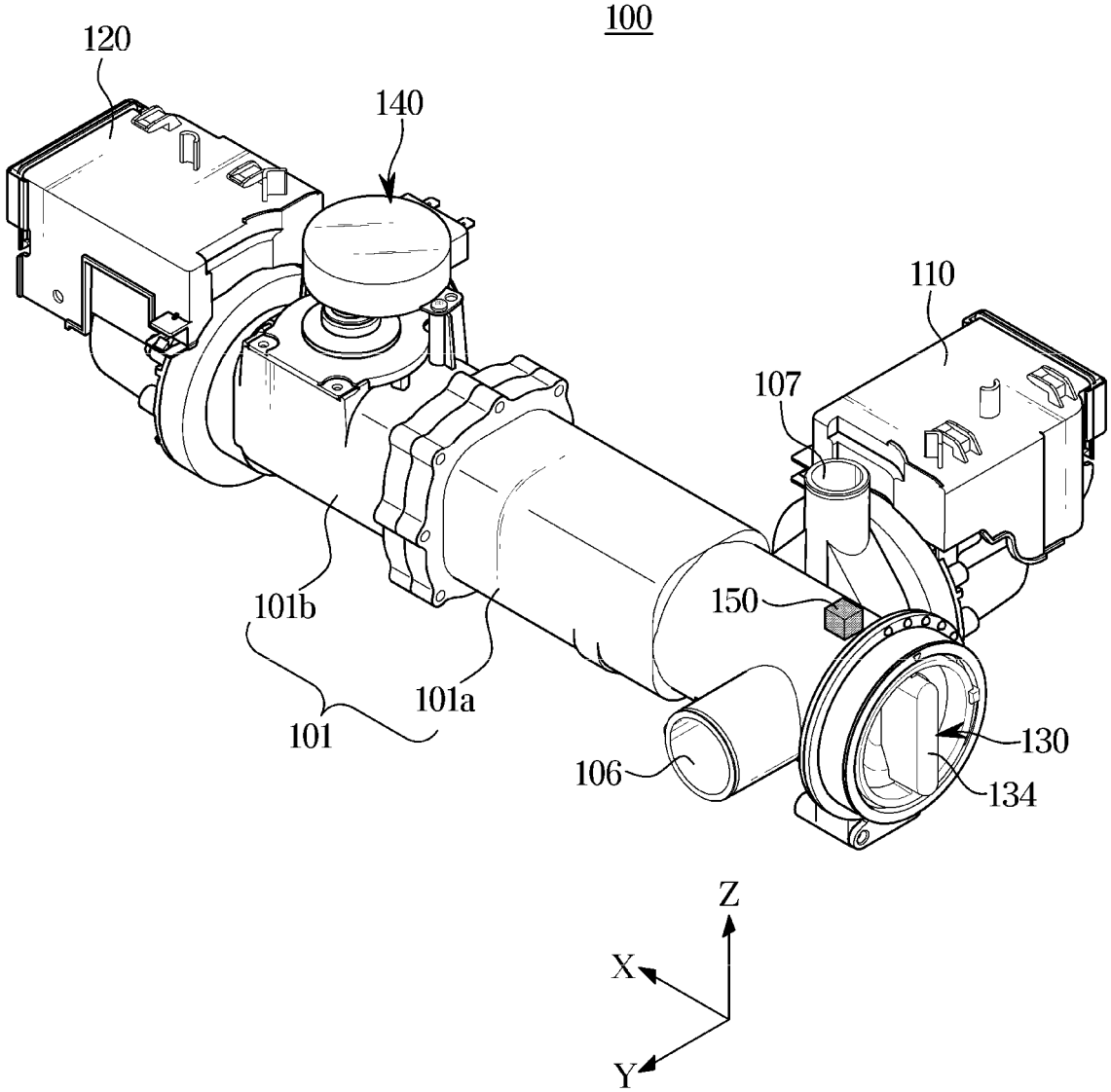
FIG. 3 shows a drain device shown in FIG. 2 according to an embodiment of the disclosure.
Figure 4:
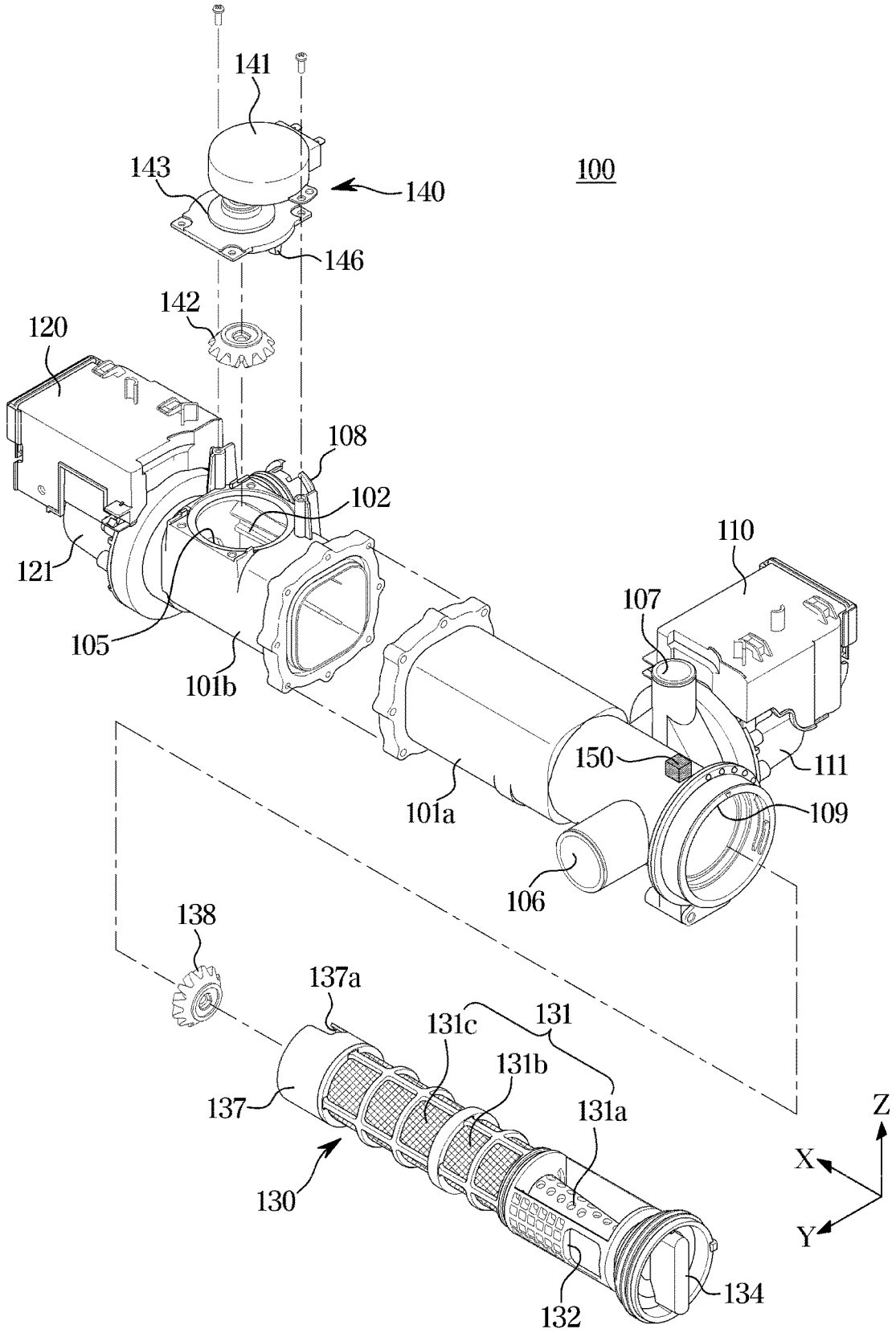
FIG. 4 is an exploded view of the drain device shown in FIG. 3 according to an embodiment of the disclosure.
Figure 5:
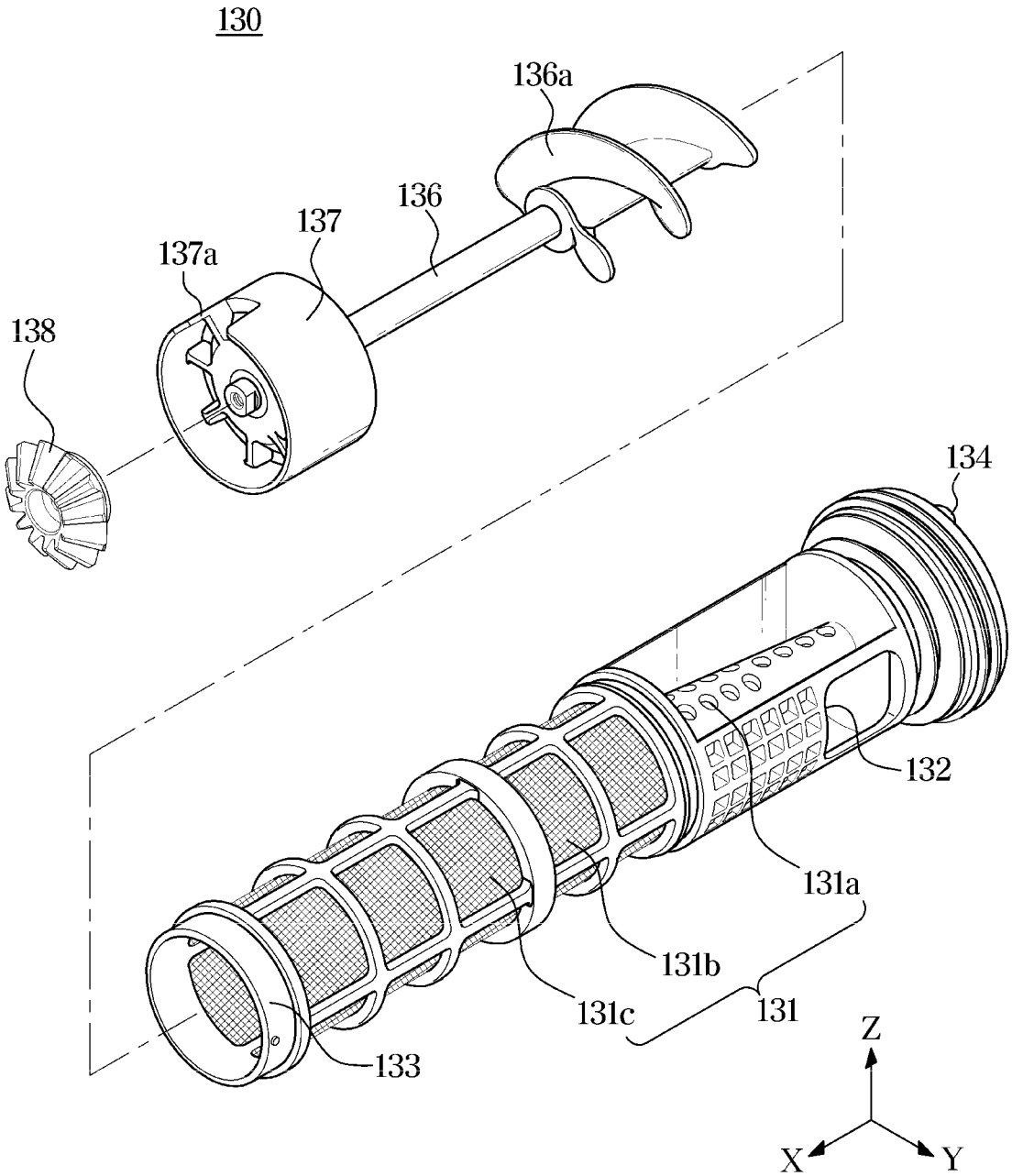
FIG. 5 is an exploded view of a filter device shown in FIG. 4 according to an embodiment of the disclosure.
Figure 6:
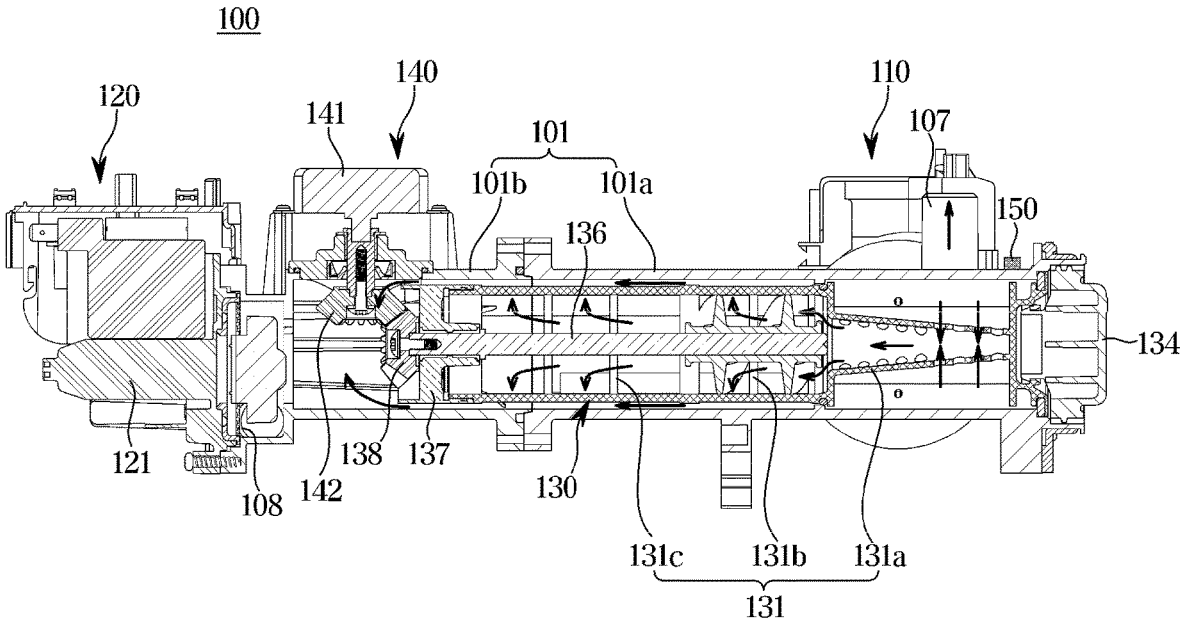
FIG. 6 shows a cross section of the drain device shown in FIG. 3 according to an embodiment of the disclosure.

FIG. 3 shows the drain device shown in FIG. 2. FIG. 4 is an exploded view of the drain device shown in FIG. 3. FIG. 5 is an exploded view of the filter device shown in FIG. 4. FIG. 6 shows a cross section of the drain device shown in FIG. 3.

Referring to FIGS. 2 to 4, the drain device 100 may be positioned below the tub 20. The drain device 100 may circulate water stored in the tub 20 or discharge water stored in the tub 20 to the outside of the washing machine 1.

The drain device 100 may include a case 101, and a pump 110 and 120 installed in the case 101. The pump 110 and 120 may include a circulation pump 110 and a drain pump 120.

The case 101 may form an appearance of the drain device 100. The case 101 may extend in an X-axis direction. The case 101 may accommodate the filter device 130. The circulation pump 110 may be installed in the case 101. The drain pump 120 may be installed in the case 101. A filter driver 140 may be installed in the case 101. The case 101 may include a first case 101*a* and a second case 101*b* detachably coupled to the first case 101*a*. The first case 101*a* and the second case 101*b* may be integrated into one body. The case 101 may be connected to the tub 20 by the connecting guide 81.

The circulation pump 110 may be installed in the first case 101*a*. An inlet 106 connected to the connecting guide 81 may be formed in the first case 101*a*. Water stored in the tub 20 may enter the drain device 100 through the inlet 106. A circulation opening 107 connected to the circulation guide 83 may be formed in the first case 101*a*. The circulation opening 107 may be adjacent to the circulation pump 110 to guide water circulating to the tub 20 by the circulation pump 110. In the first case 101*a*, a filter inserting opening 109 through which the filter device 130 is inserted may be formed.

The drain pump 120 may be installed in the second case 101*b*. A drain opening 108 connected to the drain guide 82 may be formed in the second case 101*b*. To guide water that is discharged to the outside of the housing 10 by the drain pump 120, the drain opening 108 may be adjacent to the drain pump 120. The filter driver 140 may be installed in the second case 101*b*. A driver inserting hole 105 through which a portion of the filter driver 140 is inserted may be formed in the second case 101*b*.

The inlet 106 may be substantially perpendicular to the circulation opening 107. The inlet 106 may extend in a Y-axis direction. The circulation opening 107 may extend in a Z-axis direction. The inlet 106 and the circulation opening 107 may be formed in one end of the case 101 in which the circulation pump 110 is positioned. The inlet 106 and/or the circulation opening 107 may be adjacent to the circulation pump 110.

The drain opening 108 may be substantially perpendicular to the direction in which the case 101 extends. The drain opening 108 may extend in the Y-axis direction. The drain opening 108 may be formed in another end of the case 101, which is opposite to the one end of the case 101 in which the circulation pump 110 is positioned. The drain opening 108 may be positioned in the other end of the case 101, in which the drain pump 120 is positioned. The drain opening 108 may be adjacent to the drain pump 120.

The drain device 100 may include the circulation pump 110 for circulating water stored in the tub 20. The circulation pump 110 may be installed in the case 101. The circulation pump 110 may be installed in the first case 101*a*. The circulation pump 110 may be positioned in the one end of the case 101 in which the inlet 106 is formed. The circulation pump 110 may be adjacent to the inlet 106. The circulation pump 110 may be opposite to the inlet 106. The circulation pump 110 may include a circulation motor 111 for generating a rotation force in the Y-axis direction. The circulation motor 111 may form a water stream of water entered into the inlet 106 such that the water is discharged through the circulation opening 107.

The drain device 100 may include the drain pump 120 for discharging water stored in the tub 20 to the outside of the housing 10. The drain pump 120 may be installed in the case 101. The drain pump 120 may be installed in the second case 101*b*. The drain pump 120 may be positioned in the other end of the case 101, the other end being opposite to the one end of the case 101 in which the inlet 106 is formed. The drain pump 120 may be more distant from the inlet 106 than the circulation pump 110. The drain pump 120 may include a drain motor 121 for generating a rotation force in the X-axis direction. The drain motor 121 may form a water stream of water entered into the inlet 106 such that the water is discharged through the drain opening 108.

A rotation axis (being parallel to the Y-axis direction) of the circulation motor 111 may be different from a rotation axis (being parallel to the X-axis direction) of the drain motor 121. The rotation axis of the circulation motor 111 may be perpendicular to the rotation axis of the drain motor 121.

Referring to FIGS. 4 and 5, the drain device 100 may include the filter device 130 for filtering water that is discharged through the drain pump 120. The filter device 130 may extend in the X-axis direction. The filter device 130 may be accommodated in the case 101. The filter device 130 may filter water entered into the drain device 100. The filter device 130 may be detachably installed in the case 101.

The filter device 130 may include a filter 131, and a filter blade 136 rotatably provided inside the filter 131.

The filter 131 may be detachably installed inside the case 101. The filter 131 may be positioned between the circulation pump 110 and the drain pump 120. The filter 131 may be positioned between the inlet 106 and the drain opening 108. The filter 131 may include a first filter portion 131*a*, a second filter portion 131*b*, and a third filter portion 131*c*.

The filter 131 may include a filter opening 132 that opens toward the inlet 106 in a state in which the filter 131 is installed in the case 101. Water entered into the inlet 106 may move to inside of the filter 131 through the filter opening 132.

The water entered into the inside of the filter 131 through the filter opening 132 may be primarily filtered in the first filter portion 131*a*. The first filter portion 131*a* may include a plurality of openings. The first filter portion 131*a* may filter foreign materials having relatively large sizes. The water filtered in the first filter portion 131*a* may move to the tub 20 by the circulation pump 110. The water filtered in the first filter portion 131*a* may move to the second filter portion 131*b* by the drain pump 120.

The water passed through the first filter portion 131*a* may be secondarily filtered by passing through the second filter portion 131*b* and/or the third filter portion 131*c*. In the third filter portion 131*c*, foreign materials separated from the second filter portion 131*b* by the filter blade 136 may be collected. The second filter portion 131*b* and the third filter portion 131*c* may include a mesh filter. The second filter portion 131*b* and/or the third filter portion 131*c* may filter foreign materials having relatively small sizes. The second filter portion 131*b* and/or the third filter portion 131*c* may filter foreign materials having relatively smaller sizes than those of foreign materials that the first filter portion 131*a* may filter. The second filter portion 131*b* and/or the third filter portion 131*c* may filter fine foreign materials.

The first filter portion 131*a*, the second filter portion 131*b*, and the third filter portion 131*c* may be positioned sequentially along a flow direction of water.

Referring to FIGS. 3 to 6, while the circulation pump 110 operates, water entered into the drain device 100 through the inlet 106 may be filtered by passing through the first filter portion 131*a*, and then discharged to the outside of the drain device 100 through the circulation opening 107.

While the drain pump 120 operates, water entered into the drain device 100 through the inlet 106 may be primarily filtered in the first filter portion 131*a*.

The water primarily filtered in the first filter portion 131*a* may move to the second filter portion 131*b*. Water secondarily filtered by passing through the second filter portion 131*b* may pass through the third filter portion 131*c*. Water not filtered while passing through the second filter portion 131*b* may be filtered in the third filter portion 131*c*. Water passed through the filter 131 may be discharged to outside of the drain device 100 through the drain opening 108.

The filter 131 may include a blade installing portion 133 in which the filter blade 135 is installed. The blade installing portion 133 may be positioned in another end of the filter 131, the other end being opposite to one end of the filter 131 in which a filter handle 134 is positioned.

The filter 131 may include the filter handle 134. The filter handle 134 may be exposed to outside of the case 101 in a state in which the filter 131 is installed in the case 101. A user may separate the filter 131 from the case 101 by using the filter handle 134.

The filter blade 136 may be rotatably provided inside the filter 131. The filter blade 136 may include a blade wing 136*a*. The blade wing 136*a* may be formed in a shape of a spiral extending in a radial direction from a rotation shaft of the filter blade 136 along a rotation axis direction (that is, the X-axis direction) of the filter blade 136. The blade wing 136*a* may correspond to the second filter portion 131*b*. The blade wing 136*a* may remove foreign materials collected on an inner surface of the filter 131 by scraping out the foreign materials according to a rotation of the filter blade 136 inside the filter 131. The blade wing 136*a* may include a relatively flexible material.

The filter device 130 may include a blade supporting portion 137 rotatably supporting the filter blade 136. The blade supporting portion 137 may be fixed to the filter 131. The blade supporting portion 137 may be installed in the blade installing portion 133.

The blade supporting portion 137 may include an accommodation guide 137*a* formed at a portion in a circumferential direction. The accommodation guide 137*a* may be in a shape of a groove. A blade guide 146 provided in a driving bracket 143 may be accommodated in the accommodation guide 137*a*. Upon installing of the filter device 130 in the case 101 in a state in which the filter driver 140 is installed in the second case 101*b*, the accommodation guide 137*a* may be arranged to accommodate the blade guide 146. Upon installing of the filter device 130 in the case 101, the accommodation guide 137*a* of the filter device 130 may be guided by the blade guide 146 of the filter driver 140. Accordingly, the filter device 130 may be installed at a correct location in the case 101.

A filter guide 102 for guiding installation of the filter device 130 may be formed inside the second case 101*b* of the case 101. The filter guide 102 may protrude from an inner surface of the second case 101*b*. The filter guide 102 may be inclined in such a way as to further protrude toward inside of the case 101 along a direction in which the filter device 130 is installed. Accordingly, the filter device 130 may be guided to the correct location while being inserted into the inside of the case 101.

The filter device 130 may include a filter gear 138 coupled to another end of the filter device 130, the other end being opposite to one end of the filter device 130 at which the blade wing 136*a* of the filter blade 136 is positioned. The filter gear 138 may be fixed to the filter blade 136. The filter gear 138 may be engaged with a driving gear 142. The filter gear 138 may have a rotation axis in the X-axis direction. The rotation axis of the filter gear 138 may be identical to the rotation axis of the drain motor 121. The filter gear 138 may be a bevel gear.

The drain device 100 may include the filter driver 140 for driving the filter device 130. The filter driver 140 may be installed in the case 101. The filter driver 140 may be installed in the second case 101*b*. The filter driver 140 may include a filter motor 141, the driving gear 142, and the driving bracket 143.

The filter motor 141 may generate power for rotating the filter blade 136. The filter motor 141 may generate a rotation force along an axis extending in the Z-axis direction. The filter motor 141 may be closer to the drain pump 120 than the circulation pump 110. The filter motor 141 may be adjacent to the drain opening 108.

The driving gear 142 may rotate in the Z-axis direction by receiving a rotation force from the filter motor 141. A rotation axis (being parallel to the Z-axis direction) of the driving gear 142 may be different from the rotation axis (being parallel to the X-axis direction) of the drain motor 121. The driving gear 142 may be a bevel gear.

The rotation axis of the filter gear 138 coupled to the filter blade 136 may extend along the X-axis direction, and the rotation axis of the driving gear 142 of the filter driver 140 may extend along the Z-axis direction. The rotation axis of the filter gear 138 may form a preset angle with respect to the rotation axis of the driving gear 142. The rotation axis of the filter gear 138 may be perpendicular to the rotation axis of the driving gear 142.

The driving bracket 143 may be fixed to the case 101. The blade guide 146 may be provided in the driving bracket 143.

The washing machine 1 may include a sensor 150 for detecting installation of the filter 131 in the case 101. The sensor 150 may be installed in the case 101. The sensor 150 may be adjacent to the filter 131. The sensor 150 may be adjacent to the filter handle 134. The sensor 150 may be adjacent to the other end of the filter 131, the other end being opposite to the one end of the filter 131 in which the filter handle 134 is positioned. The sensor 150 may be positioned to correspond to a substantially center portion of the filter 131 in a direction (the X-axis direction) in which the filter 131 extends. The sensor 150 may be positioned on an outer circumferential surface of the case 101. The sensor 150 may be positioned between an inner circumferential surface of the case 101 and the filter 131.

The sensor 150 may detect coupling of the filter device 130 to the case 101. The sensor 150 may detect dismounting of the filter device 130 from the case 101. Dismounting of the filter device 130 from the case 101 may mean that the filter inserting opening 109 starts opening according to an operation of the filter device 130. The sensor 150 may be one among an optical sensor, a magnetic sensor, an infrared sensor, or a pressure sensor. However, a kind of the sensor 150 is not limited to these, and the sensor 150 may be implemented as various kinds of sensors (for example, an image sensor or an ultrasonic sensor) capable of detecting coupling of the filter device 130 to the case 101.

According to various embodiments of the disclosure, the sensor 150 may detect openness or closing of the cover 19.

FIG. 7 is a control block diagram of a washing machine including the drain device shown in FIG. 3.

A method for preventing remaining water existing in the case 101 of the drain device 100 from being discharged to the outside of the case 101 through the filter inserting opening 109 while the filter device 130 is dismounted from the case 101 of the drain device 100 shown in FIG. 4 will be described with reference to FIG. 7.

Referring to FIG. 7, the washing machine 1 according to an embodiment of the disclosure may include the control panel 14 for interactions with a user, the sensor 150, the controller 90 for controlling the drain device 100 based on data and/or information received from the sensor 150, and the drain device 100 that operates based on a control signal from the controller 90.

The controller 90 may include at least one memory 92 and at least one processor 91 for performing the above-described operations and operations which will be described below.

According to an embodiment of the disclosure, the controller 90 may include at least one memory 92 that stores data in the form of an algorithm and/or program for controlling operations of components in the washing machine 1, and at least one processor 91 that performs the above-described operations and operations which will be described below by using the data stored in the at least one memory 92. The memory 92 and the processor 91 may be implemented with separate chips. The processor 91 may include one, two, or more processor chips or one, two, or more processing cores. The memory 92 may include one, two, or more memory chips or one, two, or more memory blocks. Also, the memory 92 and the processor 91 may be implemented with a single chip.

The controller 90 may process a user input received through the inputter 14*a*, and control various components (for example, the driving motor 51, the water supply valve 62, the display 14*b*, and the drain device 100) of the washing machine 1 based on a result of the processing on the user input.

For example, the controller 90 may control various components of the washing machine 1 to perform at least one operation including a water supply operation, a washing operation, a rinsing operation, and/or a dehydrating operation according to a user input inputted to the control panel 14. For example, the controller 90 may control the driving motor 51 to adjust a rotation speed of the tub 20, or control the water supply valve 62 of the water supply device 60 to supply water to the tub 20.

The controller 90 may operate, while performing a washing operation and/or a rinsing operation, the circulation pump 110 to circulate water received from the drain device 100 to the tub 20.

According to an embodiment of the disclosure, the controller 90 may detect, while operating the circulation pump 110, a load of the circulation pump 110 and detect clogging of the filter device 130 based on a load value of the circulation pump 110. For example, the controller 90 may detect clogging of the filter device 120 based on an identification that a load value of the circulation pump 110, which exceeds a preset value, is maintained for a preset time.

For this, the washing machine 1 may include a current sensor (not shown) for detecting driving current applied to the circulation pump 110, a power sensor (not shown) for detecting power applied to the circulation pump 110, and/or a speed sensor (not shown) for detecting a rotation speed of the circulation pump 110.

The controller 90 may obtain, while operating the circulation pump 110, a load value of the circulation pump 110 based on sensor data obtained from the current sensor (not shown) for detecting driving current applied to the circulation pump 110, the power sensor (not shown) for detecting power applied to the circulation pump 110, and/or the speed sensor (not shown) for detecting a rotation speed of the circulation pump 110.

According to an embodiment of the disclosure, the controller 90 may operate, while performing a washing operation and/or a rinsing operation, the drain pump 120 to discharge water stored in the tub 20 to the outside of the washing machine 1. For example, the controller 90 may operate the drain pump 120 based on completion of a washing cycle of a washing operation, and operate the drain pump 120 based on completion of a rinsing cycle of a rinsing operation.

The controller 90 may detect, while operating the drain pump 120, a load of the drain pump 120, and detect clogging of the filter device 130 based on a load value of the drain pump 120. For example, the controller 90 may detect clogging of the filter device 130 based on an identification that a load value of the drain pump 120, which exceeds the preset value, is maintained for the preset time.

For this, the washing machine 1 may include a current sensor (not shown) for detecting driving current applied to the drain pump 120 while the drain pump 120 operates, a power sensor (not shown) for detecting driving current applied to the drain pump 120 while the drain pump 120 operates, and/or a speed sensor (not shown) for detecting a rotation speed of the drain pump 120 while the drain pump 120 operates.

The controller 90 may obtain, while operating the drain pump 120, a load value of the drain pump 120 based on sensor data obtained from the current sensor (not shown) for detecting driving current applied to the drain pump 120, the power sensor (not shown) for detecting power applied to the drain pump 120, and/or the speed sensor (not shown) for detecting a rotation speed of the drain pump 120.

According to an embodiment of the disclosure, the controller 90 may detect clogging of the filter device 130 based on a change in water level of the tub 20 while operating the drain pump 120.

For example, the controller 90 may detect clogging of the filter device 130 based on an identification that a change amount in water level of the tub 20 per unit time is smaller than a preset value, while operating the drain pump 120.

For this, the washing machine 1 may include a water level sensor (not shown) for detecting a water level of the tub 20.

According to an embodiment of the disclosure, the controller 90 may operate the filter motor 141 while operating the circulation pump 110 or the drain pump 120.

The controller 90 may detect a load of the filter motor 141 while operating the filter motor, and detect clogging of the filter device 130 based on a load value of the filter motor 141. For example, the controller 90 may detect clogging of the filter device 130 based on an identification that a load value of the filter motor 141, which exceeds the preset value, is maintained for the preset time.

According to various embodiments of the disclosure, the controller 90 may control the display **14*b* to output a visual feedback representing clogging of the filter device 130 based on a detection of the clogging of the filter device 130**.

The visual feedback representing the clogging of the filter device 130 may include various visual indications, such as a character, a figure, a symbol, an icon, an image, and/or an animation.

According to an embodiment of the disclosure, a user may easily recognize clogging of the filter device 130 by the visual feedback, and manage the filter device 130.

The user who wants to manage the filter device 130 may separate the filter device 130 from the case 101 by opening the cover 19 shown in FIG. 1 and then operating the filter handle 34 shown in FIG. 3.

According to an embodiment of the disclosure, the sensor 150 may detect separation of the filter device 130 from the case 101, or openness of the cover 19.

The controller 90 may process sensor data received through the sensor 150, and control various components (for example, the drain device 100) of the washing machine 1 based on a result of the processing on the sensor data.

For example, the controller 90 may operate the drain pump 120 based on a result of processing on sensor data received through the sensor 150.

According to an embodiment of the disclosure, the controller 90 may operate the drain pump 120 based on a detection of separation of the filter device 130 from the case 101 by the sensor 150. According to a detection of dismounting of the filter device 130 from the case 101 by the sensor 150, the controller 90 may control the drain pump 120 to discharge water of the case 101 to the outside of the case 101 through the drain opening 108.

According to an embodiment of the disclosure, the controller 90 may operate the drain pump 120 based on a detection of openness of the cover 19 by the sensor 150. According to a detection of openness of the cover 19 by the sensor 150, the controller 90 may control the drain pump 120 to discharge water of the case 101 to the outside of the case 101 through the drain opening 108.

According to an embodiment of the disclosure, the controller 90 may stop operating the drain pump 120 based on a detection of coupling of the filter device 130 to the case 101 by the sensor 150.

According to an embodiment of the disclosure, the controller 90 may stop operating the drain pump 120 based on a detection of closing of the cover 19 by the sensor 150.

According to an embodiment of the disclosure, the washing machine 1 may prevent water remaining in the case 101 from being discharged to the outside through the filter inserting opening 109 by operating the drain pump 120 upon separating of the filter device 130 from the case 101 to manage (maintain and/or repair) the filter device 130, and accordingly, the washing machine 1 may prevent surroundings from being contaminated.

Figure 8:
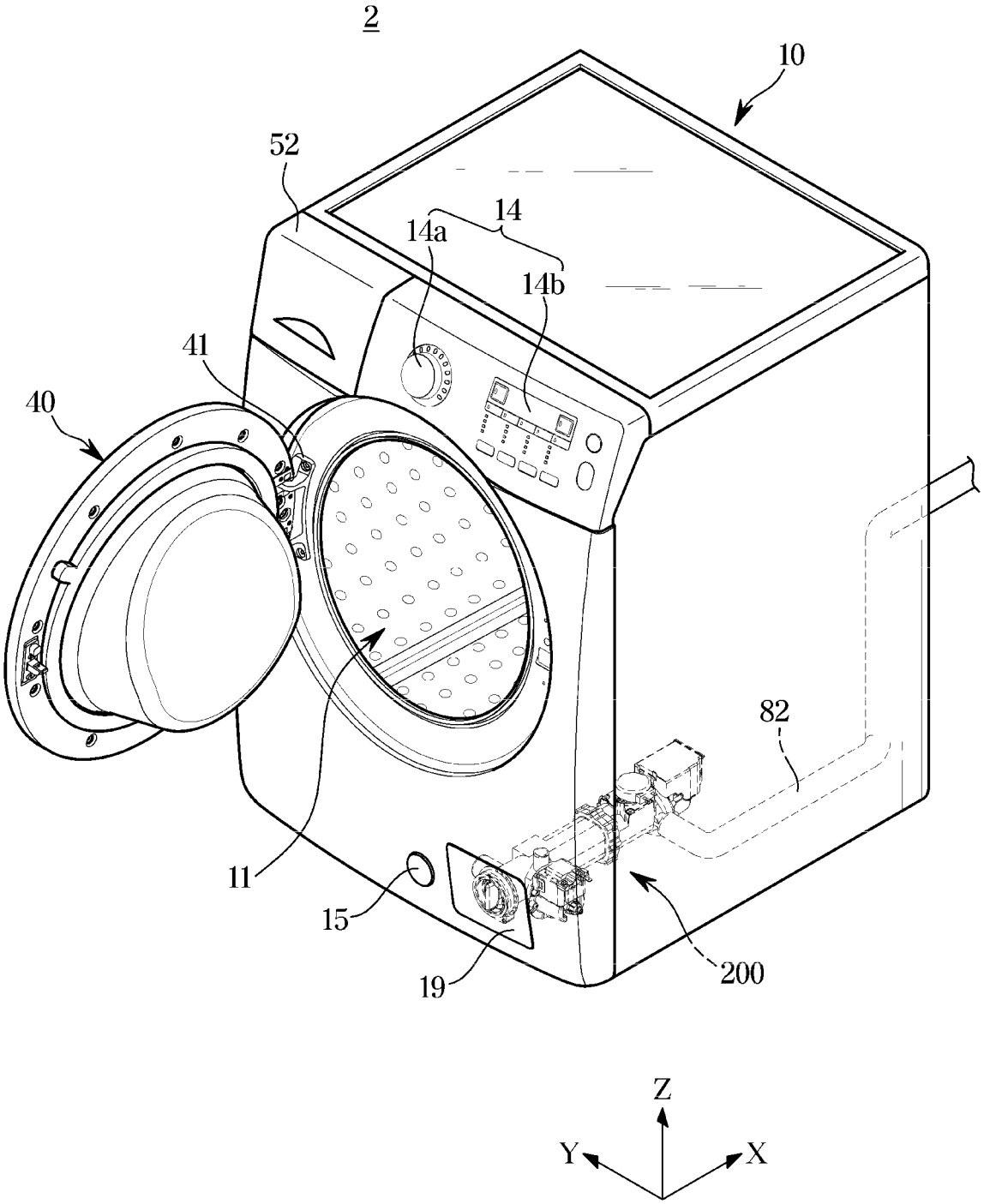
FIG. 8 shows a washing machine including a drain device according to an embodiment of the disclosure.
Figure 9:
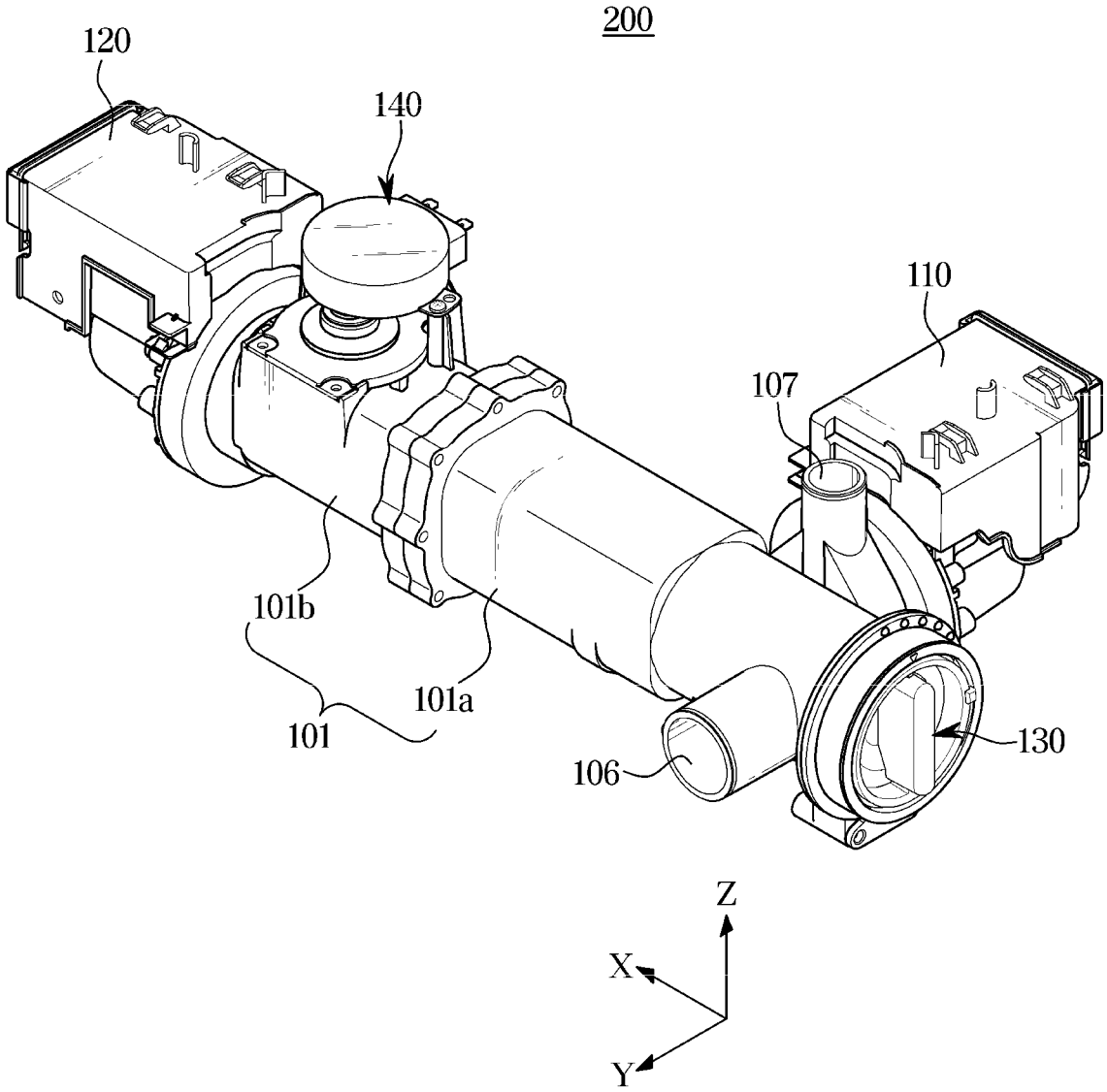
FIG. 9 shows the drain device shown in FIG. 8 according to an embodiment of the disclosure.
Figure 10:
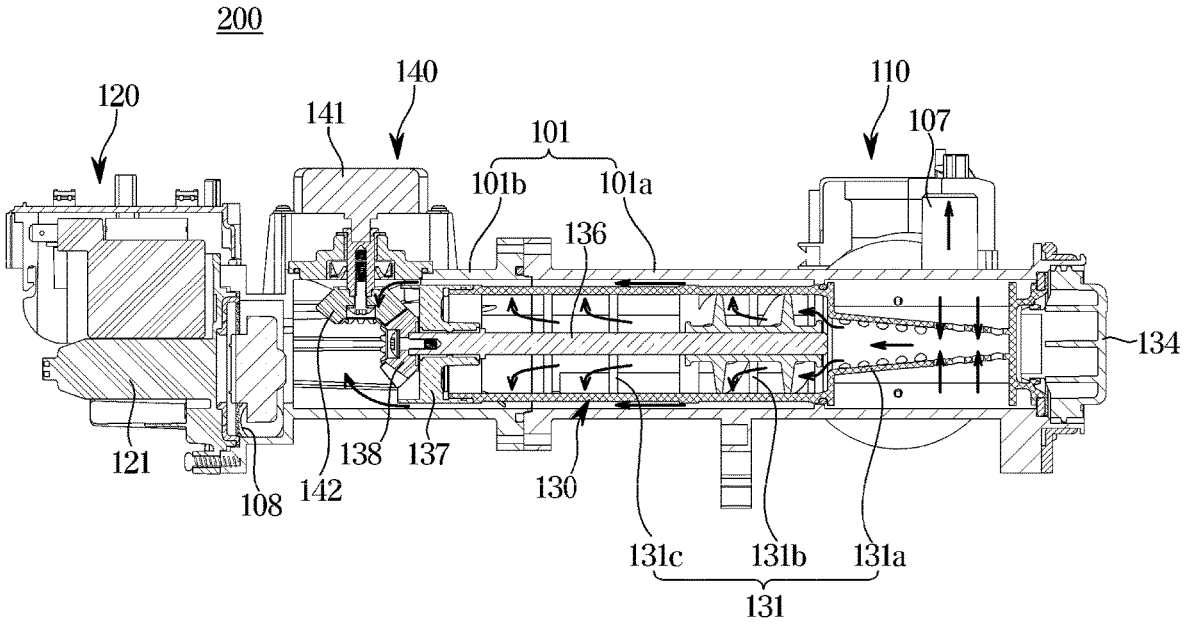
FIG. 10 shows a cross section of the drain device shown in FIG. 9 according to an embodiment of the disclosure.

FIG. 8 shows a washing machine including a drain device according to an embodiment of the disclosure. FIG. 9 shows the drain device shown in FIG. 8. FIG. 10 shows a cross section of the drain device shown in FIG. 9.

A drain device 200 of a washing machine 2 according to an embodiment of the disclosure will be described with reference to FIGS. 8 to 10. In the following description about the drain device 200 shown in FIGS. 8 to 10, the same components as those of the drain device 100 shown in FIGS. 3 to 6 may be assigned like reference numerals and detailed descriptions thereof will be omitted.

Referring to FIGS. 8 to 10, the drain device 200 may include the case 101, the circulation pump 110 for circulating water stored in the tub 20, the drain pump 120 for discharging water stored in the tub 20 to the outside of the housing 10, the filter device 130 for filtering water discharged through the drain pump 120, and the filter driver 140 for driving the filter device 130.

The drain device 200 shown in FIGS. 8 to 10 may omit the sensor 150 of the drain device 100 shown in FIGS. 3 to 6. The washing machine 2 may include an input device 15 for receiving a command for operating the drain pump 120 from a user. The input device 15 may receive a command for operating the drain device 120 from a user by being pressed. The input device 15 may receive a command for operating the drain device 120 from a user by being touched. The input device 15 may be adjacent to the cover 19.

According to this configuration, the washing machine 2 according to various embodiments of the disclosure may prevent water remaining in the case 101 from being discharged to the outside through the filter inserting opening 109 by operating the drain pump 120 upon separating of the filter device 130 from the case 101 to manage (maintain and/or repair) the filter device 130, and accordingly, the washing machine 2 may prevent surroundings from being contaminated.

Figure 11:
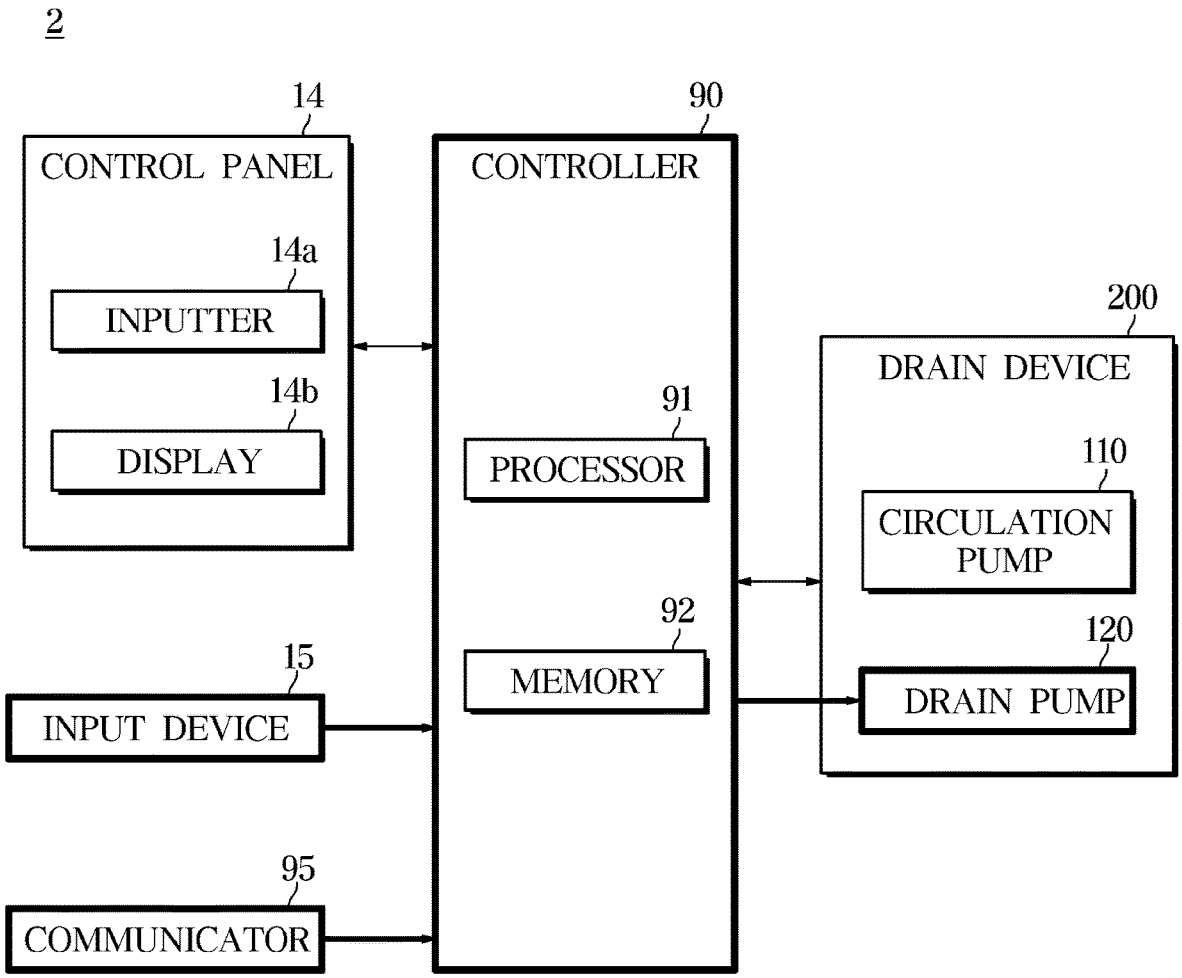
FIG. 11 is a control block diagram of a washing machine including the drain device shown in FIG. 9 according to an embodiment of the disclosure.

FIG. 11 is a control block diagram of a washing machine including the drain device shown in FIG. 9.

A method for preventing remaining water existing in the drain device 200 from being discharged to the outside of the case 101 upon dismounting of the filter 131 from the case 101 of the drain device 200 shown in FIGS. 8 to 10 will be described with reference to FIG. 11.

Referring to FIG. 11, the washing machine 2 according to an embodiment of the disclosure may include the control panel 14, the input device 15, a communicator 95, the controller 90, and the drain device 200. The washing machine 2 according to an embodiment of the disclosure may not include the sensor 150 among the components of the washing machine 1 shown in FIG. 7.

That is, the drain device 200 according to an embodiment of the disclosure may not include the sensor 150.

According to various embodiments of the disclosure, the washing machine 2 according to an embodiment of the disclosure may include the input device 15 provided adjacent to the cover 19 without being provided on the control panel 14. For example, the inputter 15 may be positioned on the front surface of the housing 10 below the door 40. Also, the input device 15 may be positioned on the front surface of the housing 10 and positioned to one side of the cover 19.

The input device 15 may be implemented as a tact switch, a push switch, a slide switch, a toggle switch, a micro switch, or a touch switch. However, a kind of the input device 15 is not limited to these.

The input device 15 may be used to operate the drain pump 120.

The controller 90 may operate the drain pump 120 based on reception of a command input through the input device 15.

For example, the input device 15 implemented as a push switch may generate an electrical signal by being pressed by a user, and the controller 90 may operate the drain pump 120 based on reception of the electrical signal from the input device 15.

The user who wants to manage the filter device 130 may operate the input device 15 before operating the filter handle 134, and according to an operation of the input device 15, the drain pump 120 may operate to prevent water remaining in the case 101 from being discharged to the outside through the filter inserting opening 109 upon separating of the filter device 130 from the case 101.

According to the disclosure, because the input device 15 is provided around the cover 19, the user may easily operate the drain pump 120 before opening the cover 19.

According to various embodiments of the disclosure, a location of the input device 15 may change. FIG. 11 shows the inputter 14*a* and the input device 15 separately. However, according to an embodiment of the disclosure, the input device 15 may be provided on the control panel 14, or may be a component of the inputter 14*a*.

According to an embodiment of the disclosure, the input device 15 may include a visual indicator representing an operation state of the drain pump 120. For example, the input device 15 implemented as a push switch may generate an electrical signal for operating the visual indicator by being pressed by the user.

According to the disclosure, the user may intuitively recognize an operation state of the drain pump 120.

The controller 90 may stop operating the drain pump 120 based on reception of a command input through the input device 15 while operating the drain pump 120.

For example, the controller 90 may stop the drain pump 120 based on an identification that the input device 15 implemented as a push switch is pressed by a user while the drain device 120 operates.

After the user finishes management of the filter device 130, the user may install the filter device 130 in the case 101, close the cover 19, and again operate the input device 15 to stop operating the drain device 120.

Meanwhile, in a case in which the user finishes management of the filter device 130 and then leaves without again operating the input device 15, that is, without stopping the drain pump 120, unnecessary energy may be consumed and noise may be generated.

According to various embodiments of the disclosure, based on elapse of a preset time (for example, about 10 minutes) after the controller 90 operates the drain pump 120 based on reception of a command input through the input device 15, the controller 90 may stop operating the drain pump 120.

According to an embodiment of the disclosure, although the user finishes management of the filter device 130 and then leaves without stopping the drain pump 120, the drain pump 120 may stop.

Meanwhile, the washing machine 1 according to an embodiment of the disclosure may also include the input device 15, which is not shown in FIG. 7, and the above-described embodiment related to the input device 15 may be applied to the washing machine 1.

The washing machine 2 according to an embodiment of the disclosure may include the communicator 95 for communicating with an external device.

The communicator 95 may transmit data to the external device based on a control signal from the controller 90, or receive data from the external device. For example, the communicator 95 may transmit and receive various data by communicating with a server and/or a user terminal and/or a home appliance.

For this, the communicator 95 may support establishment of a direct (for example, wired) communication channel or a wireless communication channel with an external electronic device (for example, a server, a user terminal, and/or a home appliance), and communications through an established communication channel. According to an embodiment of the disclosure, the communicator 95 may include a wireless communication module (for example, a cellular communication module, a short-range communication module, or a global navigation satellite system (GNSS) communication module) or a wired communication module (for example, a local area network (LAN) communication module or a power line communication module). A corresponding communication module among the communication modules may communicate with an external electronic device through a first network (for example, a short-range communication network, such as Bluetooth, WiFi Direct, or Infrared data association (IrDA)) or a second network (for example, a long-range communication network, such as a legacy cellular network, a $5^{th}$ Generation (5G) network, a next-generation communication network, the Internet, or a computer network (for example, a LAN or a wide area network (WAN)). The various kinds of communication modules may be integrated into a single component (for example, a single chip) or implemented with a plurality of separate components (for example, a plurality of chips).

According to various embodiments of the disclosure, the communicator 95 may establish communication with a user terminal through a server.

According to various embodiments of the disclosure, the communicator 95 may include a WiFi module, and communicate with an external server and/or a user terminal based on communication establishment with an Access Point (AP) in home.

The controller 90 may operate the drain pump 120 based on reception of a command for operating the drain pump 120 from a user terminal through the communicator 95.

According to various embodiments of the disclosure, the controller 90 may control the communicator 95 to transmit a message notifying clogging of the filter device 130 to the user terminal based on a detection of clogging of the filter device 130.

The user may recognize clogging of the filter device 130 through the user terminal.

The user terminal may provide an interface including a user interface element for operating the drain pump 120 based on reception of the message notifying clogging of the filter device 130.

The user terminal may transmit a command for operating the drain pump 120 to the communicator 95 based on a selection of the user interface element for operating the drain pump 120, and the controller 90 may operate the drain pump 120 based on reception of the command for operating the drain pump 120 from the user terminal through the communicator 95.

According to an embodiment of the disclosure, after the user recognizes clogging of the filter device 130 through the user terminal, the user may easily operate the drain pump 120 before managing the filter device 130.

Also, the user terminal may provide an interface including a user interface element for stopping the drain pump 120 based on the transmission of the command for operating the drain pump 120 to the communicator 95.

The user terminal may transmit a command for stopping the drain pump 120 to the communicator 95 based on a selection of the user interface element for stopping the drain pump 120, and the controller 90 may stop the drain pump 120 based on reception of the command for stopping the drain pump 120 from the user terminal through the communicator 95.

Meanwhile, the washing machine 1 according to an embodiment of the disclosure may also include the communicator 95, which is not shown in FIG. 7, and the above-described embodiment related to the communicator 95 may also be applied to the washing machine 1.

According to the disclosure, the drain pump 120 may operate according to a user's intention for managing the filter device 130, without the sensor 150.

Figure 12:
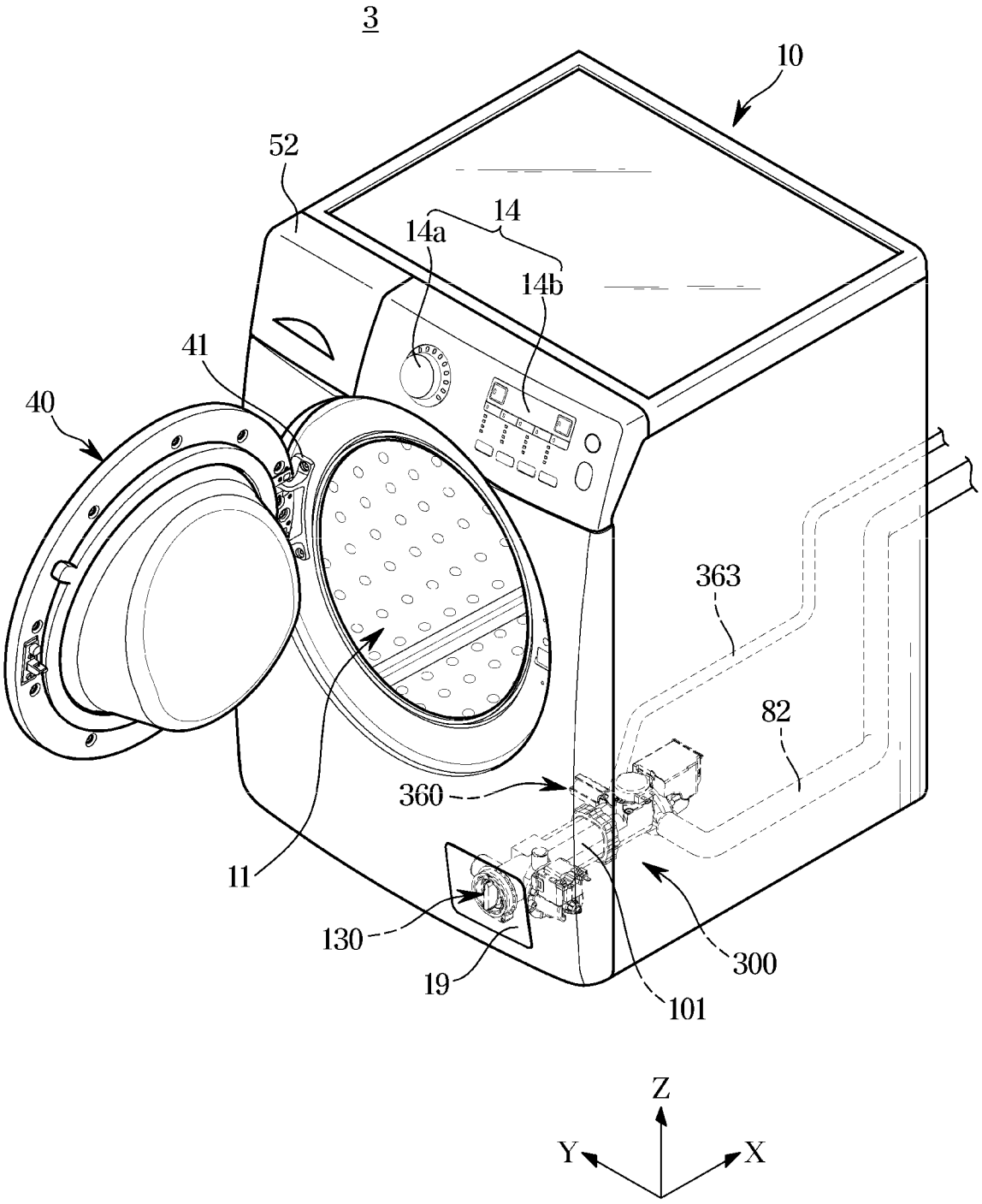
FIG. 12 shows a washing machine including a drain device according to an embodiment of the disclosure.
Figure 13:
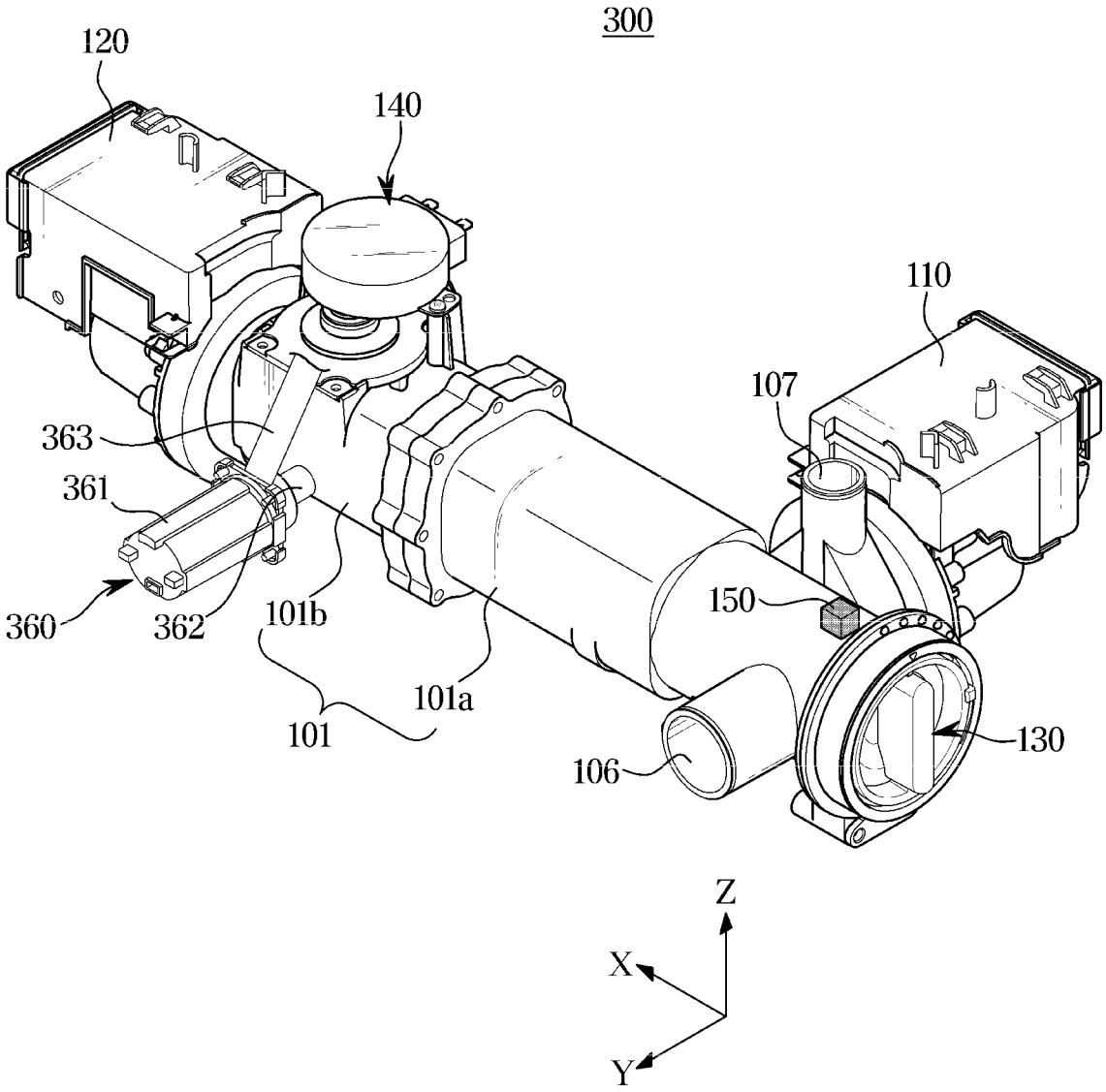
FIG. 13 shows the drain device shown in FIG. 12 according to an embodiment of the disclosure.
Figure 14:
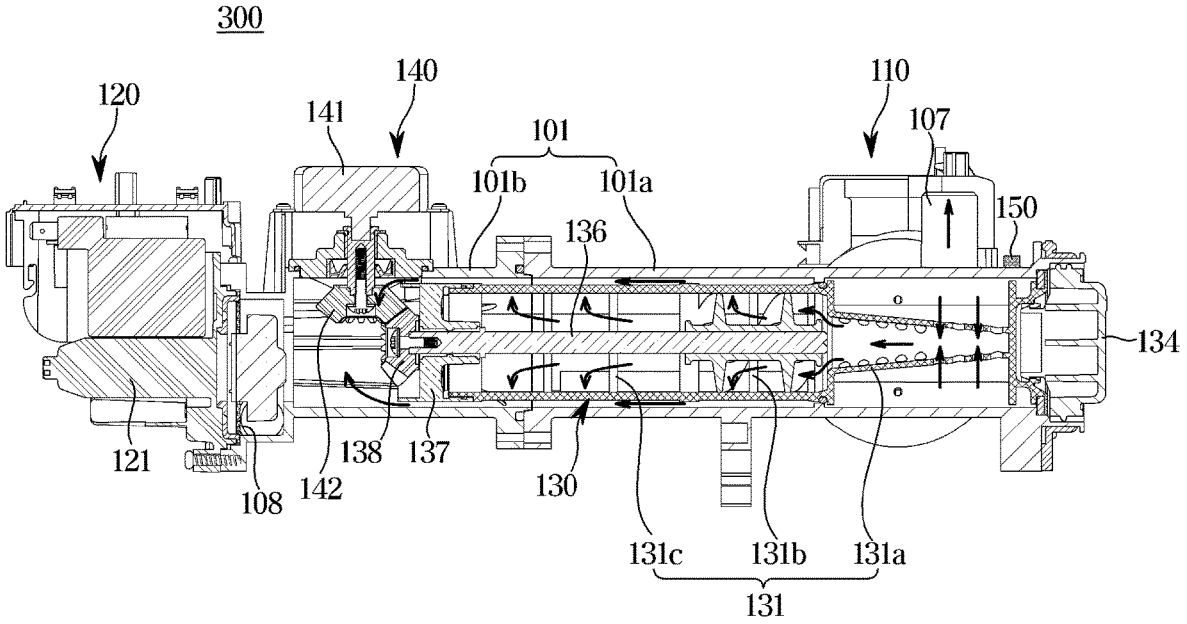
FIG. 14 shows a cross section of the drain device shown in FIG. 13 according to an embodiment of the disclosure.

FIG. 12 shows a washing machine including a drain device according to an embodiment of the disclosure. FIG. 13 shows the drain device shown in FIG. 12. FIG. 14 shows a cross section of the drain device shown in FIG. 13.

A drain device 300 of a washing machine 3 according to an embodiment of the disclosure will be described with reference to FIGS. 12 to 14.

In the following description about the drain device 300 shown in FIGS. 12 to 14, the same components as those of the drain device 100 shown in FIGS. 3 to 6 may be assigned like reference numerals and detailed descriptions thereof will be omitted.

Referring to FIGS. 12 to 14, the drain device 300 may include the case 101, the circulation pump 110 for circulating water stored in the tub 20, the drain pump 120 for discharging water stored in the tub 20 to the outside of the housing 10, the filter device 130 for filtering water discharged through the drain pump 120, the filter driver 140 for driving the filter device 130, and the sensor 150 for detecting coupling of the filter device 130 to the case 101. The sensor 150 may detect openness or closing of the cover 19.

Referring to FIG. 13, the drain device 300 may include a remaining water pump 360. The remaining water pump 360 may be driven independently from the drain pump 120. The remaining water pump 360 may discharge water of the case 101 to the outside of the case 101 while the filter device 130 is dismounted from the case 101. The remaining water pump 360 may be installed in the case 101. The remaining water pump 360 may be adjacent to the drain pump 120. The remaining water pump 360 may be adjacent to the drain opening 108. Each of the circulation pump 110, the drain pump 120, and the remaining water pump 360 of the drain device 300 may be referred to as a pump.

The remaining water pump 360 may include a remaining water motor 361. The remaining water motor 361 may form a water stream of water stored in the case 101 such that the water is discharged through a remaining water guide 363.

The drain device 300 may include a remaining water opening 362 connected to the remaining water motor 361.

The remaining water opening 362 may guide water that is discharged to the outside of the case 101 by the remaining water pump 360.

Referring to FIG. 12, the drain device 300 may include the remaining water guide 363 extending from the remaining water pump 360 to the outside of the housing 10. The remaining water guide 363 may guide water of the drain device 300 toward the outside of the housing 10. The remaining water guide 363 may guide water pumped by the remaining water pump 360. The remaining water guide 363 may be provided separately from the drain guide 82. The remaining water pump 360 may be positioned upstream of the remaining water guide 363 in a direction of a water stream formed by the remaining water pump 360.

The remaining water guide 363 may temporarily store a small amount of water remaining in the case 101. According to various embodiments of the disclosure, a diameter of the remaining water guide 363 may be smaller than a diameter of the drain guide 82.

According to this configuration, the washing machine 3 according to various embodiments of the disclosure may prevent water remaining in the case 101 from being discharged to the outside through the filter inserting opening 109 upon separating of the filter device 130 from the case 101 to manage (maintain and/or repair) the filter device 130, and accordingly, the washing machine 3 may prevent surroundings from being contaminated.

Figure 15:
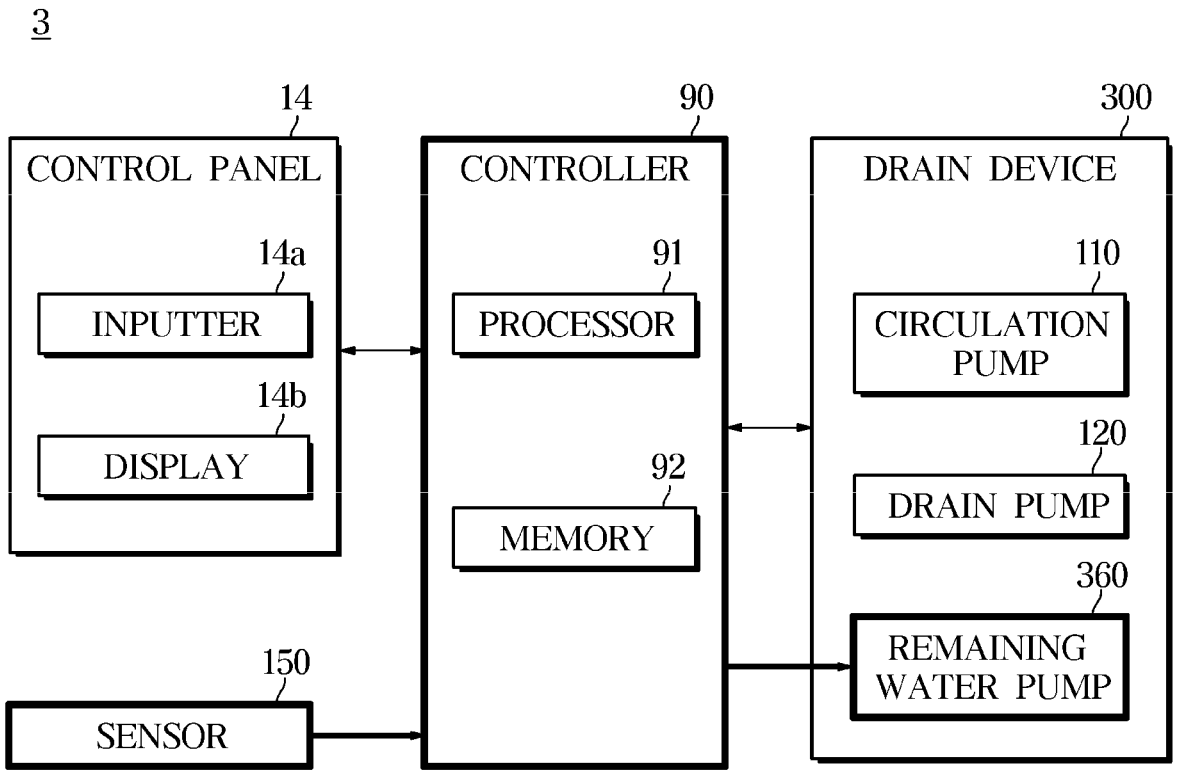
FIG. 15 is a control block diagram of a washing machine including the drain device shown in FIG. 12 according to an embodiment of the disclosure.

FIG. 15 is a control block diagram of a washing machine including the drain device shown in FIG. 12.

A method for preventing remaining water of the drain device 300 from being discharged to the outside of the case 10 while the filter 131 is dismounted from the case 101 of the drain device 300 shown in FIGS. 12 to 14 will be described with reference to FIG. 15.

Referring to FIG. 15, the washing machine 3 according to an embodiment of the disclosure may include the control panel 14, the sensor 150, the controller 90, and the drain device 300.

The drain device 300 may include the remaining water pump 360 that is distinguished from the circulation pump 11 and the drain pump 120.

The remaining water pump 360 may be a component for temporarily holding water of the case 101 in the remaining water guide 363. Accordingly, consumption power of the remaining water pump 360 may be lower than consumption power of the drain pump 120.

As described above, the controller 90 may control various components of the washing machine 1 to perform at least one operation including a water supply operation, a washing operation, a rinsing operation, and/or a dehydrating operation according to a user input inputted to the control panel 14.

The controller 90 may not operate the remaining water pump 360 while performing at least one operation.

Also, the controller 90 may operate the remaining water pump 360 based on a detection of a preset condition by the sensor 150 while at least one operation is not performed.

A user who wants to manage the filter device 130 may separate the filter device 130 from the case 101 by opening the cover 19 shown in FIG. 1 and then operating the filter handle 134 shown in FIG. 3.

According to an embodiment of the disclosure, the sensor 150 may detect separation of the filter device 130 from the case 101 or openness of the cover 19.

The controller 90 may process sensor data received through the sensor 150, and control various components (for example, the drain device 300) of the washing machine 3 based on a result of the processing on the sensor data.

For example, the controller 90 may operate the remaining water pump 360 based on a result of processing on sensor data received through the sensor 150.

According to an embodiment of the disclosure, the controller 90 may operate the remaining water pump 360 based on a detection of separation of the filter device 130 from the case 101 by the sensor 150. The controller 90 may control the remaining water pump 360 to discharge water of the case 101 to the outside of the case 101 through the remaining water opening 362, according to a detection of dismounting of the filter device 130 from the case 101 by the sensor 150.

According to an embodiment of the disclosure, the controller 90 may operate the remaining water pump 360 based on a detection of openness of the cover 19 by the sensor 150. The controller 90 may control the remaining water pump 360 to discharge water of the case 101 to the outside of the case 101 through the remaining water opening 362, according to a detection of openness of the cover 19 by the sensor 150.

According to an embodiment of the disclosure, the controller 90 may stop operating the remaining water pump 360 based on a detection of coupling of the filter device 130 to the case 101 by the sensor 150.

According to an embodiment of the disclosure, the controller 90 may stop operating the remaining water pump 360 based on a detection of closing of the cover 19 by the sensor 150.

According to the disclosure, the washing machine 3 may prevent water remaining in the case 101 from being discharged to the outside through the filter inserting opening 109 by operating the remaining water pump 360 upon separating of the filter device 130 from the case 101 to manage (maintain and/or repair) the filter device 130, and accordingly, the washing machine 3 may prevent surroundings from being contaminated.

Also, according to the disclosure, by operating the remaining water pump 360 with low consumption power, instead of the drain pump 120, upon management (maintenance and/or repair) of the filter device 130, energy may be saved.

Figure 16:
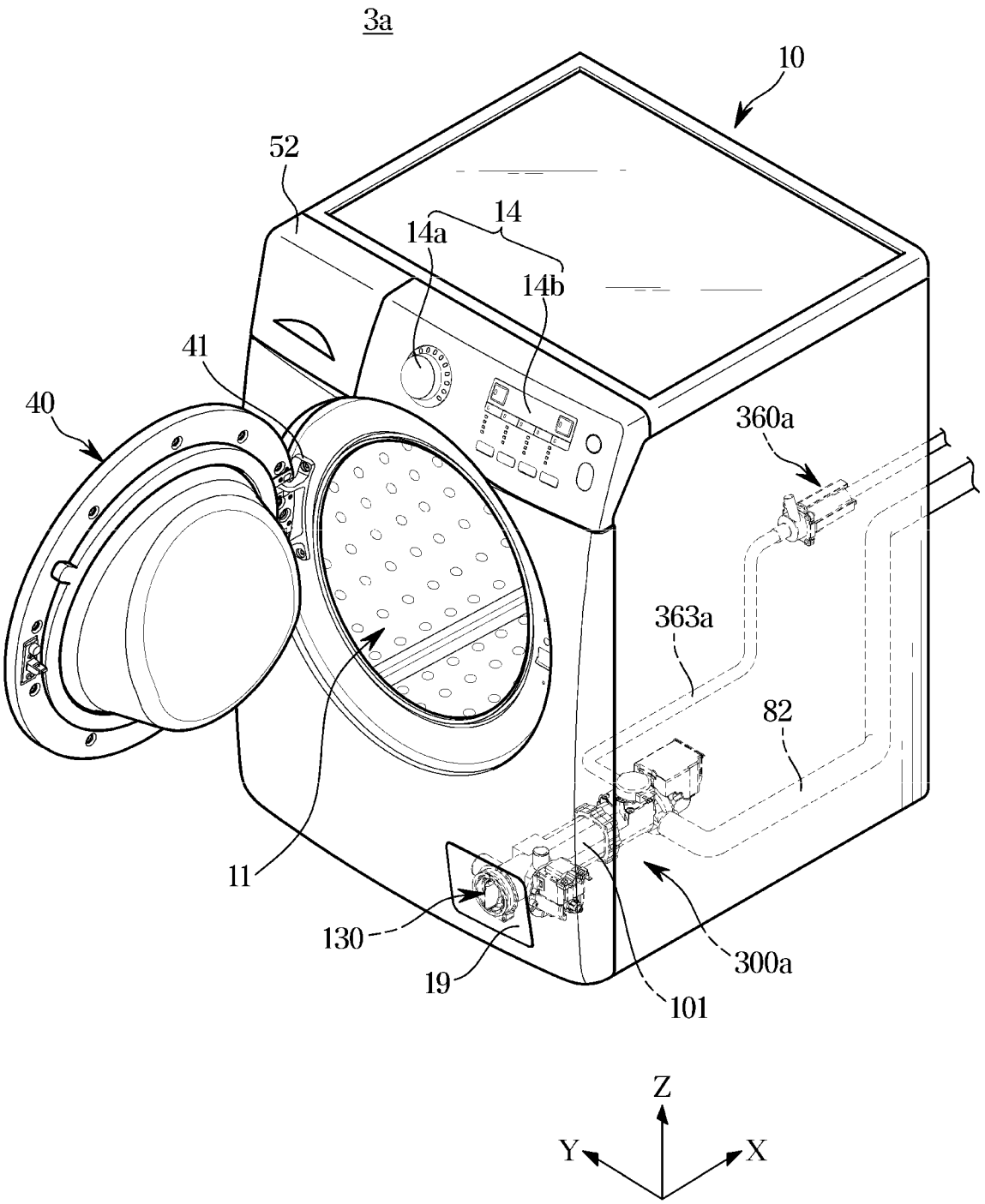
FIG. 16 shows a washing machine including a drain device according to an embodiment of the disclosure.

FIG. 16 shows a washing machine including a drain device according to an embodiment of the disclosure.

A drain device 300*a* of a washing machine 3*a* according to an embodiment of the disclosure will be described with reference to FIG. 16. In the following description about the drain device 300*a* shown in FIG. 16, the same components as those of the drain device 300 shown in FIGS. 12 to 14 may be assigned like reference numerals and detailed descriptions thereof will be omitted.

Referring to FIG. 16, the washing machine 3*a* according to an embodiment of the disclosure may include a remaining water pump 360*a* installed in the housing 10. The remaining water pump 360*a* may be spaced from the drain pump 300*a*. The remaining water pump 360*a* may be connected to the drain pump 300*a* by a remaining water guide 363*a*. The remaining water pump 360*a* may be positioned downstream of the remaining water guide 363*a* in a direction of a water stream formed by the remaining water pump 360*a*.

The method for preventing remaining water of the drain device 300 from being discharged to the outside of the case 101 while the filter device 130 is dismounted from the case 101 of the drain device 300 shown in FIGS. 12 to 14 may be applied to a method for preventing remaining water of the drain device 300*a* from being discharged to the outside of the case 101 while the filter device 130 is dismounted from the case 101 of the drain device 300*a* shown in FIG. 16.

According to this configuration, the washing machine 3*a* according to various embodiments of the disclosure may prevent water remaining in the case 101 from being discharged to the outside through the filter inserting opening 109 upon separating of the filter device 130 from the case 101 to manage (maintain and/or repair) the filter device 130, and accordingly, the washing machine 3*a* may prevent surroundings from being contaminated.

Figure 17:
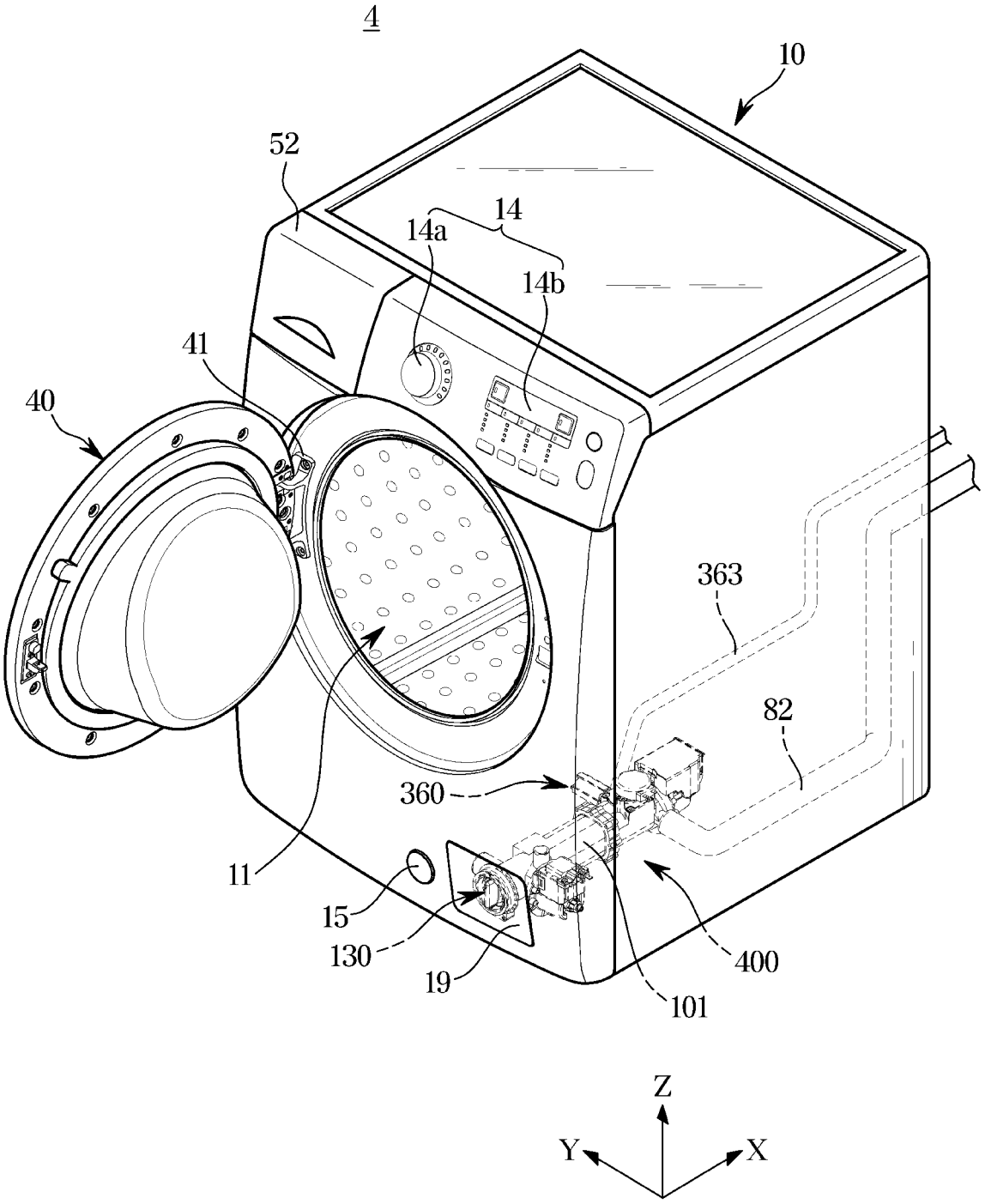
FIG. 17 shows a washing machine including a drain device according to an embodiment of the disclosure.
Figure 18:
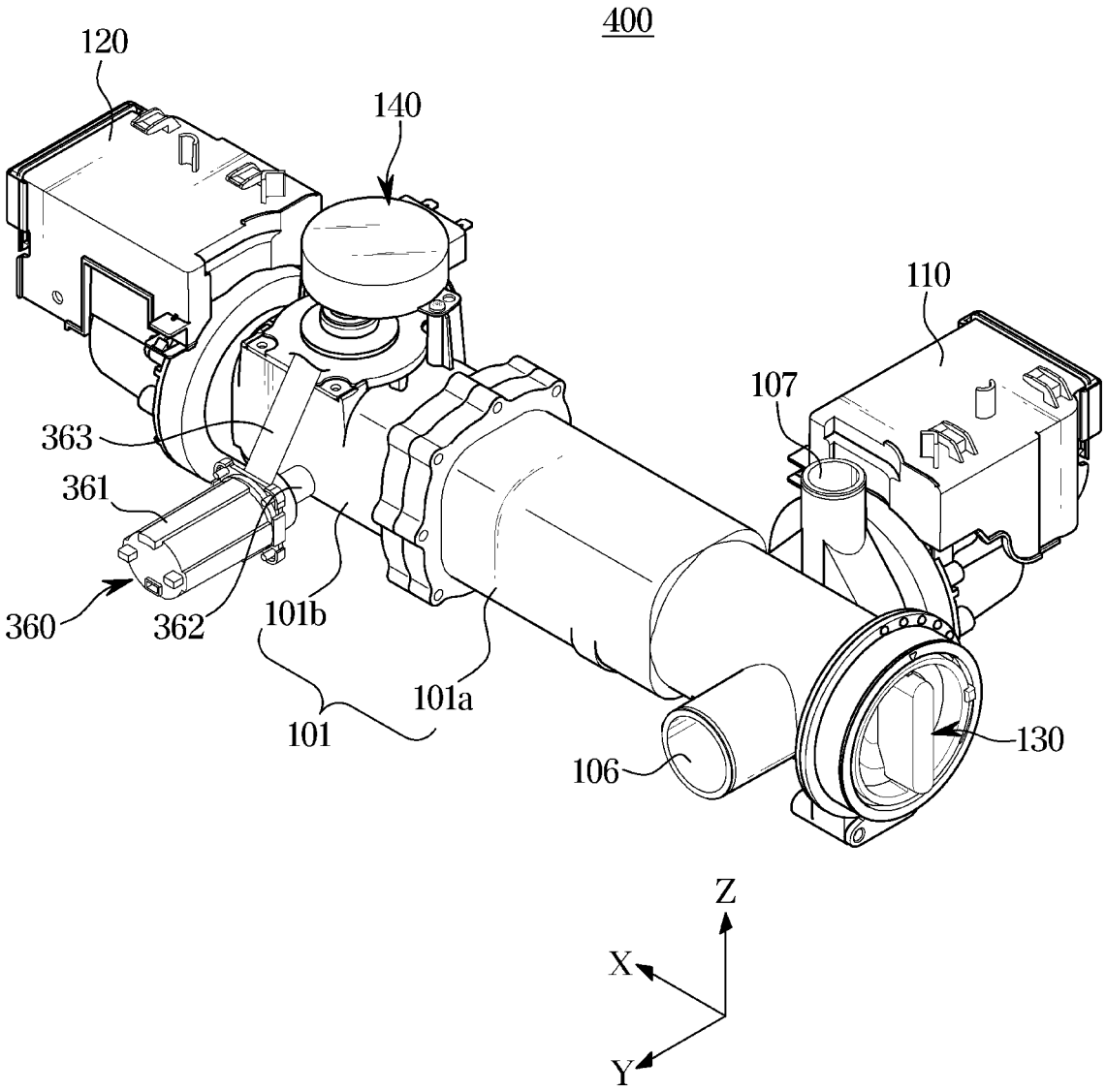
FIG. 18 shows the drain device shown in FIG. 17 according to an embodiment of the disclosure.
Figure 19:
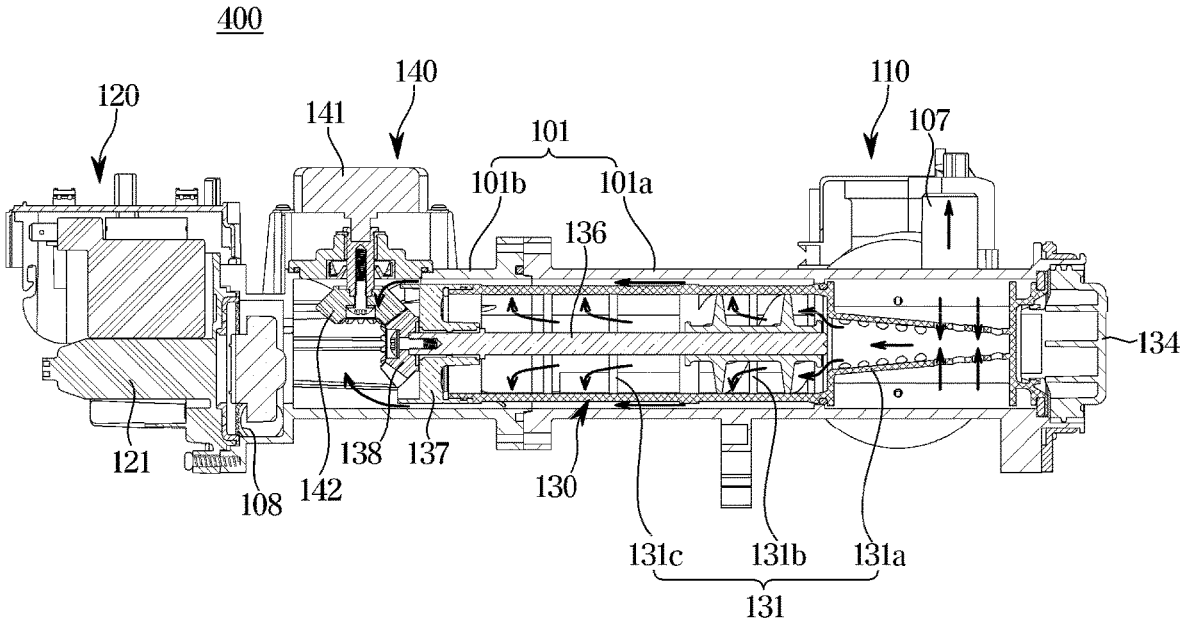
FIG. 19 shows a cross section of the drain device shown in FIG. 18 according to an embodiment of the disclosure.

FIG. 17 shows a washing machine including a drain device according to an embodiment of the disclosure. FIG. 18 shows the drain device shown in FIG. 17. FIG. 19 shows a cross section of the drain device shown in FIG. 18.

A drain device 400 of a washing machine 4 according to an embodiment of the disclosure will be described with reference to FIGS. 17 to 19.

In the following description about the drain device 400 shown in FIGS. 17 to 19, the same components as those of the drain device 300 shown in FIGS. 12 to 14 may be assigned like reference numerals and detailed descriptions thereof will be omitted.

Referring to FIGS. 17 to 19, the drain device 400 may include the case 101, the circulation pump 110 for circulating water stored in the tub 20, the drain pump 120 for discharging water stored in the tub 20 to the outside of the housing 10, the filter device 130 for filtering water discharged through the drain pump 120, and the filter driver 140 for driving the filter device 130.

The drain device 400 may include the remaining water pump 360 for discharging water of the case 101 to the outside of the case 101 while the filter device 130 is dismounted from the case 101. The remaining water pump 360 may be installed in the case 101. The remaining water pump 360 may be adjacent to the drain pump 120. The remaining water pump 360 may be adjacent to the drain opening 108. The remaining water pump 360 may be positioned upstream of the remaining water guide 363 in a direction of a water stream formed by the remaining water pump 360. Each of the circulation pump 110, the drain pump 120, and the remaining water pump 360 of the drain device 400 may be referred to as a pump.

The remaining water pump 360 may include the remaining water motor 361 for forming a water stream of water stored in the case 101 such that the water is discharged through the remaining water guide 363, the remaining water opening 362 connected to the remaining water motor 361, and the remaining water guide 363 extending from the remaining water pump 360 to the outside of the housing 10.

The drain device 400 shown in FIGS. 17 to 19 may omit the sensor 150 of the drain device 300 shown in FIGS. 12 to 14. The washing machine 4 may include the input device 15 for receiving a command for operating the remaining water pump 360 from a user. The input device 15 may receive a command for operating the remaining water pump 360 from a user by being pressed. The input device 15 may receive a command for operating the remaining water pump 360 from a user by being touched. The input device 15 may be adjacent to the cover 19.

According to this configuration, the washing machine 4 according to various embodiments of the disclosure may prevent water remaining in the case 101 from being discharged to the outside through the filter inserting opening 109 upon separating of the filter device 130 from the case 101 to manage (maintain and/or repair) the filter device 130, and accordingly, the washing machine 4 may prevent surroundings from being contaminated.

Figure 20:
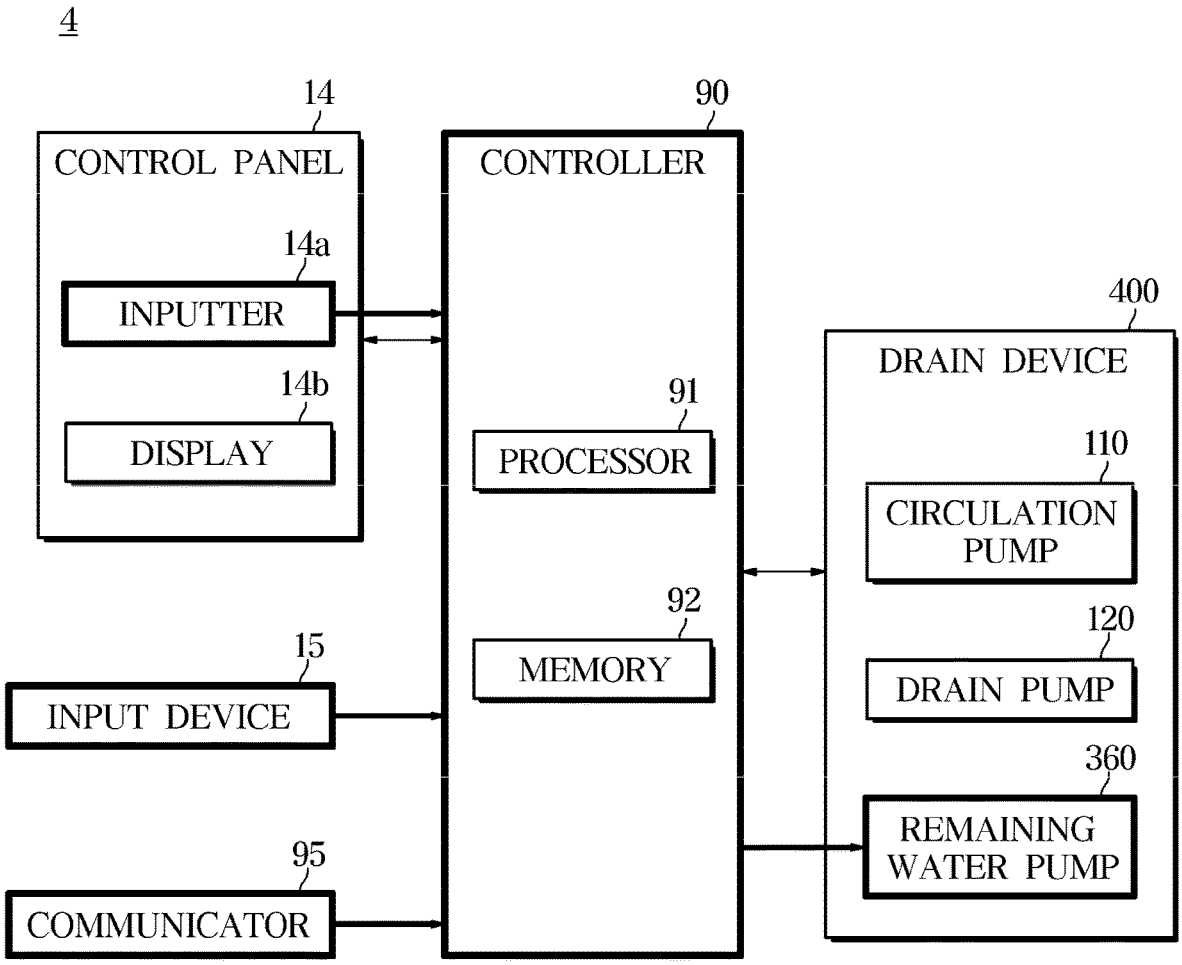
FIG. 20 is a control block diagram of a washing machine including the drain device shown in FIG. 18 according to an embodiment of the disclosure.

FIG. 20 is a control block diagram of a washing machine including the drain device shown in FIG. 18.

A control method for preventing remaining water in the drain device 400 from being discharged to the outside of the case 101 while the filter 131 is dismounted from the case 101 of the drain device 400 shown in FIG. 17 to 19 will be described with reference to FIG. 20.

Referring to FIG. 20, the washing machine 4 according to an embodiment of the disclosure may include the control panel 14, the input device 15, the communicator 95, the controller 90, and the drain device 400. The washing machine 4 according to an embodiment of the disclosure may not include the sensor 150 among components of the washing machine 3 shown in FIG. 15.

That is, the drain device 400 according to an embodiment of the disclosure may not include the sensor 150.

According to various embodiments of the disclosure, the washing machine 4 according to an embodiment of the disclosure may include the input device 15 that is adjacent to the cover 19, instead of being provided on the control panel 14. For example, the input device 15 may be provided on the front surface of the housing 10 below the door 40. Also, the input device 15 may be provided on the front surface of the housing 10, and provided to one side of the cover 19.

The input device 15 may be used to operate the remaining water pump 360.

The controller 90 may operate the remaining water pump 360 based on reception of a command input through the input device 15.

For example, the input device 15 implemented as a push switch 15 may generate an electrical signal by being pressed by a user, and the controller 90 may operate the remaining water pump 360 based on reception of the electrical signal from the input device 15.

The user who wants to manage the filter device 130 may operate the input device 15 before operating the filter handle 134, and according to an operation of the input device 15, the remaining water pump 360 may operate to prevent water remaining in the case 101 from being discharged to the outside through the filter inserting opening 109 upon separating of the filter device 130 from the case 101.

According to the disclosure, because the input device 15 is provided around the cover 19, the user may easily operate the remaining water pump 360 before opening the cover 19.

According to various embodiments of the disclosure, a location of the input device 15 may change. FIG. 20 shows the inputter 14*a* and the input device 15 separately. However, according to an embodiment of the disclosure, the input device 15 may be provided on the control panel 14, or may be a component of the inputter 14*a*.

According to an embodiment of the disclosure, the input device 15 may include a visual indicator representing an operation state of the remaining water pump 120. For example, the input device 15 implemented as a push switch may generate an electrical signal for operating the visual indicator by being pressed by the user.

According to the disclosure, the user may intuitively recognize an operation state of the drain pump 120.

The controller 90 may stop operating the remaining water pump 360 based on reception of a command input through the input device 15 while the remaining water pump 360 operates.

For example, the controller 90 may stop the remaining water pump 360 based on an identification that the input device 15 implemented as a push switch is pressed by a user while the remaining water device 360 operates.

After the user finishes management of the filter device 130, the user may install the filter device 130 in the case 101, close the cover 19, and then again operate the input device 15 to stop operating the remaining water device 360.

Meanwhile, in a case in which the user finishes management of the filter device 130 and then leaves without again operating the input device 15, that is, without stopping the remaining water pump 360, unnecessary energy may be consumed and noise may be generated.

According to various embodiments of the disclosure, based on elapse of a preset time (for example, about 10 minutes) after the controller 90 operates the remaining water pump 360 based on reception of a command input through the input device 15, the controller 90 may stop operating the remaining water pump 360.

According to the disclosure, although the user finishes management of the filter device 130 and then leaves without stopping the remaining water pump 360, the remaining water pump 360 may stop.

Meanwhile, the washing machine 3 according to an embodiment of the disclosure may also include the input device 15, which is not shown in FIG. 15, and the above-described embodiment related to the input device 15 may be applied to the washing machine 3.

The washing machine 4 according to an embodiment of the disclosure may include the communicator 95 for communicating with an external device.

The controller 90 may operate the remaining water pump 360 based on reception of a command for operating the remaining water pump 360 from a user terminal through the communicator 95.

According to various embodiments of the disclosure, the controller 90 may control the communicator 95 to transmit a message notifying clogging of the filter device 130 to the user terminal based on a detection of clogging of the filter device 130.

The user may recognize clogging of the filter device 130 through the user terminal.

The user terminal may provide an interface including a user interface element for operating the remaining water pump 360 based on reception of the message notifying clogging of the filter device 130.

The user terminal may transmit a command for operating the remaining water pump 360 to the communicator 95 based on a selection of the user interface element for operating the remaining water pump 360, and the controller 90 may operate the remaining water pump 360 based on reception of the command for operating the remaining water pump 360 from the user terminal through the communicator 95.

According to the disclosure, the user who has recognized clogging of the filter device 130 through the user terminal may easily operate the remaining water pump 360 before managing the filter device 130.

Also, the user terminal may provide an interface including a user interface element for stopping the remaining water pump 360 based on the transmission of the command for operating the remaining water pump 360 to the communicator 95.

The user terminal may transmit a command for stopping the remaining water pump 360 to the communicator 95 based on a selection of the user interface element for stopping the remaining water pump 360, and the controller 90 may stop the remaining water pump 360 based on reception of the command for stopping the remaining water pump 360 from the user terminal through the communicator 95.

Meanwhile, the washing machine 3 according to an embodiment of the disclosure may also include the communicator 95, which is not shown in FIG. 15, and the above-described embodiment related to the communicator 95 may also be applied to the washing machine 3.

According to the disclosure, the remaining water pump 360 may operate according to a user's intention for managing the filter device 130, without the sensor 150.

Figure 21:
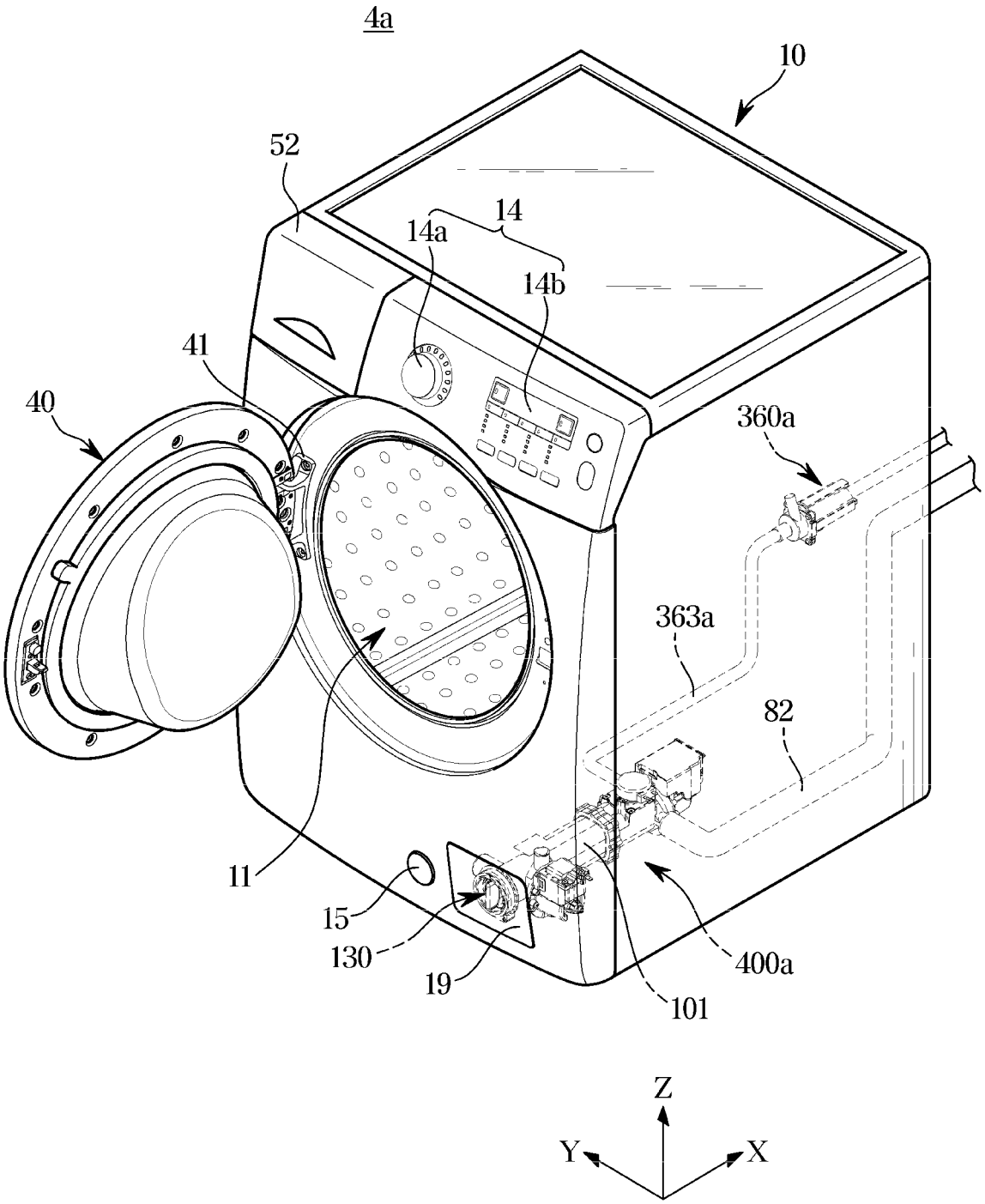
FIG. 21 shows a washing machine including a drain device according to an embodiment of the disclosure.

FIG. 21 shows a washing machine including a drain device according to an embodiment of the disclosure.

A drain device 400*a* of a washing machine 4*a* according to an embodiment of the disclosure will be described with reference to FIG. 21. In the following description about the drain device 400*a* shown in FIG. 21, the same components as those of the drain devices 300*a* and 400 shown in FIGS. 16 to 19 may be assigned like reference numerals and detailed descriptions thereof will be omitted.

Referring to FIG. 21, the washing machine 4*a* according to an embodiment of the disclosure may include a remaining water pump 360*a* installed in the housing 10. The remaining water pump 360*a* may be spaced from the drain pump 400*a*. The remaining water pump 360*a* may be connected to the drain pump 400*a* by the remaining water guide 363*a*. The remaining water pump 360*a* may be positioned downstream of the remaining water guide 363*a* in a direction of a water stream formed by the remaining water pump 360*a*.

The method for preventing remaining water of the drain device 400 from being discharged to the outside of the case 101 while the filter 131 is dismounted from the case 101 of the drain device 400 shown in FIGS. 17 to 19 may be applied to a method for preventing remaining water of the drain device 400*a* from being discharged to the outside of the case 101 while the filter device 130 is dismounted from the case 101 of the drain device 400*a* shown in FIG. 21.

According to this configuration, the washing machine 4*a* according to various embodiments of the disclosure may prevent water remaining in the case 101 from being discharged to the outside through the filter inserting opening 109 upon separating of the filter device 130 from the case 101 to manage (maintain and/or repair) the filter device 130, and accordingly, the washing machine 4*a* may prevent surroundings from being contaminated.

Figure 22:
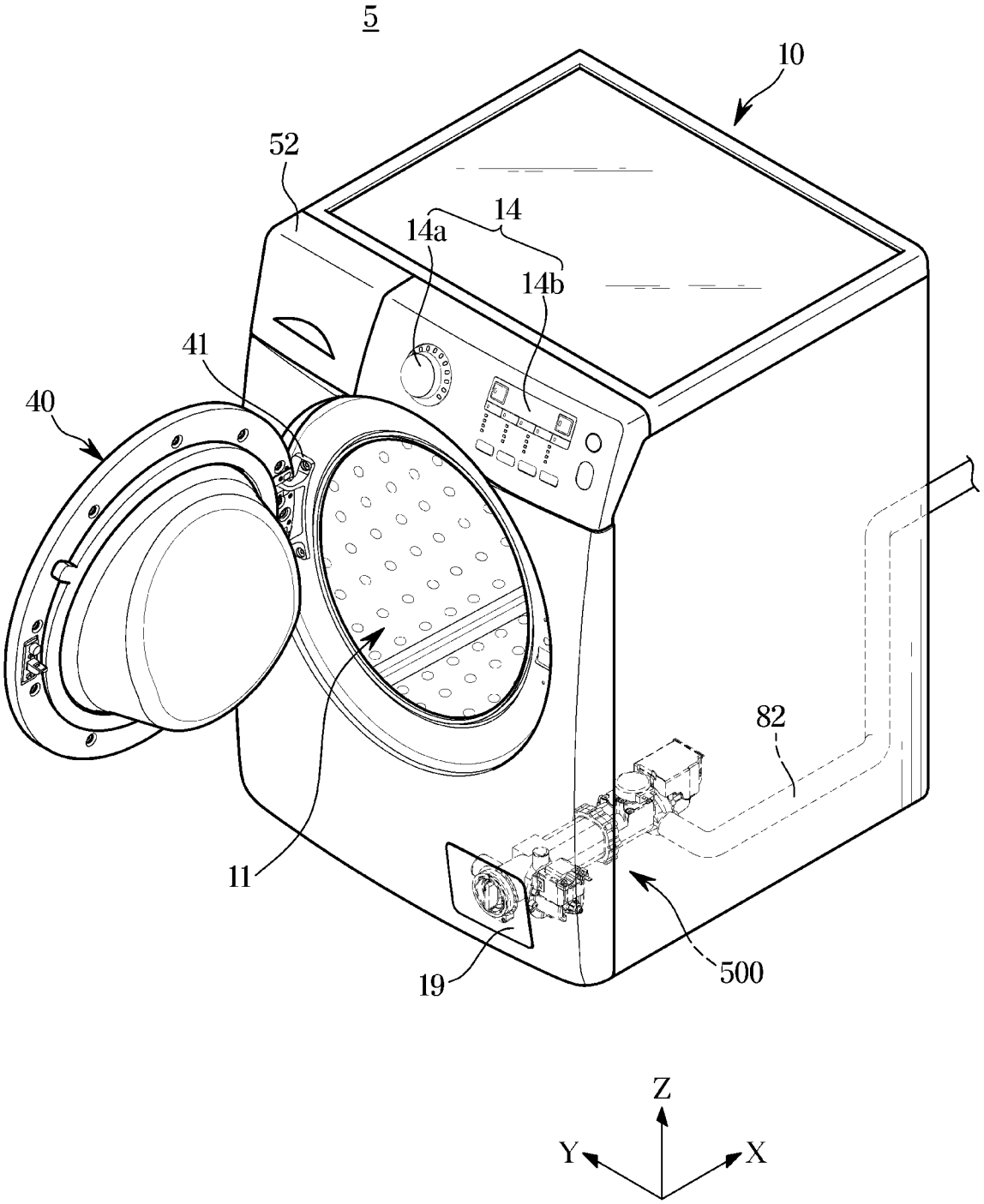
FIG. 22 shows a washing machine including a drain device according to an embodiment of the disclosure.
Figure 23:
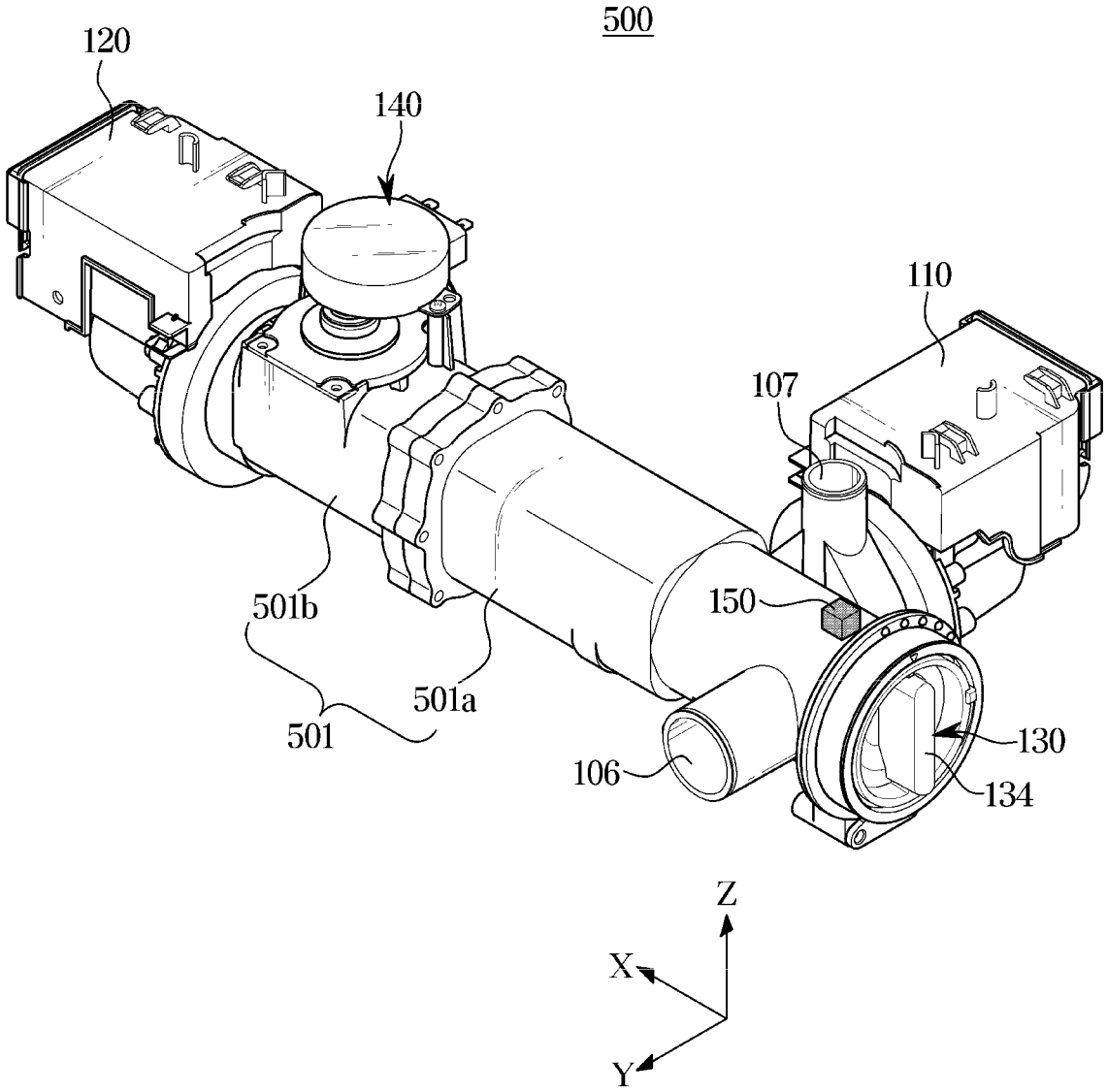
FIG. 23 shows the drain device shown in FIG. 22 according to an embodiment of the disclosure.
Figure 24:
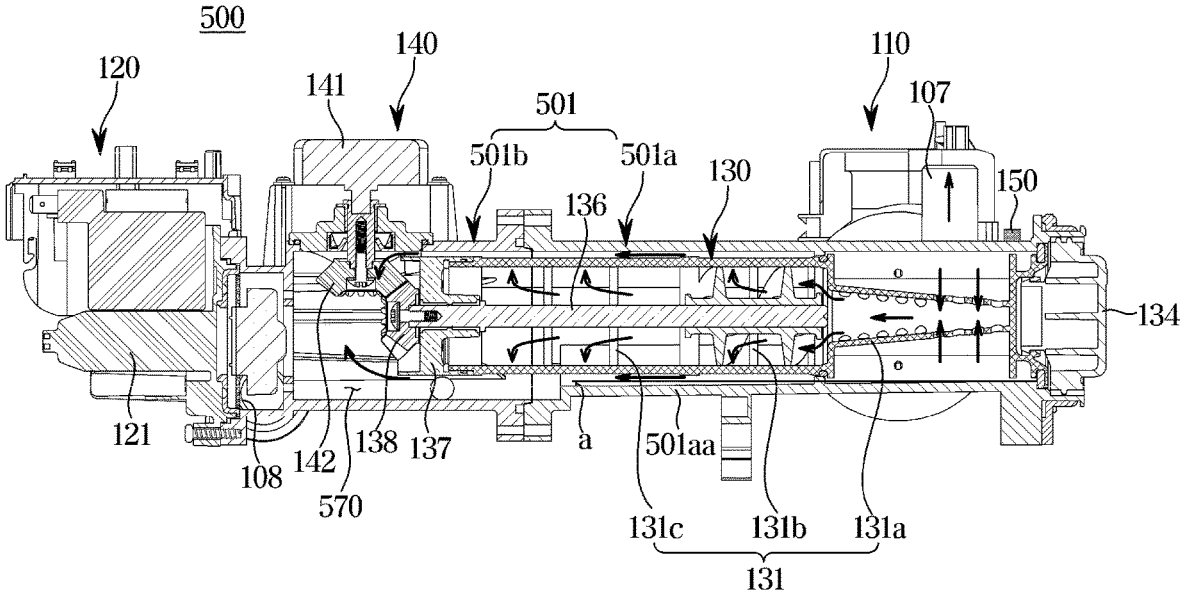
FIG. 24 shows a cross section of the drain device shown in FIG. 23 according to an embodiment of the disclosure.

FIG. 22 shows a washing machine including a drain device according to an embodiment of the disclosure. FIG. 23 shows the drain device shown in FIG. 22. FIG. 24 shows a cross section of the drain device shown in FIG. 23.

A drain device 500 of a washing machine 5 according to an embodiment of the disclosure will be described with reference to FIGS. 22 to 24.

In the following description about the drain device 500 shown in FIGS. 22 to 24, the same components as those of the drain device 100 shown in FIGS. 3 to 6 may be assigned like reference numerals and detailed descriptions thereof will be omitted.

Referring to FIGS. 22 to 24, the drain device 500 may include a case 501, the circulation pump 110 for circulating water stored in the tub 20, the drain pump 120 for discharging water stored in the tub 20 to the outside of the housing 10, the filter device 130 for filtering water discharged through the drain pump 120, the filter driver 140 for driving the filter device 130, and the sensor 150 for detecting coupling of the filter device 130 to the case 101.

Referring to FIG. 24, the drain device 500 may include a remaining water space 570. The remaining water space 570 may be formed inside the case 501. The remaining water space 570 may be positioned below the filter device 130 in a direction of gravity. The remaining water space 570 may be adjacent to the drain pump 120. The remaining water space 570 may be adjacent to the drain opening 108. The remaining water space 570 may be formed by a first case 501*a* and a second case 501*b* of the case 501. The remaining water space 570 may be formed by forming a step at a part of a bottom portion of the case 501. A water storage capacity of the remaining water space 570 may be designed by considering an amount of water remaining in the drain guide 82 after a drain operation of the drain device 500. Because the remaining water space 570 stores at least one portion of water received from the drain guide 82 although water remaining in the drain guide 82 again enters the drain device 500 while the filter device 130 is dismounted from the case 501 of the drain device 500, the remaining water space 570 may prevent remaining water from being discharged to the outside of the drain device 500.

The case 501 may include a remaining water inclined portion 501*aa* as a part of the bottom portion, inclined downward toward the remaining water space 570. The remaining water inclined portion 501*aa* may be inclined upward toward the inlet 106 from the remaining water space 570. The remaining water inclined portion 501*aa* may be inclined upward toward the filter inserting opening 109 from the remaining water space 570. The remaining water inclined portion 501*aa* may extend in a direction having a preset inclination angle a with respect to a direction that is parallel to an extension direction of an upper portion of the case 501. Upon generation of remaining water exceeding the water storage capacity of the remaining water space 570, the remaining water inclined portion 501*aa* may prevent the remaining water from being discharged through the inlet 106 and/or the filter inserting opening 109.

The method for preventing remaining water of the drain device 100 from being discharged to the outside of the case 101 while the filter device 130 is dismounted from the case 101 of the drain device 100 shown in FIGS. 3 to 6 may be applied to a method for preventing remaining water of the drain device 500 from being discharged to the outside of the case 501 while the filter device 130 is dismounted from the case 501 of the drain device 500 shown in FIGS. 22 to 24.

Because the drain device 500 of the washing machine 5 shown in FIGS. 22 to 24 includes the remaining water space 570, a preset amount of remaining water may be stored although the drain pump 120 does not operate, and accordingly, remaining water of the drain device 500 may be prevented from being discharged to the outside of the case 501.

According to this configuration, the washing machine 5 according to various embodiments of the disclosure may prevent water remaining in the case 501 from being discharged to the outside through the filter inserting opening 109 by operating the drain pump 120 upon separating of the filter device 130 from the case 501 to manage (maintain and/or repair) the filter device 130, and accordingly, the washing machine 5 may prevent surroundings from being contaminated.

Figure 25:
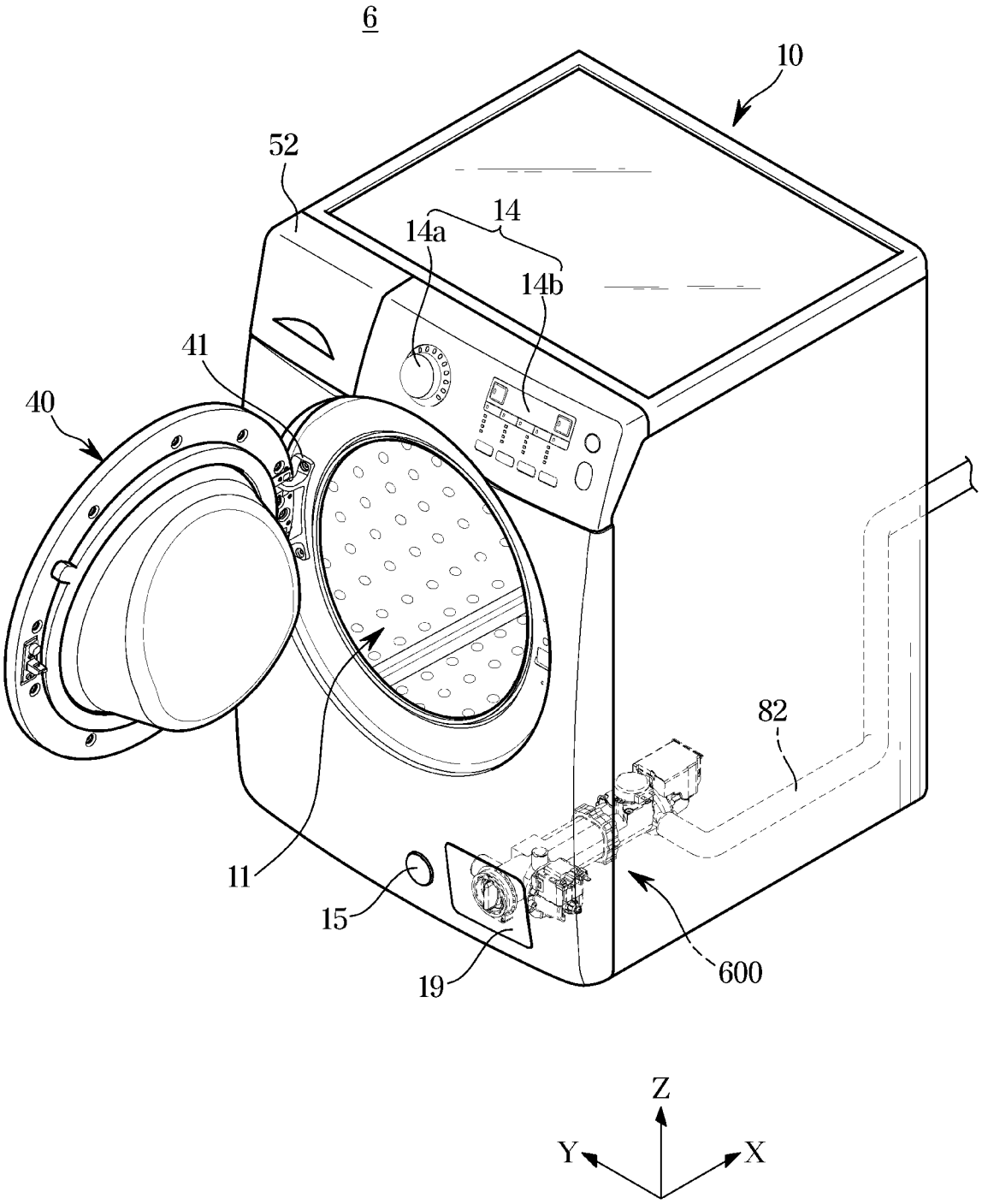
FIG. 25 shows a washing machine including a drain device according to an embodiment of the disclosure.
Figure 26:
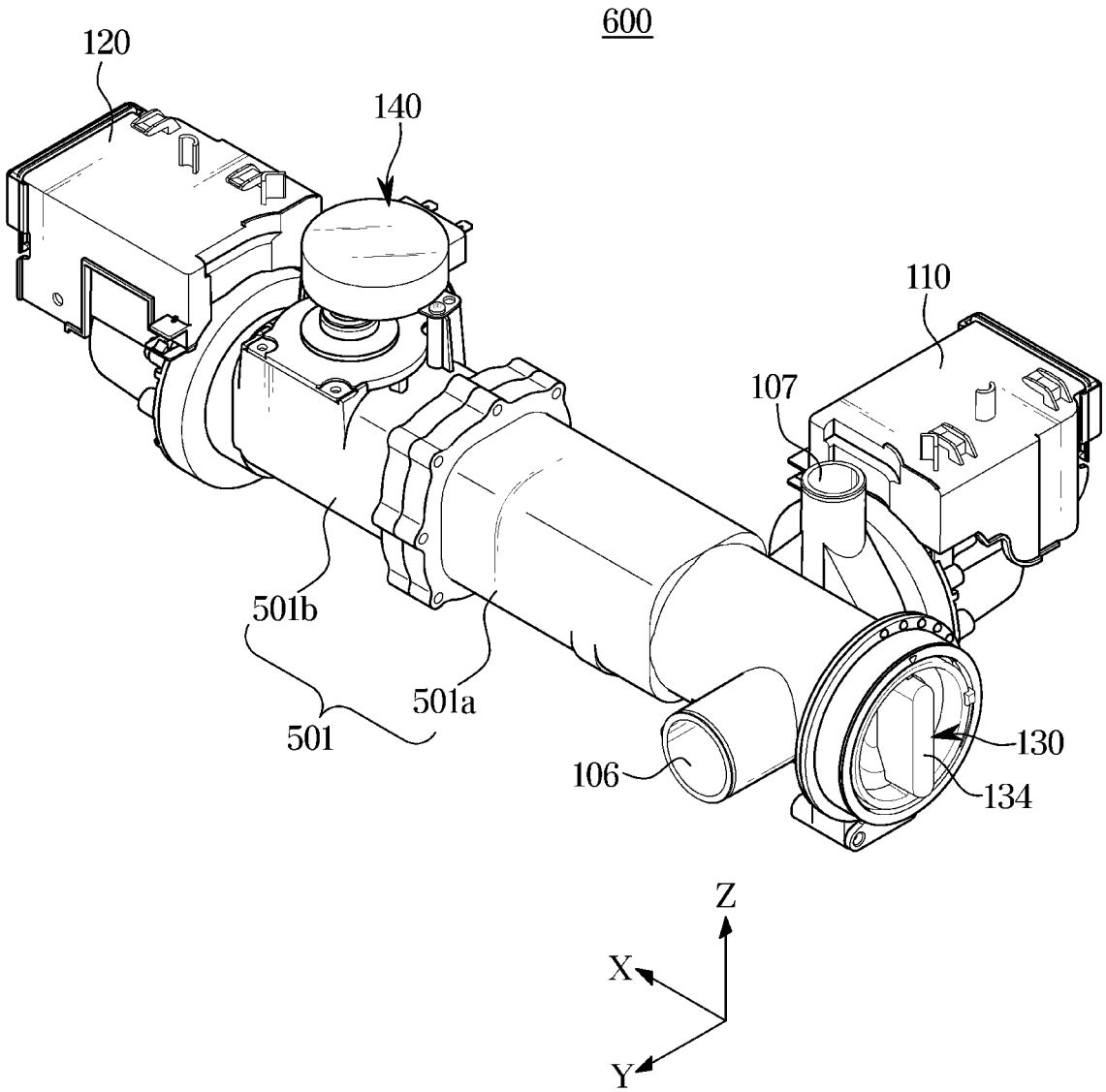
FIG. 26 shows the drain device shown in FIG. 25 according to an embodiment of the disclosure.
Figure 27:
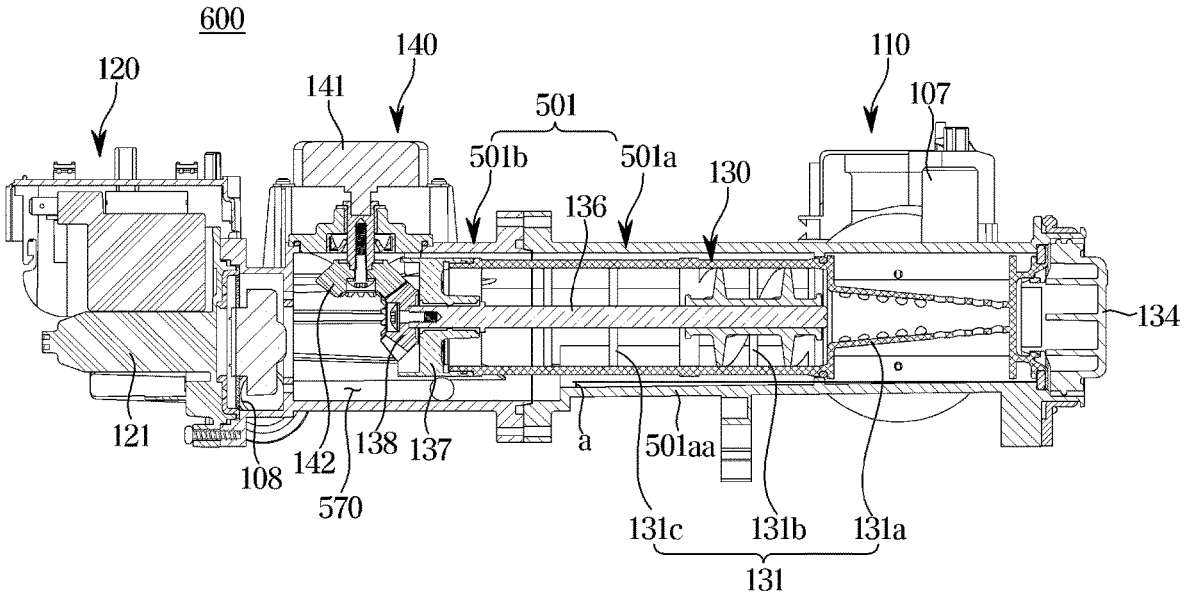
FIG. 27 shows a cross section of the drain device shown in FIG. 26 according to an embodiment of the disclosure.

FIG. 25 shows a washing machine including a drain device according to an embodiment of the disclosure. FIG. 26 shows the drain device shown in FIG. 25. FIG. 27 shows a cross section of the drain device shown in FIG. 26.

A drain device 600 of a washing machine 6 according to an embodiment of the disclosure will be described with reference to FIGS. 25 to 27. In the following description about the drain device 600 shown in FIGS. 25 to 27, the same components as those of the drain device 500 shown in FIGS. 22 to 24 may be assigned like reference numerals and detailed descriptions thereof will be omitted.

Referring to FIGS. 25 to 27, the drain device 600 may include the case 501, the circulation pump 110 for circulating water stored in the tub 20, the drain pump 120 for discharging water stored in the tub 20 to the outside of the housing 10, the filter device 130 for filtering water discharged through the drain pump 120, the filter driver 140 for driving the filter device 130, and the remaining water space 570 and the remaining water inclined portion 501*aa* formed inside the case 501.

The drain device 600 shown in FIGS. 25 to 27 may omit the sensor 150 of the drain device 500 shown in FIGS. 22 to 24. The washing machine 6 may include the input device 15 for receiving a command for operating the drain pump 120 from a user. The input device 15 may receive a command for operating the drain pump 120 from a user by being pressed. The input device 15 may receive a command for operating the drain pump 120 from a user by being touched. The input device 15 may be adjacent to the cover 19.

Because the drain device 600 of the washing machine 6 shown in FIGS. 25 to 27 includes the remaining water space 570, a preset amount of remaining water may be stored although the drain pump 120 does not operate, and accordingly, remaining water of the drain device 600 may be prevented from being discharged to the outside of the case 501.

The drain device 600 shown in FIGS. 25 to 27 may discharge water stored in the remaining water space 570 of the case 501 to the outside of the case 501 of the drain device 600 by operating the drain pump 120. The method for preventing remaining water of the drain device 200 from being discharged to the outside of the case 101 while the filter device 130 is dismounted from the case 101 of the drain device 200 shown in FIGS. 8 to 10 may be applied to a method for preventing remaining water of the drain device 600 from being discharged to the outside of the case 501 while the filter device 130 is dismounted from the case 501 of the drain device 600 shown in FIGS. 25 to 27.

According to this configuration, the washing machine 6 according to various embodiments of the disclosure may prevent water remaining in the case 501 from being discharged to the outside through the filter inserting opening 109 upon separating of the filter device 130 from the case 101 to manage (maintain and/or repair) the filter device 130, and accordingly, the washing machine 6 may prevent surroundings from being contaminated.

Figure 28:
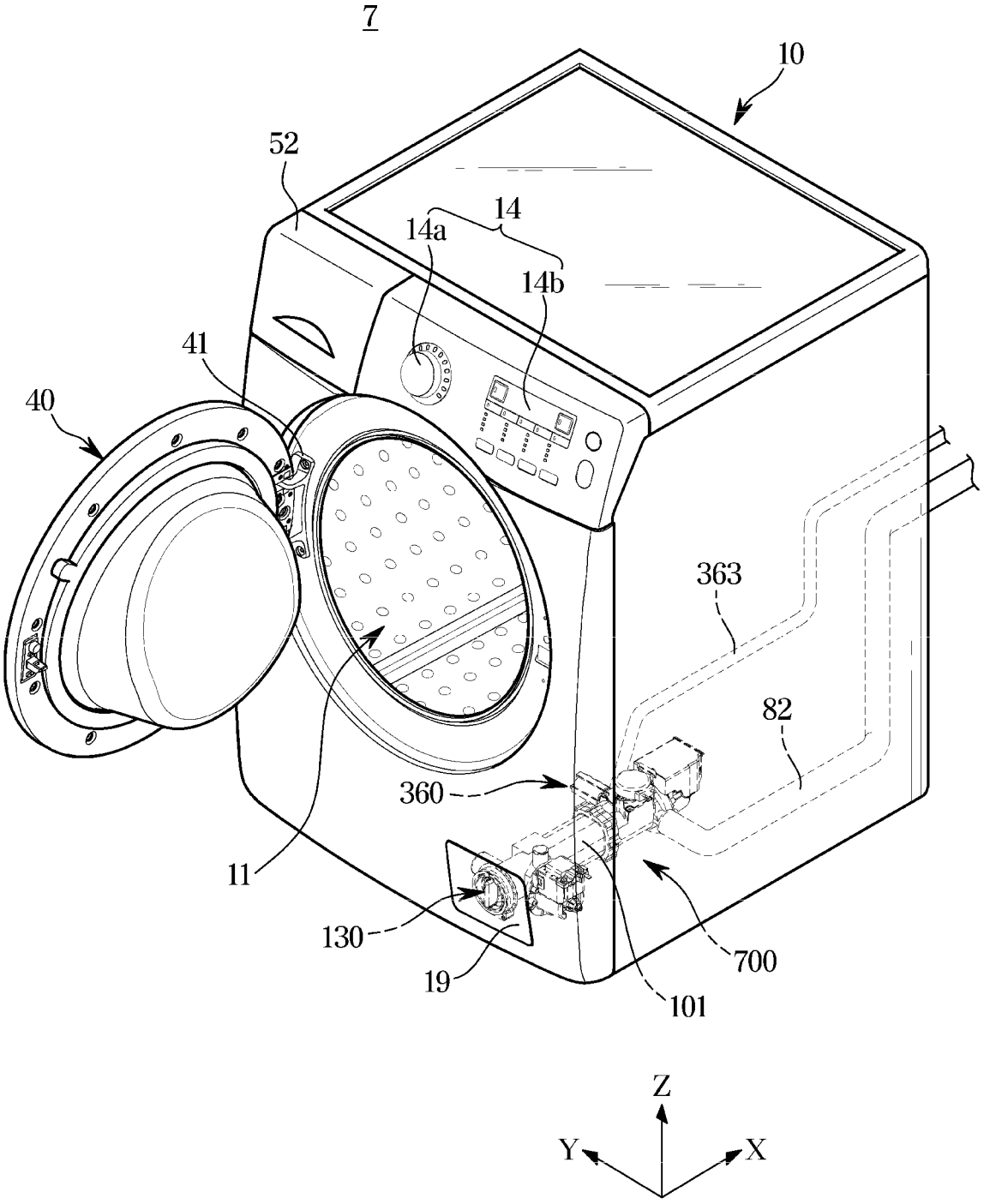
FIG. 28 shows a washing machine including a drain device according to an embodiment of the disclosure.
Figure 29:
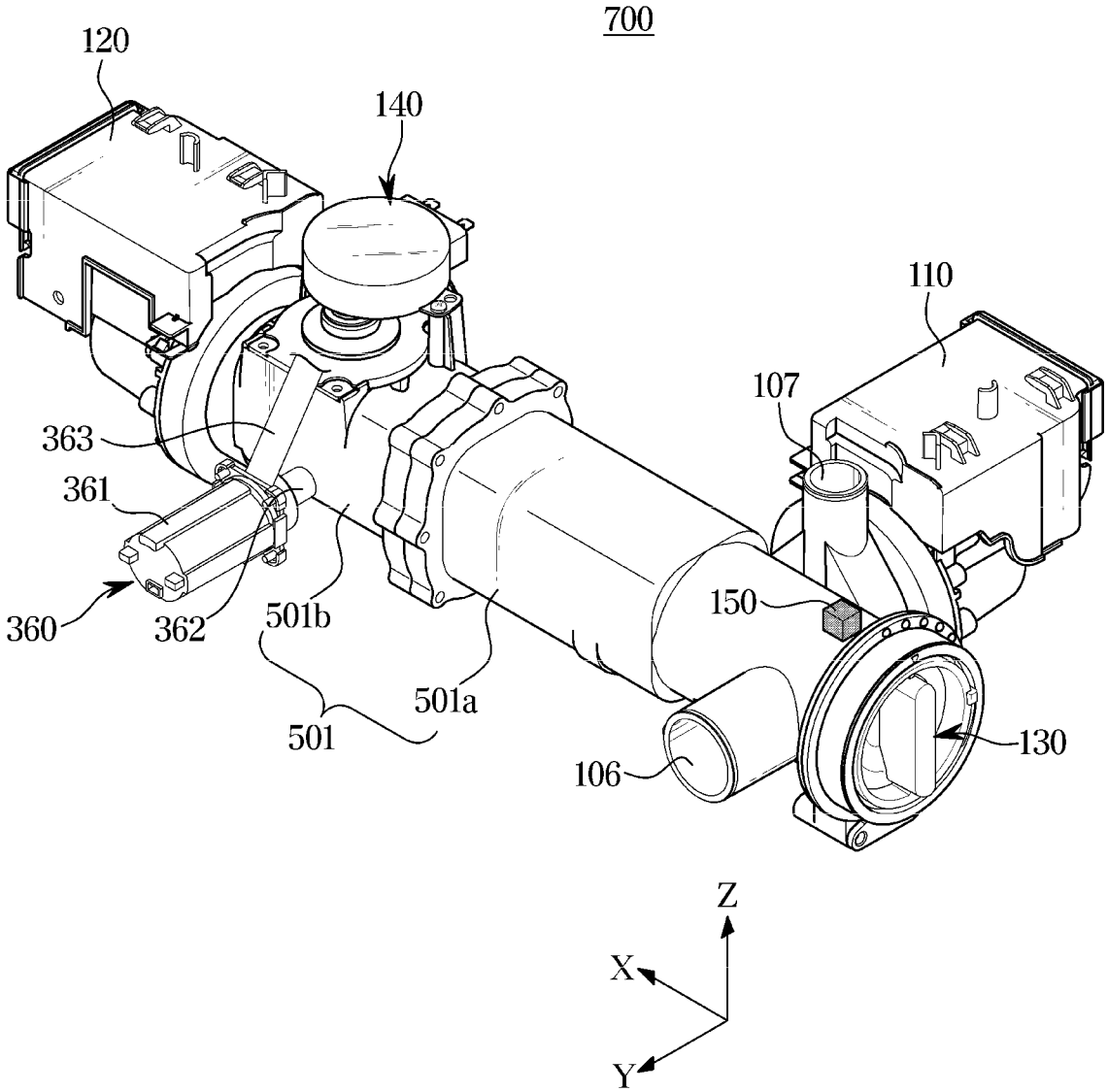
FIG. 29 shows the drain device shown in FIG. 28 according to an embodiment of the disclosure.
Figure 30:
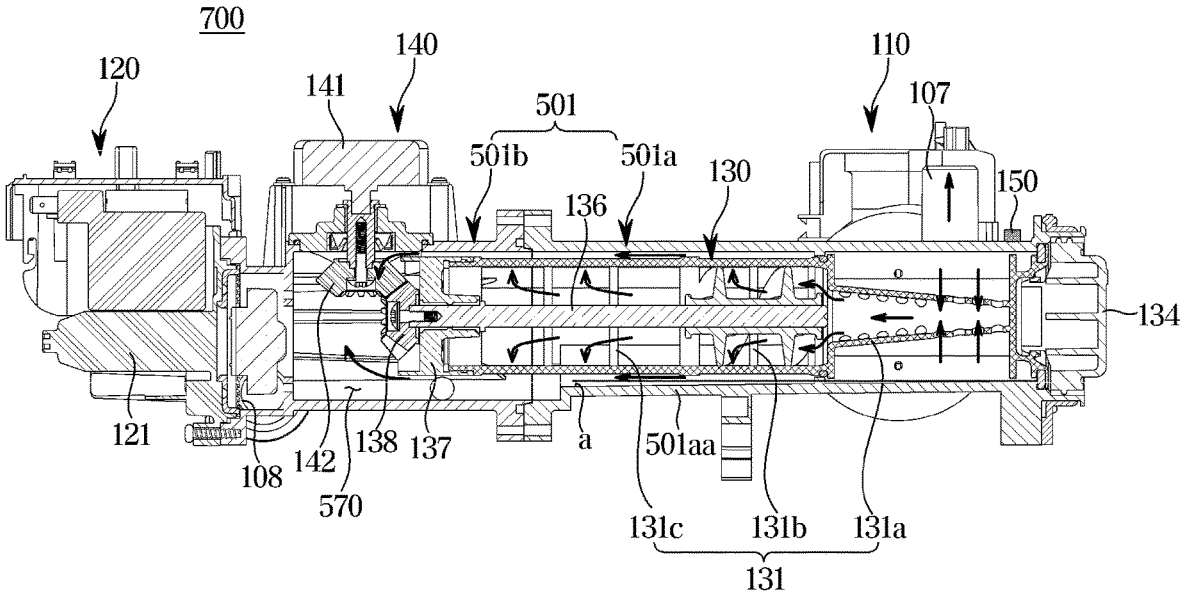
FIG. 30 shows a cross section of the drain device shown in FIG. 29 according to an embodiment of the disclosure.

FIG. 28 shows a washing machine including a drain device according to an embodiment of the disclosure. FIG. 29 shows the drain device shown in FIG. 28. FIG. 30 shows a cross section of the drain device shown in FIG. 29.

A drain device 700 of a washing machine 7 according to an embodiment of the disclosure will be described with reference to FIGS. 28 to 30. In the following description about the drain device 700 shown in FIGS. 28 to 30, the same components as those of the drain device 300 shown in FIGS. 12 to 14 and the drain device 500 shown in FIGS. 22 to 24 may be assigned like reference numerals and detailed descriptions thereof will be omitted.

Referring to FIGS. 28 to 30, the drain device 700 may include the case 501, the circulation pump 110 for circulating water stored in the tub 20, the drain pump 120 for discharging water stored in the tub 20 to the outside of the housing 10, the filter device 130 for filtering water discharged through the drain pump 120, the filter driver 140 for driving the filter device 130, the sensor 150 for detecting coupling of the filter device 130 to the case 101, and the remaining water space 570 and the remaining water inclined portion 501*aa* formed inside the case 501.

Referring to FIG. 29, the drain device 700 may include the remaining water pump 360 that operates to discharge water of the case 501 to the outside of the case 501 while the filter device 130 is dismounted from the case 501. The remaining water pump 360 may be installed in the case 501. The remaining water pump 360 may be adjacent to the drain pump 120. The remaining water pump 360 may be adjacent to the drain opening 108. The remaining water pump 360 may be positioned upstream of the remaining water guide 363 in a direction of a water stream formed by the remaining water pump 360. Each of the circulation pump 110, the drain pump 120, and the remaining water pump 360 of the drain device 700 may be referred to as a pump.

The remaining water pump 360 may include the remaining water motor 361 for forming a water stream of water stored in the case 101 such that the water is discharged through the remaining water guide 363, the remaining water opening 362 connected to the remaining water motor 361, and the remaining water guide 363 extending from the remaining water pump 360 to the outside of the housing 10.

The method for preventing remaining water of the drain device 300 from being discharged to the outside of the case 101 while the filter device 130 is dismounted from the case 101 of the drain device 300 shown in FIGS. 12 to 14 may be applied to a method for preventing remaining water of the drain device 700 from being discharged to the outside of the case 501 while the filter device 130 is dismounted from the case 501 of the drain device 700 shown in FIGS. 28 to 30.

Because the drain device 700 of the washing machine 7 shown in FIGS. 28 to 30 includes the remaining water space 570, a preset amount of remaining water may be stored although the drain pump 120 does not operate, and accordingly, remaining water of the drain device 700 may be prevented from being discharged to the outside of the case 501.

According to this configuration, the washing machine 7 according to various embodiments of the disclosure may prevent water remaining in the case 501 from being discharged to the outside through the filter inserting opening 109 upon separating of the filter device 130 from the case 501 to manage (maintain and/or repair) the filter device 130, and accordingly, the washing machine 7 may prevent surroundings from being contaminated.

Figure 31:
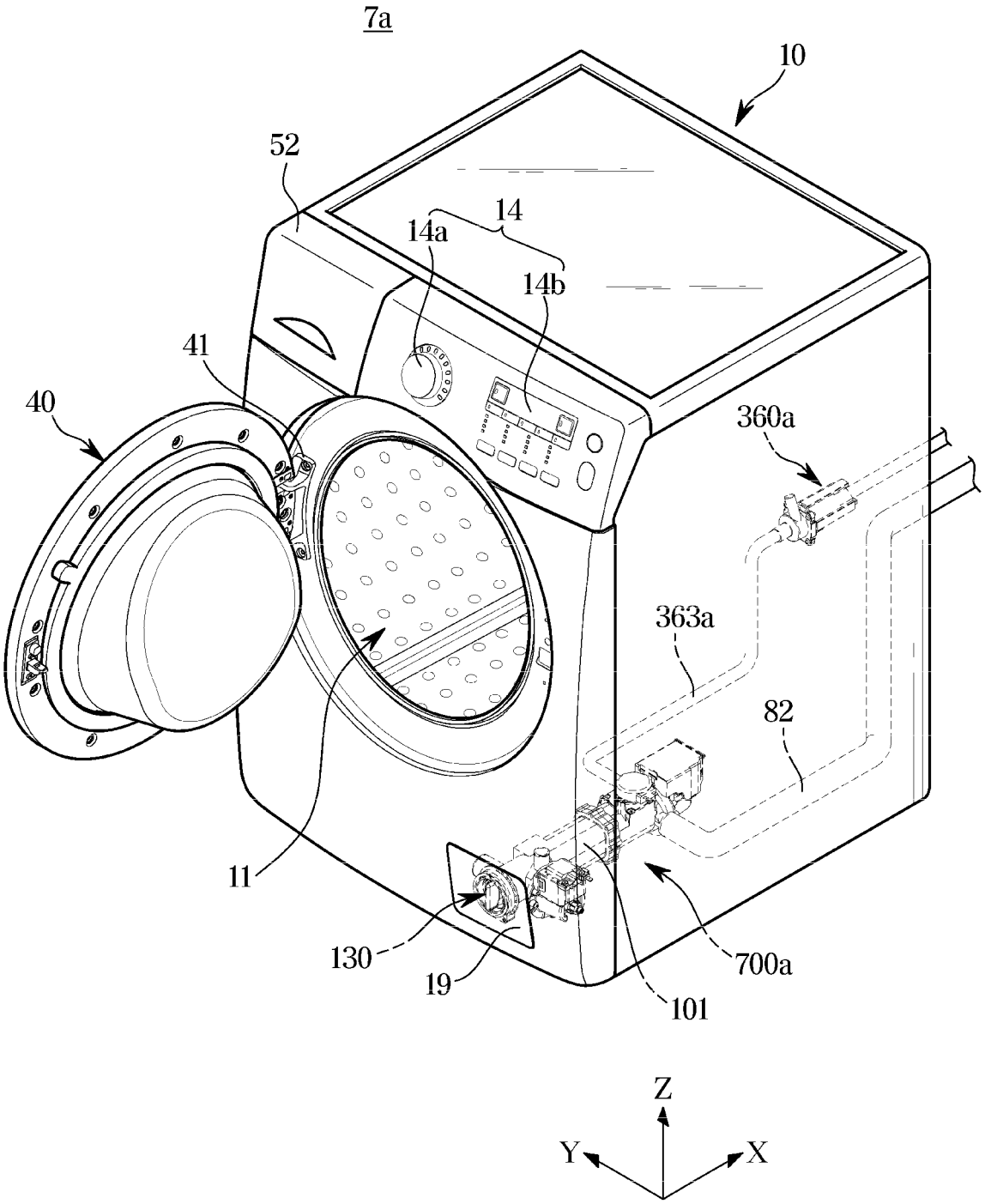
FIG. 31 shows a washing machine including a drain device according to an embodiment of the disclosure.

FIG. 31 shows a washing machine including a drain device according to an embodiment of the disclosure.

Referring to FIG. 31, a drain device 700*a* of a washing machine 7*a* according to an embodiment of the disclosure will be described. In the following description about the drain device 700*a* shown in FIG. 31, the same components as those of the drain device 700 shown in FIGS. 28 to 30 may be assigned like reference numerals and detailed descriptions thereof will be omitted.

Referring to FIG. 31, the washing machine 7*a* according to an embodiment of the disclosure may include a remaining water pump 760*a* installed in the housing 10. The remaining water pump 760*a* may be spaced from the drain pump 700*a*. The remaining water pump 760*a* may be connected to the drain pump 700*a* by a remaining water guide 763*a*. The remaining water pump 760*a* may be positioned downstream of the remaining water guide 763*a* in a direction of a water stream formed by the remaining water pump 760*a*.

The method for preventing remaining water of the drain device 700 from being discharged to the outside of the case 501 while the filter device 130 is dismounted from the case 501 of the drain device 700 shown in FIGS. 28 to 30 may be applied to a method for preventing remaining water of the drain device 700*a* from being discharged to the outside of the case 501 while the filter device 130 is dismounted from the case 501 of the drain device 700*a* shown in FIG. 31.

The drain device 700*a* shown in FIG. 31 may include a remaining water space formed inside the case 501, like the drain device 700 shown in FIGS. 28 to 30. Accordingly, because the drain device 700*a* shown in FIG. 31 stores a preset amount of remaining water although the drain pump 120 does not operate, remaining water of the drain device 700*a* may be prevented from being discharged to the outside of the case 501.

According to this configuration, the washing machine 7*a* according to various embodiments of the disclosure may prevent water remaining in the case 501 from being discharged to the outside through the filter inserting opening 109 upon separating of the filter device 130 from the case 501 to manage (maintain and/or repair) the filter device 130, and accordingly, the washing machine 7*a* may prevent surroundings from being contaminated.

Figure 32:
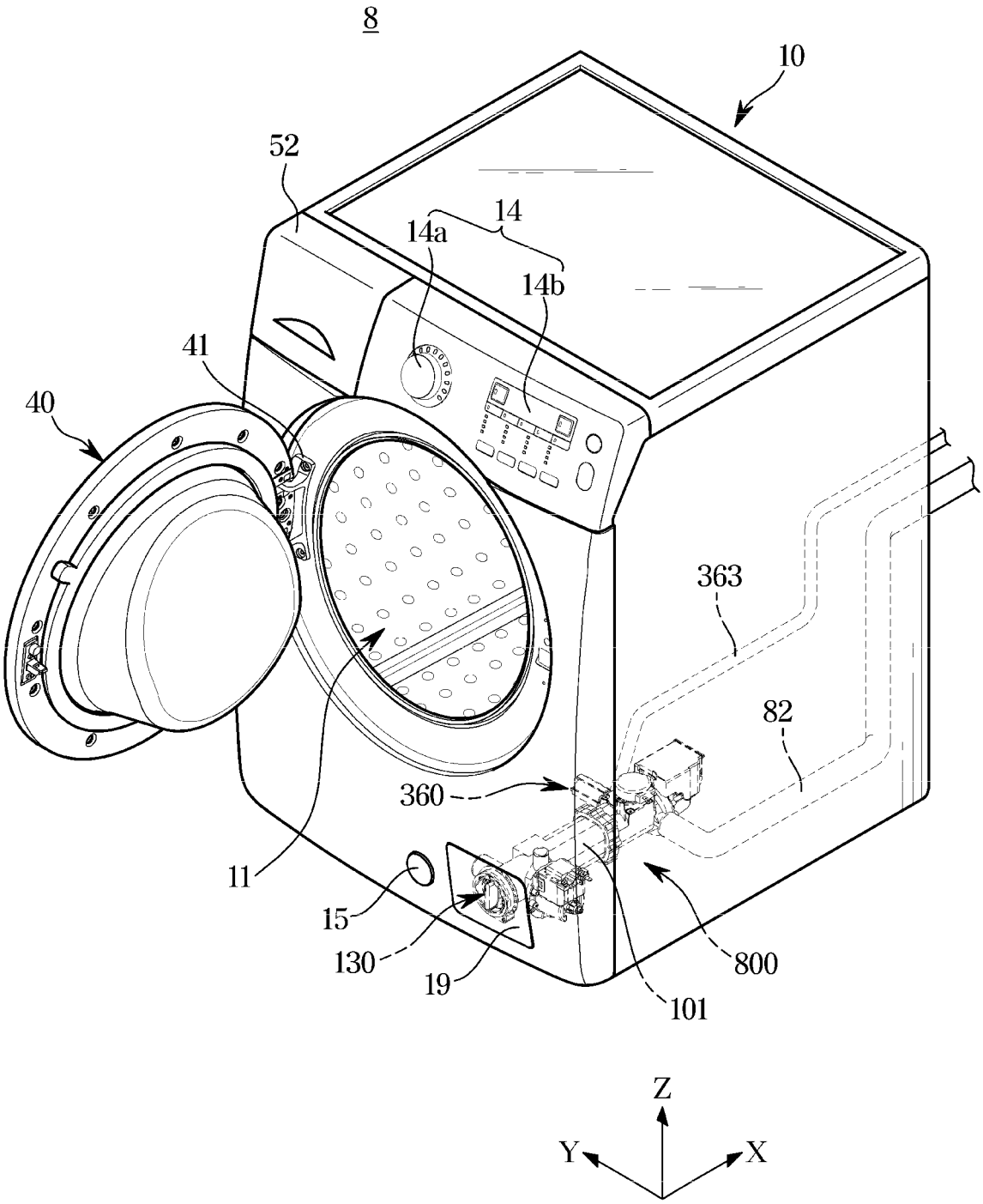
FIG. 32 shows a washing machine including a drain device according to an embodiment of the disclosure.
Figure 33:
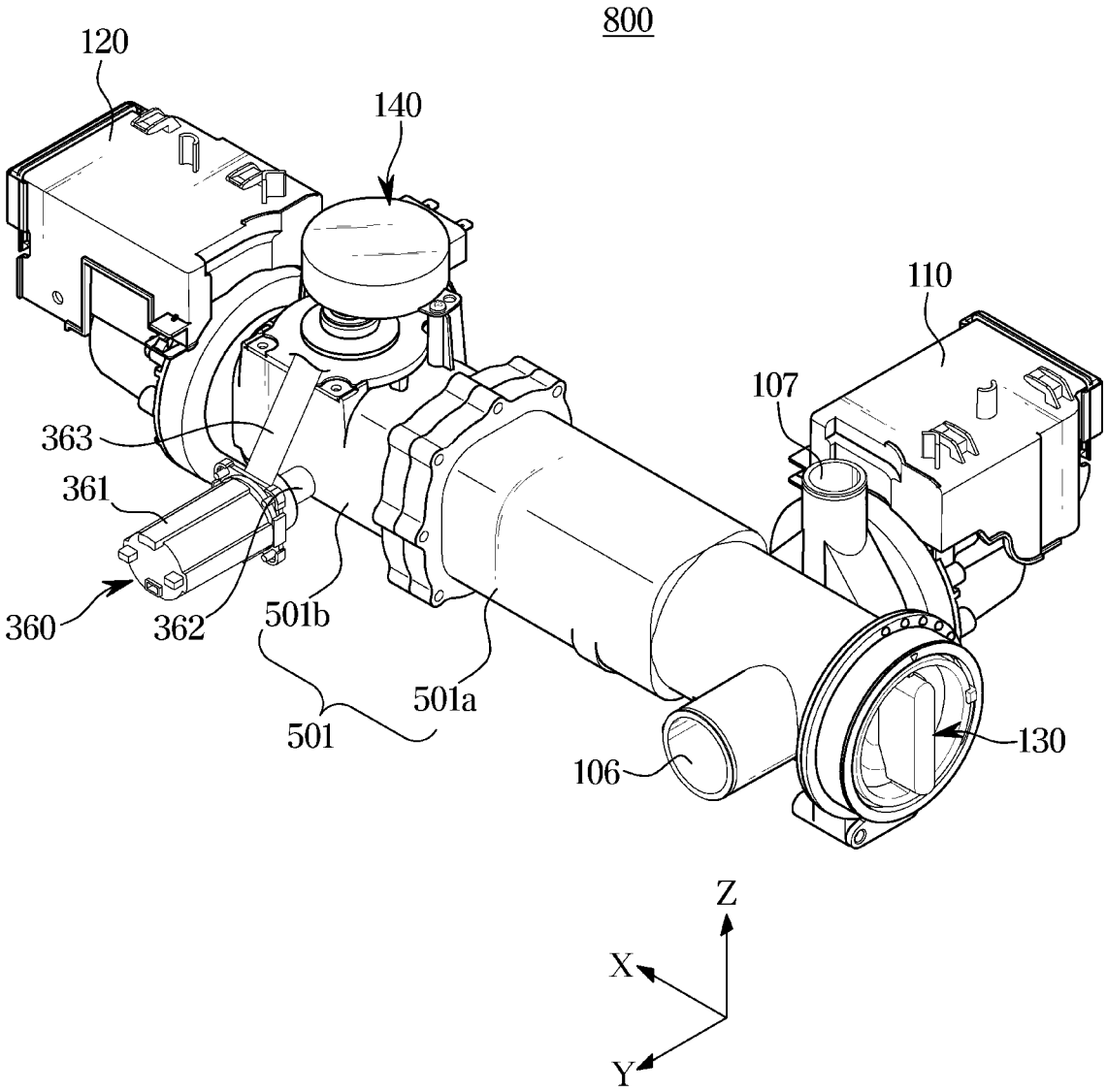
FIG. 33 shows the drain device shown in FIG. 32 according to an embodiment of the disclosure.
Figure 34:
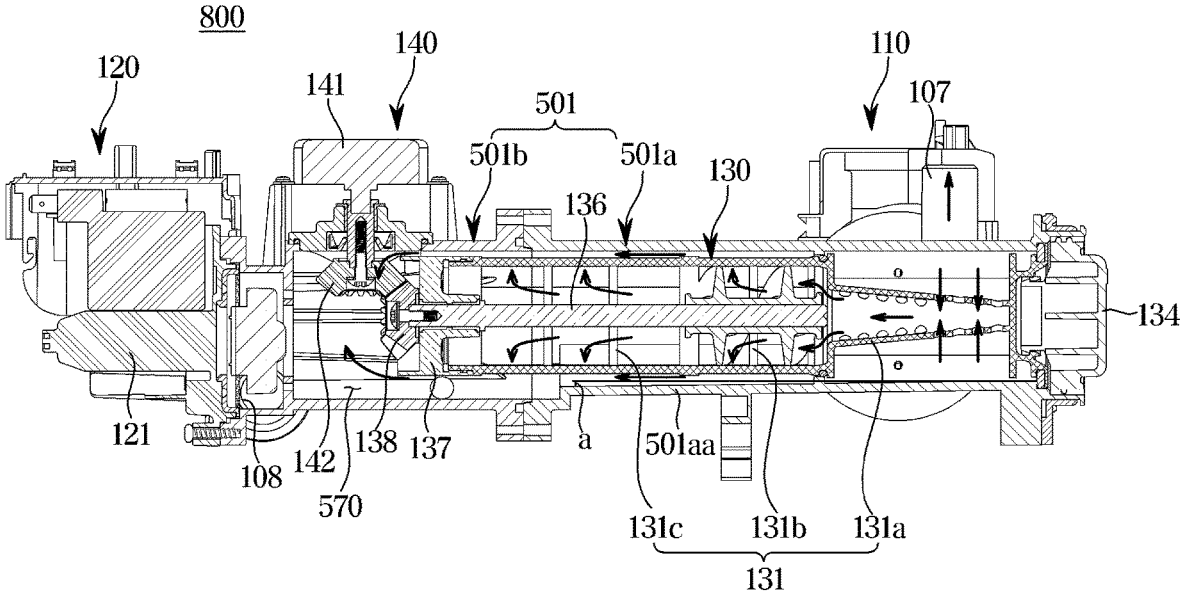
FIG. 34 shows a cross section of the drain device shown in FIG. 33 according to an embodiment of the disclosure.

FIG. 32 shows a washing machine including a drain device according to an embodiment of the disclosure. FIG. 33 shows the drain device shown in FIG. 32. FIG. 34 shows a cross section of the drain device shown in FIG. 33.

A drain device 800 of a washing machine 8 according to an embodiment of the disclosure will be described with reference to FIGS. 32 to 34.

In the following description about the drain device 800 shown in FIGS. 31 to 34, the same components as those of the drain device 700 shown in FIGS. 28 to 30 may be assigned like reference numerals and detailed descriptions thereof will be omitted.

Referring to FIGS. 32 to 34, the drain device 800 may include the case 501, the circulation pump 110 for circulating water stored in the tub 20, the drain pump 120 for discharging water stored in the tub 20 to the outside of the housing 10, the filter device 130 for filtering water discharged through the drain pump 120, the filter driver 140 for driving the filter device 130, and the remaining water space 570 and the remaining water inclined portion 501*aa* formed inside the case 501.

The drain device 800 may include the remaining water pump 360 that operates to discharge water of the case 501 to the outside of the case 501 while the filter device 130 is dismounted from the case 501. The remaining water pump 360 may be installed in the case 501. The remaining water pump 360 may be adjacent to the drain pump 120. The remaining water pump 360 may be adjacent to the drain opening 108. The remaining water pump 360 may be positioned upstream of the remaining water guide 363 in a direction of a water stream formed by the remaining water pump 360. Each of the circulation pump 110, the drain pump 120, and the remaining water pump 360 of the drain device 800 may be referred to as a pump.

The remaining water pump 360 may include the remaining water motor 361 for forming a water stream of water stored in the case 501 such that the water is discharged through the remaining water guide 363, the remaining water opening 362 connected to the remaining water motor 361, and the remaining water guide 363 extending from the remaining water pump 360 to the outside of the housing 10.

The drain device 800 shown in FIGS. 32 to 34 may omit the sensor 150 of the drain device 700 shown in FIGS. 28 to 30. The washing machine 8 may include the input device 15 for receiving a command for operating the remaining water pump 360 from a user. The input device 15 may receive a command for operating the remaining water pump 360 from a user by being pressed. The input device 15 may receive a command for operating the remaining water pump 360 from a user by being touched. The input device 15 may be adjacent to the cover 19.

The method for preventing remaining water of the drain device 400 from being discharged to the outside of the case 501 while the filter device 130 is dismounted from the case 501 of the drain device 400 shown in FIGS. 17 to 19 may be applied to a method for preventing remaining water of the drain device 800 from being discharged to the outside of the case 501 while the filter device 130 is dismounted from the case 501 of the drain device 800 shown in FIGS. 32 to 34.

Because the drain device 800 of the washing machine 8 shown in FIGS. 32 to 34 includes the remaining water space 570, a preset amount of remaining water may be stored although the drain pump 120 does not operate, and accordingly, remaining water of the drain device 800 may be prevented from being discharged to the outside of the case 501.

According to this configuration, the washing machine 8 according to various embodiments of the disclosure may prevent water remaining in the case 501 from being discharged to the outside through the filter inserting opening 109 by operating the drain pump 120 upon separating of the filter device 130 from the case 501 to manage (maintain and/or repair) the filter device 130, and accordingly, the washing machine 8 may prevent surroundings from being contaminated.

Figure 35:
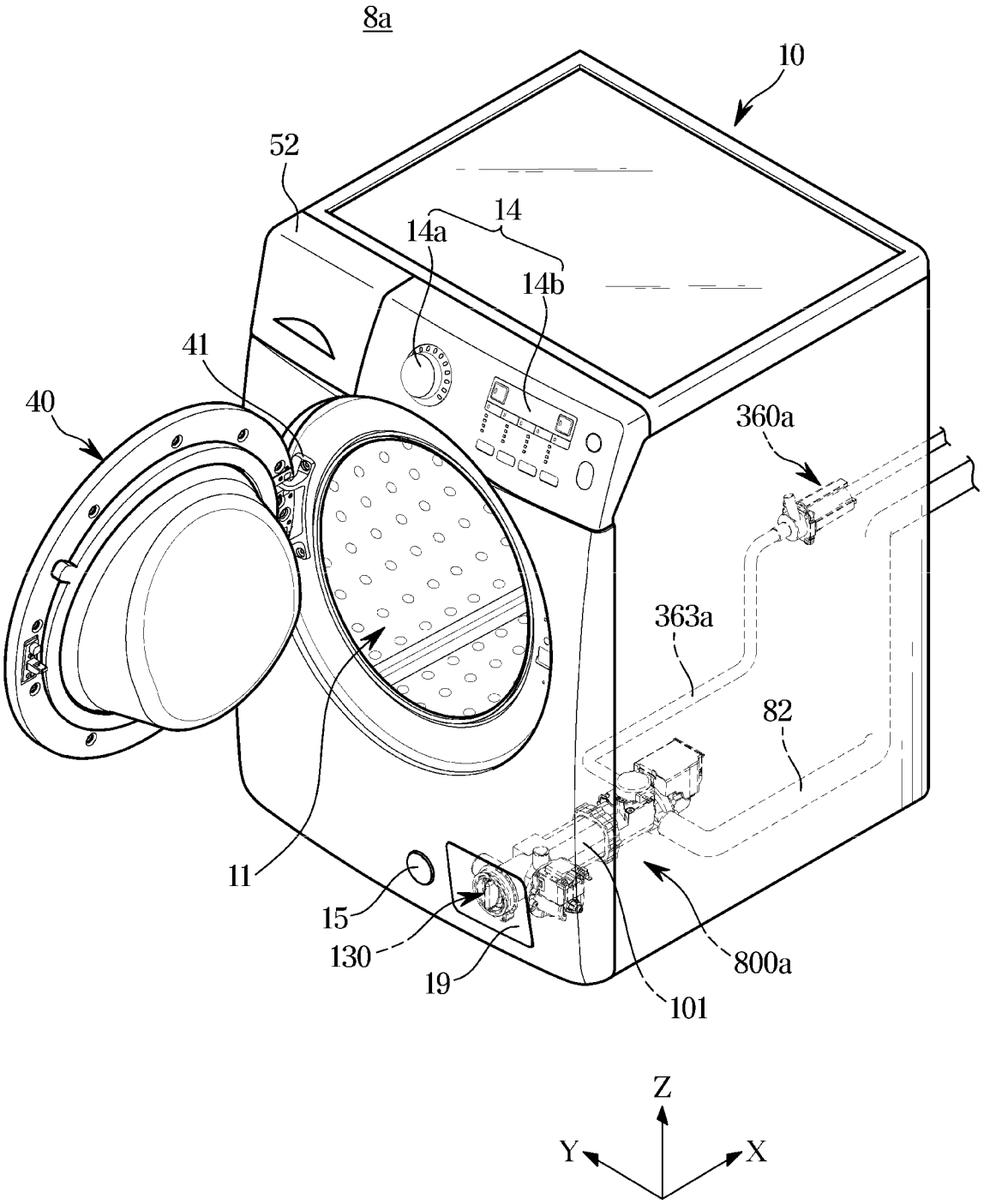
FIG. 35 shows a washing machine including a drain device according to an embodiment of the disclosure.

FIG. 35 shows a washing machine including a drain device according to an embodiment of the disclosure.

A drain device 800*a* of a washing machine 8*a* according to an embodiment of the disclosure will be described with reference to FIG. 35. In the following description about the drain device 800*a* shown in FIG. 35, the same components as those of the drain device 800 shown in FIGS. 32 to 34 may be assigned like reference numerals and detailed descriptions thereof will be omitted.

Referring to FIG. 35, the washing machine 8*a* according to an embodiment of the disclosure may include a remaining water pump 360*a* installed in the housing 10. The remaining water pump 360*a* may be spaced from the drain device 800*a*. The remaining water pump 360*a* may be connected to the drain device 800*a* by the remaining water guide 363*a*. The remaining water pump 360*a* may be positioned downstream of the remaining water guide 363*a* in a direction of a water stream formed by the remaining water pump 360*a*.

The method for preventing remaining water of the drain device 400 from being discharged to the outside of the case 501 while the filter 131 is dismounted from the case 501 of the drain device 400 shown in FIGS. 17 to 19 may be applied to a method for preventing remaining water of the drain device 800*a* from being discharged to the outside of the case 501 while the filter 131 is dismounted from the case 501 of the drain device 800*a* shown in FIG. 35.

The drain device 800*a* shown in FIG. 35 may include a remaining water space formed inside the case 501, like the drain device 800 shown in FIGS. 32 to 34. Accordingly, because the drain device 800*a* shown in FIG. 35 stores a preset amount of remaining water although the drain pump 120 does not operate, remaining water of the drain device 800*a* may be prevented from being discharged to the outside of the case 501.

According to this configuration, the washing machine 8*a* according to various embodiments of the disclosure may prevent water remaining in the case 501 from being discharged to the outside through the filter inserting opening 109 upon separating of the filter device 130 from the case 501 to manage (maintain and/or repair) the filter device 130, and accordingly, the washing machine 8*a* may prevent surroundings from being contaminated.

Figure 36:
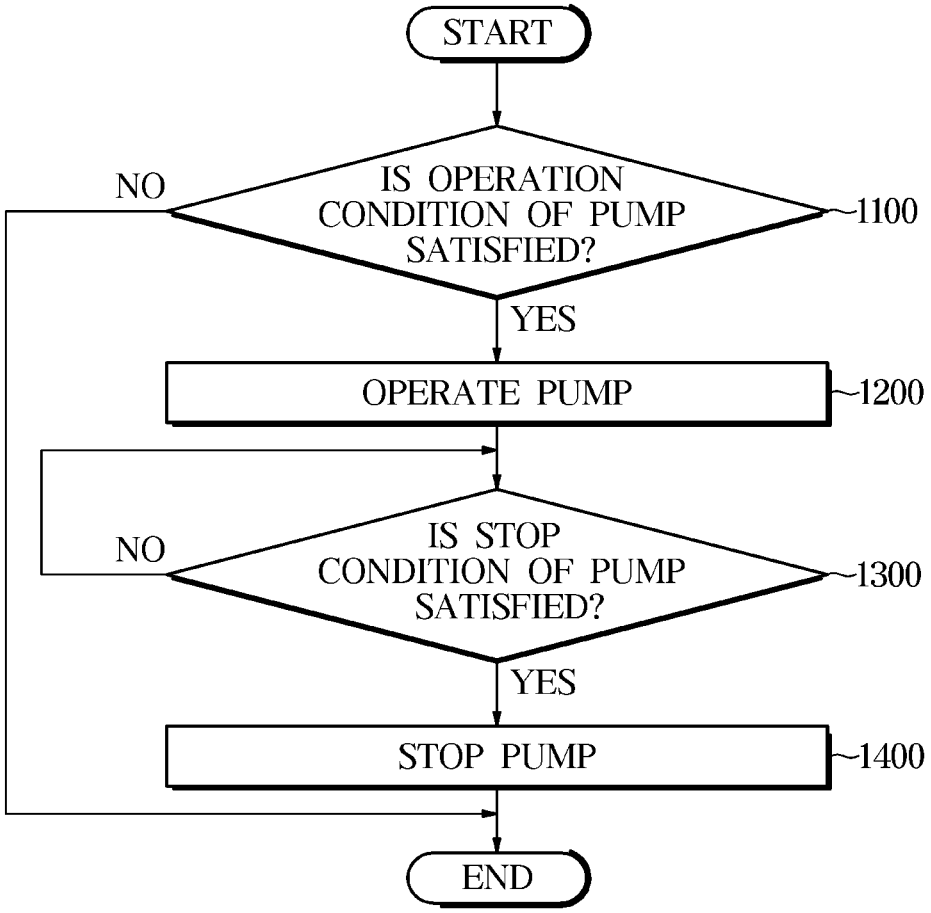
FIG. 36 is a flowchart showing a method for controlling a washing machine according to an embodiment of the disclosure.

FIG. 36 is a flowchart showing a method for controlling a washing machine according to an embodiment of the disclosure.

Referring to FIG. 36, the controller 90 according to an embodiment of the disclosure may operate the pump 120 or 360 based on an identification (YES in operation 1100) that an operation condition of the pump 120 or 360 is satisfied (operation 1200).

1) The operation condition of the pump 120 or 360 may include at least one of the following conditions.

- 1-1) A detection of dismounting of the filter device 130 from the case 101 by the sensor 150
- 1-2) A detection of openness of the cover 19 by the sensor 150
- 1-3) Reception of a command input through the input device 15
- 1-4) Reception of a command for operating the pump 120 or 360 from a user terminal through the communicator 95

The controller 90 may stop operating the pump 120 or 360 based on an identification (YES in operation 1300) that a stop condition of the pump 120 or 360 is satisfied while the pump 120 or 360 operates (operation 1400).

2) The stop condition of the pump 120 or 360 may include at least one of the following conditions.

- 2-1) A detection of coupling of the filter device 130 to the case 101 by the sensor 150
- 2-2) A detection of closing of the cover 19 by the senor 150
- 2-3) Reception of a command input through the input device 15
- 2-4) Reception of a command for stopping the pump 120 or 360 from a user terminal through the communicator 95
- 2-5) A case in which an operation time of the pump 120 or 360 exceeds a preset time while the pump 120 or 360 operates according to conditions 1-3 and 1-4

According to the disclosure, while a user manages the filter device 130, water remaining in the case 101 may be efficiently prevented from being discharged to the outside through the filter inserting opening 109.

Figure 37:
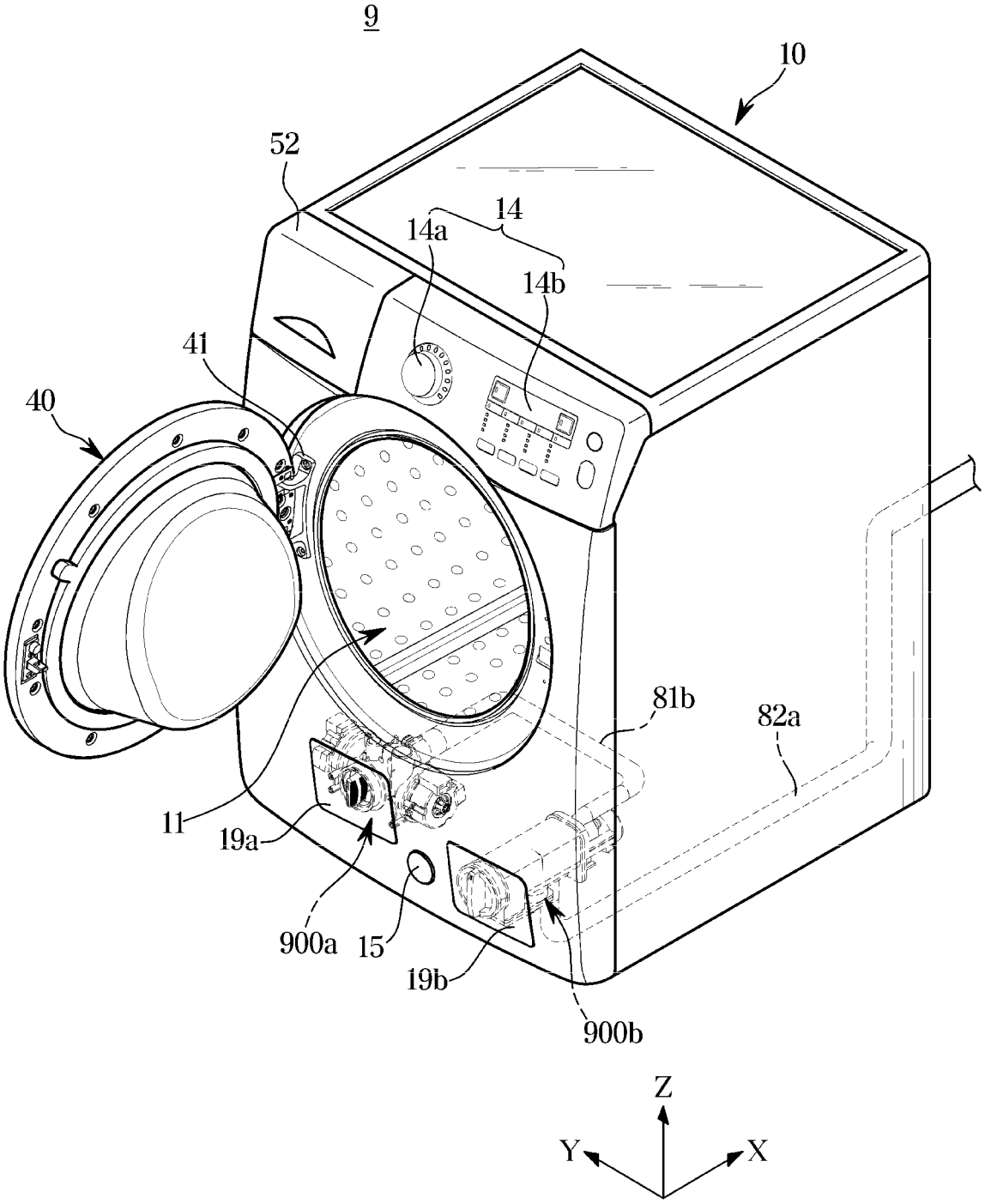
FIG. 37 shows a washing machine including a first filter device and a second filter device according to an embodiment of the disclosure.
Figure 38:
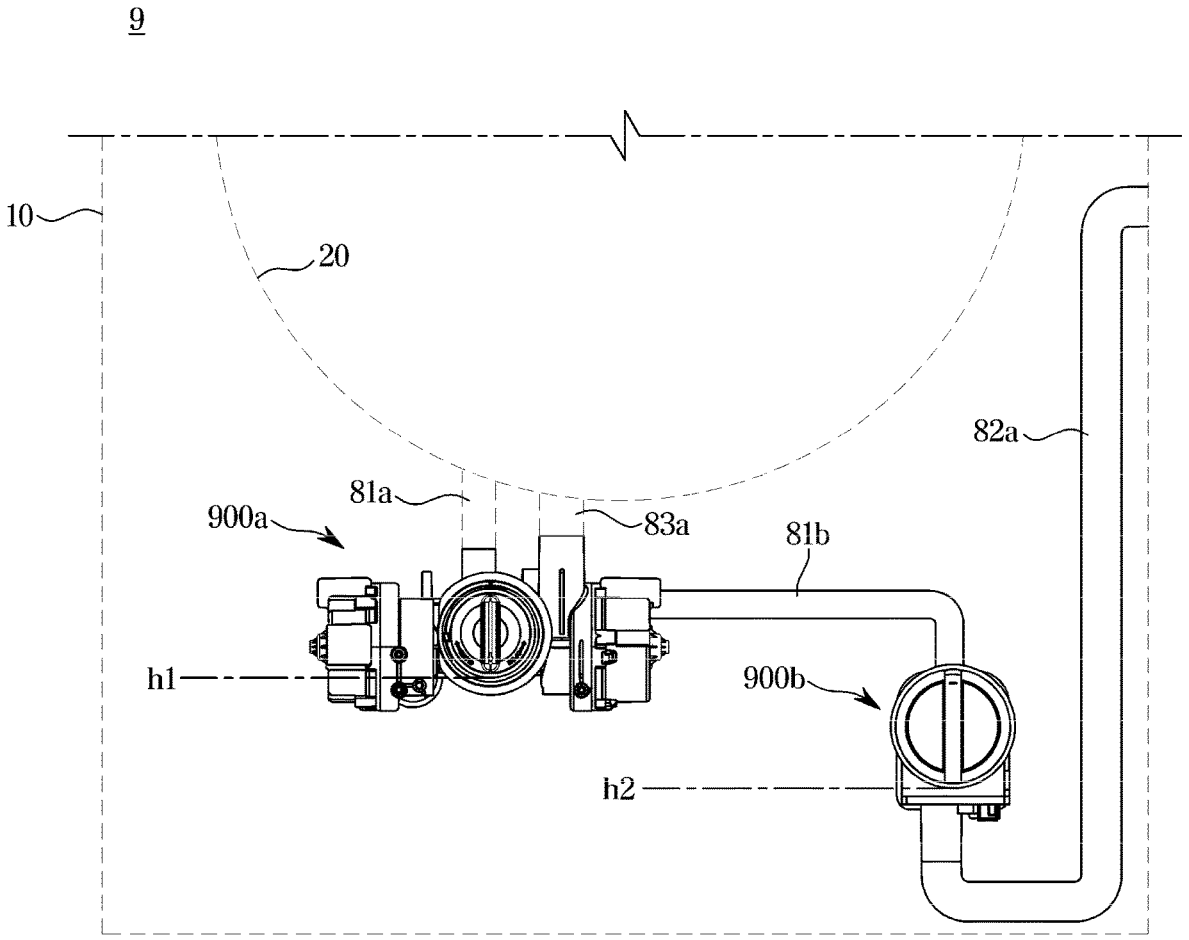
FIG. 38 shows an arrangement relationship of a tub, the first filter device, and the second filter device of the washing machine shown in FIG. 37, in a front direction according to an embodiment of the disclosure.
Figure 39:
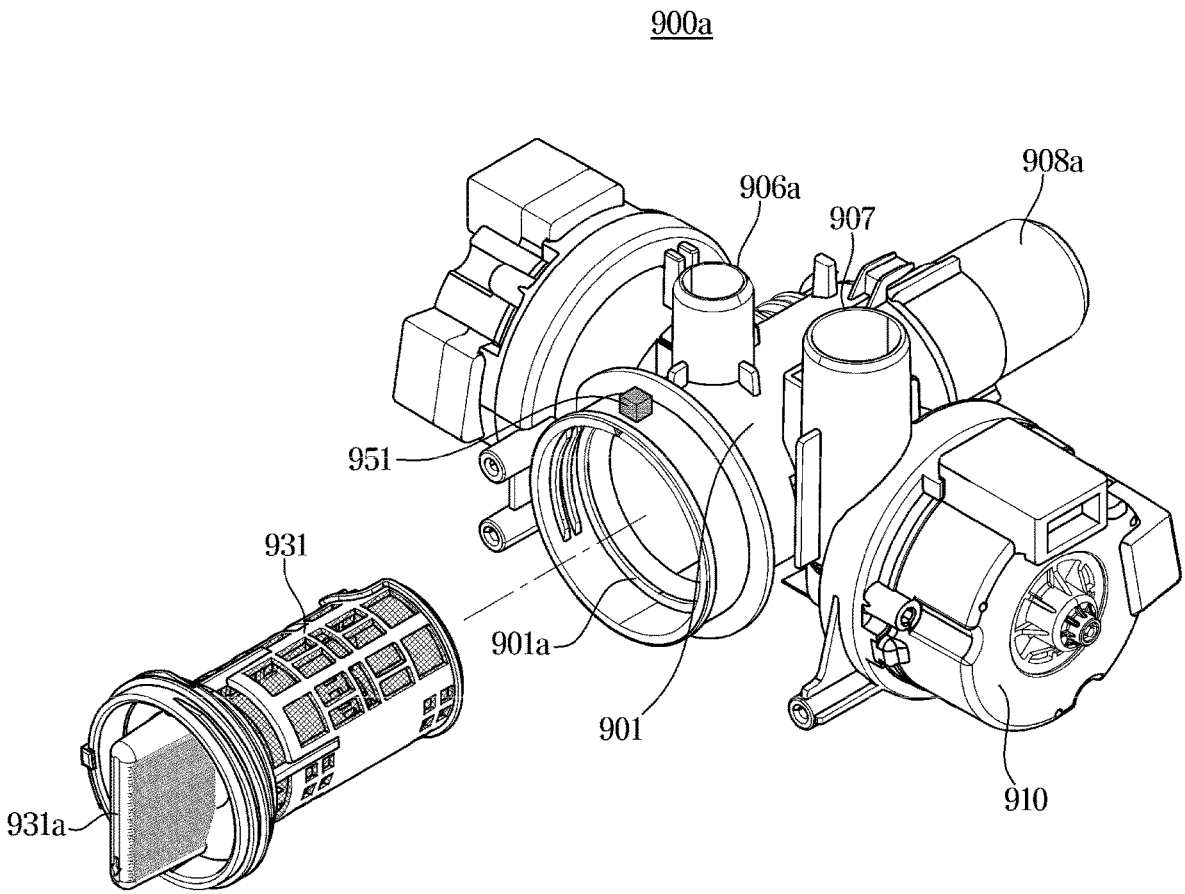
FIG. 39 shows the first filter device shown in FIG. 37 according to an embodiment of the disclosure.
Figure 40:
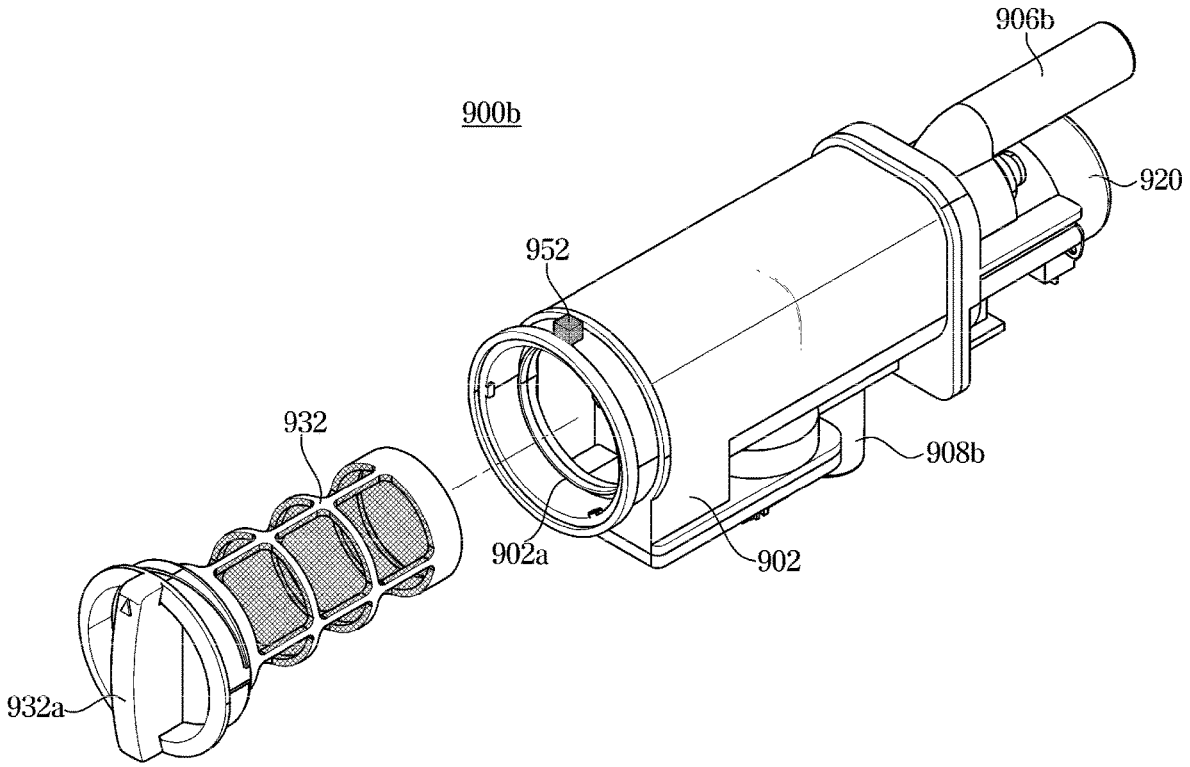
FIG. 40 shows the second filter device shown in FIG. 37 according to an embodiment of the disclosure.

FIG. 37 shows a washing machine including a first filter device and a second filter device according to an embodiment of the disclosure. FIG. 38 shows an arrangement relationship of a tub, the first filter device, and the second filter device of the washing machine shown in FIG. 37, in a front direction. FIG. 39 shows the first filter device shown in FIG. 37. FIG. 40 shows the second filter device shown in FIG. 37.

A washing machine 9 according to an embodiment of the disclosure will be described with reference to FIGS. 37 to 40. In the following description about the washing machine 9 shown in FIGS. 37 to 40, the same components as those of the washing machine 1 shown in FIGS. 3 to 6 may be assigned like reference numerals and detailed descriptions thereof will be omitted.

Referring to FIGS. 37 and 38, the washing machine 9 may include a first filter device 900*a* and a second filter device 900*b*. The first filter device 900*a* and the second filter device 900*b* shown in FIGS. 37 and 38 may perform the same function as the drain device 100 shown in FIGS. 3 to 6.

The first filter device 900*a* may be connected to the tub 20. The washing machine 9 may include a first connecting guide 81*a* for guiding water discharged from the tub 20 to the first filter device 900*a*. The washing machine 9 may include a circulation guide 83*a* for guiding water discharged from the first filter device 900*a* to the tub 20.

The second filter device 900*b* may be connected to the first filter device 900*a*. The washing machine 9 may include a second connecting guide 81*b* for guiding water discharged from the first filter device 900*a* to the second filter device 900*b*. The washing machine 9 may include a drain guide 82*b* for discharging water discharged from the second filter device 900*b* to the outside of the housing 10.

The washing machine 9 may include a first cover 19*a* for covering the first filter device 900*a*. The first cover 19*a* may be positioned in a lower portion of the front surface of the housing 10. A user may access the first filter device 900*a* by opening the first cover 19*a*.

The washing machine 9 may include a second cover 19*b* for covering the second filter device 900*b*. The second cover 19*b* may be positioned in the lower portion of the front surface of the housing 10. A user may access the second filter device 900*b* by opening the second cover 19*b*.

According to various embodiments of the disclosure, the washing machine 9 according to an embodiment of the disclosure may include the input device 15 that is adjacent to the first cover 19*a* or the second cover 19*b*, instead of being provided on the control panel 14. For example, the input device 15 may be positioned on the front surface of the housing 10 below the door 40. Also, the input device 15 may be positioned on the front surface of the housing 10, and positioned to one side of the first cover 19*a* or the second cover 19*b*.

The input device 15 may be implemented as a tact switch, a push switch, a slide switch, a toggle switch, a micro switch, or a touch switch. However, a kind of the input device 15 is not limited to these.

The input device 15 may be used to operate a drain pump 920.

Referring to FIG. 39, the first filter device 900*a* may include a first case 901. The first case 901 may form an appearance of the first filter device 900*a*. The first case 901 may accommodate a first filter 931. In the first case 901, a first filter inserting opening 901*a* through which the first filter 931 is insertable into the first case 901 may be formed.

In the first case 901, a first inlet 906*a* connected to the first connecting guide 81*a* may be formed. Water stored in the tub 20 may enter the first filter device 900*a* through the first inlet 906*a*.

In the first case 901, a circulation opening 907 connected to the circulation guide 83*a* may be formed. The circulation opening 907 may be adjacent to a circulation pump 910 to guide water circulating to the tub 20 by the circulation pump 910.

In the first case 901, a first drain opening 908*a* connected to the second connecting guide 81*b* may be formed. The first drain opening 908*a* may guide water that is discharged to the second filter device 900*b* by the drain pump 920.

The first filter device 900*a* may include the circulation pump 910 for circulating water of the tub 20. The circulation pump 910 may be installed in the first case 901. The circulation pump 910 may form a water stream of water received through the first inlet 906*a* such that the water is discharged through the circulation opening 907.

While the circulation pump 910 operates, water stored in the tub 20 may enter the first filter device 900*a* through the first inlet 906*a*, the water entered into the first filter device 900*a* may pass through the first filter 931 such that foreign materials of the water is filtered, and then the water may be discharged to the tub 20 through the circulation opening 907.

The first filter device 900*a* may include the first filter 931 for filtering water passing through the first filter device 900*a*. The first filter 931 may be accommodated inside the first case 901. The first filter 931 may be detachably installed in the first case 901.

The first filter 931 may be positioned between the first inlet 906*a* and the first drain opening 908*a*. The first filter 931 may filter foreign materials having relatively larger sizes than a second filter 932. Water filtered by the first filer 931 may move to the tub 20 by the circulation pump 910. The water filtered by the first filter 931 may move to the second filter device 900*b* by the drain pump 920.

The first filter 931 may include a first filter handle 931*a*. The first filter handle 931*a* may be exposed to outside of the first case 901 after the first filter 931 is installed in the first case 901. A user may separate the first filter 931 from the first case 901 by using the first filter handle 931*a*.

The washing machine 9 may include a first sensor 951 capable of identifying whether the first filter 931 is installed in the first case 901. The first sensor 951 may be mounted on the first case 901. The first sensor 951 may be adjacent to the first filter 931. The first sensor 951 may be adjacent to the first filter handle 931*a*. The first sensor 951 may be positioned on an outer circumferential surface of the first case 901. The first sensor 951 may be positioned between an inner circumferential surface of the first case 901 and the first filter 931.

The first sensor 951 may detect coupling of the first filter 931 to the first case 901. The first sensor 951 may detect dismounting of the first filter 931 from the first case 901. Dismounting of the first filter 931 from the first case 901 may mean that the first filter inserting opening 901*a* starts opening according to an operation of the first filter 931. The first sensor 951 may be one among an optical sensor, a magnetic sensor, an infrared sensor, or a pressure sensor. However, a kind of the sensor 951 is not limited to these, and the first sensor 951 may be implemented as various kinds of sensors (for example, an image sensor or an ultrasonic sensor) capable of detecting coupling of the first filter 931 to the first case 901.

According to various embodiments of the disclosure, the first sensor 951 may detect openness or closing of the first cover 19*a*.

The first sensor 951 may be omitted.

Referring to FIG. 40, the second filter device 900*b* may include a second case 902. The second case 902 may form an appearance of the second filter device 900*b*. The second case 902 may accommodate the second filter 932. In the second case 902, a second filter inserting opening 902*a* through which the second filter 932 is insertable into the second case 902 may be formed.

In the second case 902, a second inlet 906*b* connected to the second connecting guide 81*b* may be formed. Water of the first filter device 900*a* may enter the second filter device 900*b* through the second inlet 906*b*.

In the second case 902, a second drain opening 908*b* connected to the drain guide 82*b* may be formed. The second drain opening 908*b* may be adjacent to the drain pump 120 to guide water that is discharged to the outside of the housing 10 by the drain pump 920.

The second filter device 900*b* may include the drain pump 920 for discharging water stored in the tub 20 to the outside of the housing 10. The drain pump 920 may be installed in the second case 902. The drain pump 920 may form a water stream of water received through the second inlet 906*b* such that the water is discharged through the second drain opening 908*b*.

While the drain pump 920 operates, water stored in the tub 20 may enter the first filter device 900*a* through the first inlet 906*a*, the water entered into the first filter device 900*a* may pass through the first filter 931 such that foreign materials of the water are filtered, then the water may be discharged from the first filter device 900*a* through the first drain opening 908*a*, the water discharged from the first filter device 900*a* may be guided to the second filter device 900*b* by the second connecting guide 81*b*, the water guided to the second filter device 900*b* may enter the second filter device 900*b* through the second inlet 906*b*, the water entered into the second filter device 900*b* may pass through the second filter 932 such that foreign materials of the water are filtered, and then the water may be discharged from the second filter device 900*b* through the second drain opening 908*b* and guided to the outside of the housing 10 by the drain guide 82*a*.

The second filter device 900*b* may include the second filter 932 for filtering water passing through the second filter device 900*b*. The second filter 932 may be accommodated inside the second case 902. The second filter 932 may be detachably installed in the second case 902.

The second filter 932 may be positioned between the second inlet 906*b* and the second drain opening 908*b*. The second filter 932 may filter foreign materials having relatively smaller sizes than the first filter 931. The second filter 932 may filter microplastics having sizes of 5 mm or less. The second filter 932 may include a mesh filter.

The second filter 932 may include a second filter handle 932*a*. The second filter handle 932*a* may be exposed to outside of the second case 902 after the second filter 932 is installed in the second case 902. A user may separate the second filter 932 from the second case 902 by using the second filter handle 932*a*.

The washing machine 9 may include a second sensor 952 capable of identifying whether the second filter 932 is installed in the second case 902. The second sensor 952 may be installed in the second case 902. The second sensor 952 may be adjacent to the second filter 932. The second sensor 952 may be adjacent to the second filter handle 932*a*. The second sensor 952 may be positioned on an outer circumferential surface of the second case 902. The second sensor 952 may be positioned between an inner circumferential surface of the second case 902 and the second filter 932.

The second sensor 952 may detect coupling of the second filter 932 to the second case 902. The second sensor 952 may detect dismounting of the second filter 932 from the second case 902. Dismounting of the second filter 932 from the second case 902 may mean that the second filter inserting opening 902*a* starts opening according to an operation of the second filter 932. The second sensor 952 may be one among an optical sensor, a magnetic sensor, an infrared sensor, or a pressure sensor. However, a kind of the second sensor 952 is not limited to these, and the second sensor 952 may be implemented as various kinds of sensors (for example, an image sensor or an ultrasonic sensor) capable of detecting coupling of the second filter 932 to the second case 902.

According to various embodiments of the disclosure, the second sensor 952 may detect openness or closing of the second cover 19*b*.

The second sensor 952 may be omitted.

Referring to FIG. 38, the second filter device 900*b* may be positioned below the first filter device 900*a* in the direction of gravity. A height h1 of a lower end of the first filter device 900*a* may be higher than a height h2 of a lower end of the second filter device 900*b*. Because the second filter device 900*b* is lower than the first filter device 900*a*, remaining water generated in the first filter device 900*a* may move to the second filter device 900*b* by gravity. According to this configuration, the washing machine 9 may prevent water remaining in the first case 901 from being discharged to the outside through the first filter inserting opening 901*a* upon separating of the first filter 931 from the first case 901 to manage (maintain and/or repair) the first filter 931, and accordingly, the washing machine 9 may prevent surroundings from being contaminated.

In the washing machine 9 according to an embodiment of the disclosure, the drain pump 920 may be provided in the second filter device 900*b* positioned downstream of a flow of water that is discharged from the washing machine 9. Because the drain pump 920 is provided in the second filter device 900*b* positioned downstream of a flow of water that is discharged from the washing machine 9, the washing machine 9 may remove remaining water generated in the first filter device 900*a*, as well as remaining water generated in the second filter device 900*b*, while the drain pump 920 operates.

The washing machine 9 according to an embodiment of the disclosure may prevent water remaining in the first case 901 and/or the second case 902 from being discharged to the outside through the first filter inserting opening 901*a* and/or the second filter inserting opening 902*a* by operating the drain pump 920 upon separating of the first filter 931 from the first case 901 to manage (maintain and/or repair) the first filter 931 or upon separating of the second filter 932 from the second case 902 to manage (maintain and/or repair) the second filter 932, and accordingly, the washing machine 9 may prevent surroundings from being contaminated.

Figure 41:
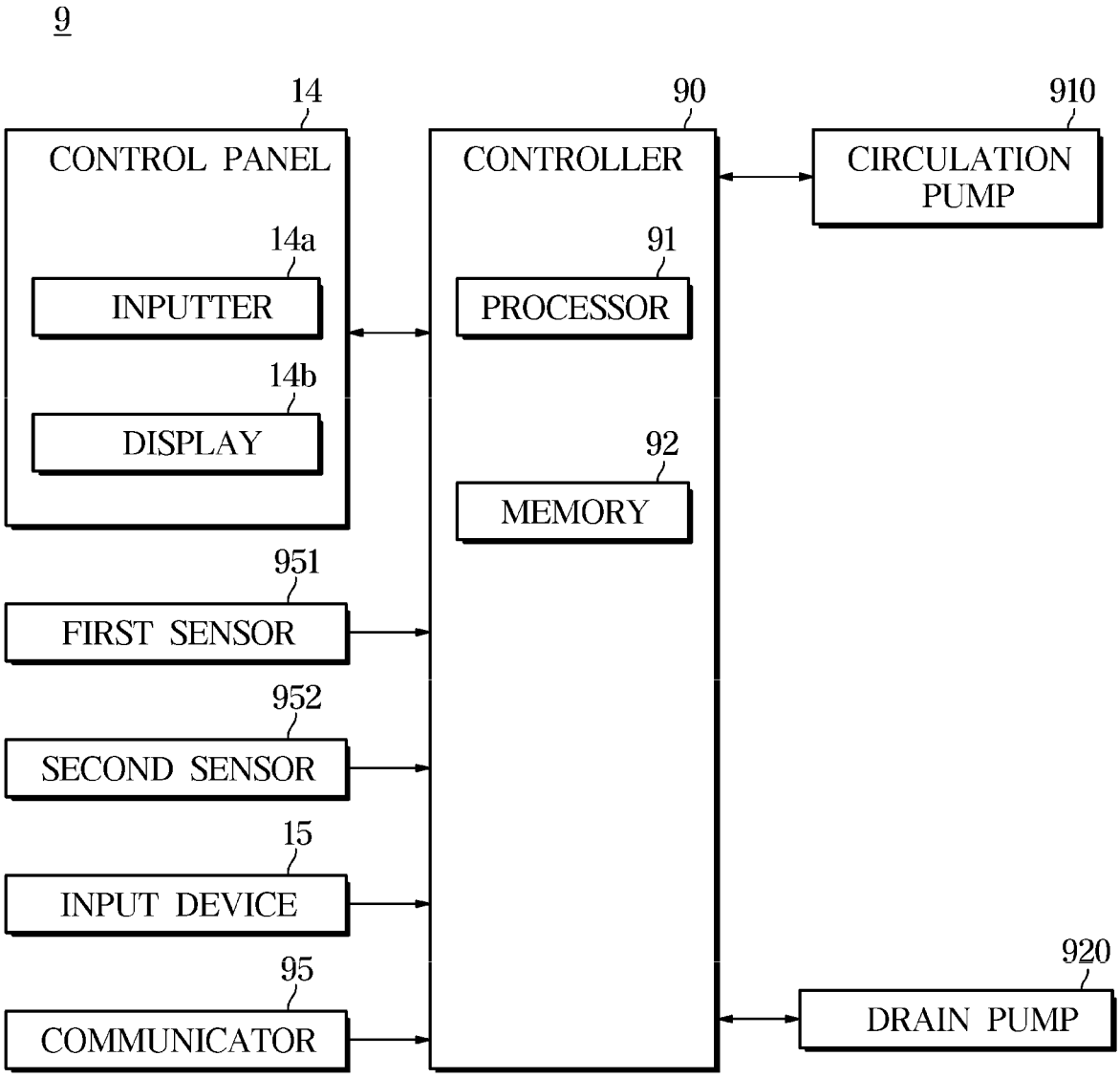
FIG. 41 is a control block diagram of a washing machine including the first filter device and the second filter device shown in FIGS. 37 to 40 according to an embodiment of the disclosure.

FIG. 41 is a control block diagram of a washing machine including the first filter device and the second filter device shown in FIGS. 37 to 40.

A control method for preventing remaining water existing in the first case 901 of the first filter device 900*a* shown in FIGS. 37 to 40 from being discharged to the outside of the first case 901 through the first filter inserting opening 901*a* while the first filter 931 is dismounted from the first case 901 of the first filter device 900*a*, and a control method for preventing remaining water existing in the second case 902 of the second filter device 900*b* from being discharged to the outside of the second case 902 through the second filter inserting opening 902*a* while the second filter 932 is dismounted from the second case 902 of the second filter device 900*b* will be described with reference to FIG. 41.

Referring to FIG. 41, the washing machine 9 according to an embodiment of the disclosure may include the control panel 14 for interacting with a user, the input device 15, the communicator 95, the first sensor 951, the second sensor 952, the controller 90 for controlling the drain pump 920 of the second filter device 900*b* based on data and/or information received from the first sensor 951 and the second sensor 952, and the drain pump 920 that operates based on a control signal from the controller 90.

The controller 90 may include at least one memory 92 and at least one processor 91 to perform the above-described operations and operations which will be described below.

According to an embodiment of the disclosure, the controller 90 may include the at least one memory 92 storing data in the form of an algorithm and/or program for controlling operations of components in the washing machine 9, and the at least one processor 91 that perform the above-described operations and operations which will be described below by using the data stored in the at least one memory 92. The memory 92 and the processor 91 may be implemented as separate chips. The processor 91 may include one, two, or more processing chips or one, two, or more processing cores. The memory 92 may include one, two, or more memory chips or one, two, or more memory blocks. Also, the memory 92 and the processor 91 may be implemented as a single chip.

The controller 90 may process a user input received through the inputter 14*a*, and control various components (for example, the driving motor 51, the water supply valve 62, the display 14*b*, the circulation pump 910, and the drain pump 920) of the washing machine 9 based on a result of the processing on the user input.

For example, the controller 90 may control various components of the washing machine 9 to perform at least one operation including a water supply operation, a washing operation, a rinsing operation, and/or a dehydrating operation according to a user input inputted to the control panel 14. For example, the controller 90 may control the driving motor 51 to adjust a rotation speed of the tub 20, or control the water supply valve 62 of the water supply device 60 to supply water to the tub 20.

The controller 90 may operate the circulation pump 910 to circulate water received from the first filter device 900*a* to the tub 20, while performing a washing operation and/or a rinsing operation.

According to an embodiment of the disclosure, the controller 90 may detect a load of the circulation pump 910 while operating the circulation pump 910, and detect clogging of the first filter 931 based on a load value of the circulation pump 910. For example, the controller 90 may detect clogging of the first filter 931 based on an identification that a load value of the circulation pump 910, which exceeds a preset value, is maintained for a preset time.

For this, the washing machine 9 may include a current sensor (not shown) for detecting driving current applied to the circulation pump 910, a power sensor (not shown) for detecting power applied to the circulation pump 910, and a speed sensor (not shown) for detecting a rotation speed of the circulation pump 910.

The controller 90 may obtain, while operating the circulation pump 910, a load value of the circulation pump 910 based on sensor data obtained from the current sensor (not shown) for detecting driving current applied to the circulation pump 910, the power sensor (not shown) for detecting power applied to the circulation pump 910, and/or the speed sensor (not shown) for detecting a rotation speed of the circulation pump 910.

According to an embodiment of the disclosure, the controller 90 may operate the drain pump 920 to discharge water stored in the tub 20 to the outside of the washing machine 9, while performing a washing operation and/or a rinsing operation. For example, the controller 90 may operate the drain pump 920 based on completion of a washing cycle of a washing operation, and operate the drain pump 920 based on completion of a rinsing cycle of a rinsing operation.

The controller 90 may detect a load of the drain pump 920 while operating the drain pump 920, and detect clogging of the second filter 932 based on a load value of the drain pump 920. For example, the controller 90 may detect clogging of the second filter 932 based on an identification that a load value of the drain pump 920, which exceeds the preset value, is maintained for the preset time.

For this, the washing machine 9 may include the current sensor (not shown) for detecting driving current applied to the drain pump 920 while the drain pump 920 operates, the power sensor (not shown) for detecting power applied to the drain pump 920 while the drain pump 920 operates, and/or the speed sensor (not shown) for detecting a rotation speed of the drain pump 920 while the drain pump 920 operates.

The controller 90 may obtain a load value of the drain pump 920 while operating the drain pump 920 based on sensor data obtained from the current sensor (not shown) for detecting driving current applied to the drain pump 920, the power sensor (not shown) for detecting power applied to the drain pump 920, and/or the speed sensor (not shown) for detecting a rotation speed of the drain pump 920.

According to an embodiment of the disclosure, the controller 90 may detect clogging of the first filter 931 and/or the second filter 932 based on a change in water level of the tub 20, while operating the drain pump 920.

For example, the controller 90 may detect clogging of the first filter 931 and/or the second filter 932 based on an identification that a change amount in water level of the tub 20 per unit time is smaller than a preset value while the drain pump 120 operates.

For this, the washing machine 9 may include a water level sensor (not shown) for detecting a water level of the tub 20.

According to various embodiments of the disclosure, the controller 90 may control the display 14*b* to output a visual feedback representing clogging of the first filter 931 and/or the second filter 932 based on a detection of the clogging of the first filter 931 and/or the second filter 932. For example, the visual feedback representing the clogging of the first filter 931 and/or the second filter 932 may include various visual indications, such as a character, a figure, a symbol, an icon, an image, and/or an animation.

According to the disclosure, a user may easily recognize clogging of the first filter 931 and/or the second filter 932 by the visual feedback, and manage the first filter 931 and/or the second filter 932.

The user who wants to manage the first filter 931 may separate the first filter 931 from the first case 901 by opening the first cover 19*a* shown in FIG. 37 and then operating the first filter handle 931*a* shown in FIG. 38. The user who wants to manage the second filter 932 may separate the second filter 932 from the second case 902 by opening the second cover 19*b* shown in FIG. 37 and then operating the second filter handle 932*a* shown in FIG. 39.

According to an embodiment of the disclosure, the first sensor 951 may detect separation of the first filter 931 from the first case 901, or openness of the first cover 19*a*. According to an embodiment of the disclosure, the second sensor 952 may detect separation of the second filter 932 from the second case 902, or openness of the second cover 19*b*.

The controller 90 may process sensor data received through the first sensor 951 and the second sensor 952, and control various components of the washing machine 9 based on a result of the processing on the sensor data. For example, the controller 90 may operate the drain pump 920 based on a result of processing on sensor data received through the first sensor 951 and/or the second sensor 952.

According to an embodiment of the disclosure, the controller 90 may operate the drain pump 920 based on a detection of separation of the first filter 931 from the first case 901 by the first sensor 951. According to a detection of dismounting of the first filter 931 from the first case 901 by the sensor 150, the controller 90 may control the drain pump 920 to discharge water of the first case 901 to the outside of the first case 901.

According to an embodiment of the disclosure, the controller 90 may operate the drain pump 920 based on a detection of separation of the second filter 932 from the second case 902 by the second sensor 952. According to a detection of dismounting of the second filter 932 from the second case 902 by the second sensor 952, the controller 90 may control the drain pump 920 to discharge water of the second case 902 to the outside of the second case 902.

According to an embodiment of the disclosure, the controller 90 may operate the drain pump 920 based on a detection of openness of the first cover 19*a* by the first sensor 951. Accordingly, according to a detection of openness of the first cover 19*a* by the first sensor 951, the controller 90 may control the drain pump 920 to discharge water of the first case 901 to the outside of the first case 901.

According to an embodiment of the disclosure, the controller 90 may operate the drain pump 920 based on a detection of openness of the second cover 19*b* by the second sensor 952. According to a detection of openness of the second cover 19*b* by the second sensor 952, the controller 90 may control the drain pump 920 to discharge water of the second case 902 to the outside of the second case 902.

According to an embodiment of the disclosure, the controller 90 may stop operating the drain pump 920 based on a detection of coupling of the first filter 931 to the first case 901 by the first sensor 951.

According to an embodiment of the disclosure, the controller 90 may stop operating the drain pump 920 based on a detection of coupling of the second filter 932 to the second case 902 by the second sensor 952.

According to an embodiment of the disclosure, the controller 90 may stop operating the drain pump 920 based on a detection of closing of the first cover 19*a* by the first sensor 951.

According to an embodiment of the disclosure, the controller 90 may stop operating the drain pump 920 based on a detection of closing of the second cover 19*b* by the second sensor 952.

According to an embodiment of the disclosure, the washing machine 9 may prevent water remaining in the first case 901 from being discharged to the outside through the first filter inserting opening 901*a* by operating the drain pump 920 upon separating of the first filter 931 from the first case 901 to manage (maintain and/or repair) the first filter 931, and accordingly, the washing machine 9 may prevent surroundings from being contaminated.

According to an embodiment of the disclosure, the washing machine 9 may prevent water remaining in the second case 902 from being discharged to the outside through the second filter inserting opening 902*a* by operating the drain pump 920 upon separating of the second filter 932 from the second case 902 to manage (maintain and/or repair) the second filter 932, and accordingly, the washing machine 9 may prevent surroundings from being contaminated.

The controller 90 may operate the drain pump 920 based on reception of a command input through the input device 15.

For example, the input device 15 implemented as a push switch may generate an electrical signal by being pressed by a user, and the controller 90 may operate the drain pump 920 based on reception of the electrical signal from the input device 15.

The user who wants to manage the first filter device 900*a* may operate the input device 15 before operating the first filter handle 931*a*, and according to an operation of the input device 15, the drain pump 920 may operate to prevent water remaining in the first case 901 from being discharged to the outside through the first filter inserting opening 901*a* upon separating of the first filter 931 from the first case 901.

The user who wants to manage the second filter device 900*b* may operate the input device 15 before operating the second filter handle 932*a*, and according to an operation of the input device 15, the drain pump 920 may operate to prevent water remaining in the second case 902 from being discharged to the outside through the second filter inserting opening 902*a* upon separating of the second filter 932 from the second case 902.

According to the disclosure, because the input device 15 is provided around the first cover 19*a* and/or the second cover 19*b*, the user may easily operate the drain pump 920 before opening the first cover 19*a* and/or the second cover 19*b*.

According to various embodiments of the disclosure, a location of the input device 15 may change. FIG. 41 shows the inputter 14*a* and the input device 15 separately. However, according to an embodiment of the disclosure, the input device 15 may be provided on the control panel 14, or may be a component of the inputter 14*a*.

According to an embodiment of the disclosure, the input device 15 may include a visual indicator representing an operation state of the drain pump 920. For example, the input device 15 implemented as a push switch may generate an electrical signal for operating the visual indicator by being pressed by the user.

According to the disclosure, the user may intuitively recognize an operation state of the drain pump 920.

The controller 90 may stop operating the drain pump 920 based on reception of a command input through the input device 15 while operating the drain pump 920.

For example, the input device 15 implemented as a push switch may stop the drain pump 920 based on an identification that the input device 15 is pressed by a user while the drain device 920 operates.

After the user finishes management of the first filter device 900*a*, the user may install the first filter device 900*a* in the first case 901, close the first cover 19*a*, and then again operate the input device 15 to stop operating the drain device 920.

After the user finishes management of the second filter device 900*b*, the user may install the second filter device 900*b* in the second case 902, close the second cover 19*b*, and then again operate the input device 15 to stop operating the drain device 920.

Meanwhile, in a case in which the user finishes management of the first filter device 900*a* and/or the second filter device 900*b* and then leaves without again operating the input device 15, that is, without stopping the drain pump 920, unnecessary energy may be consumed and noise may be generated.

According to various embodiments of the disclosure, according to elapse of a preset time (for example, about 10 minutes) after the controller 90 operates the drain pump 920 based on reception of a command input through the input device 15, the controller 90 may stop operating the drain pump 920.

According to the disclosure, although the user finishes management of the first filter device 900*a* and/or the second filter device 900*b* and then leaves without stopping the drain pump 920, the drain pump 920 may stop.

The washing machine 9 according to an embodiment of the disclosure may include the communicator 95 for communicating with an external device.

The communicator 95 may transmit data to the external device based on a control signal from the controller 90, or receive data from the external device. For example, the communicator 95 may transmit and receive various data by communicating with a server and/or a user terminal and/or a home appliance.

For this, the communicator 95 may support establishment of a direct (for example, wired) communication channel or a wireless communication channel with an external electronic device (for example, a server, a user terminal, and/or a home appliance), and communications through an established communication channel. According to an embodiment of the disclosure, the communicator 95 may include a wireless communication module (for example, a cellular communication module, a short-range communication module, or a GNSS communication module) or a wired communication module (for example, a LAN communication module or a power line communication module). A corresponding communication module among the communication modules may communicate with an external electronic device through a first network (for example, a short-range communication network, such as Bluetooth, WiFi Direct, or IrDA) or a second network (for example, a long-range communication network, such as a legacy cellular network, a 5G network, a next-generation communication network, the Internet, or a computer network (for example, a LAN or WAN)). The various kinds of communication modules may be integrated into a single component (for example, a single chip) or implemented with a plurality of separate components (for example, a plurality of chips).

According to various embodiments of the disclosure, the communicator 95 may establish communication with a user terminal through a server.

According to various embodiments of the disclosure, the communicator 95 may include a WiFi module, and communicate with an external server and/or a user terminal based on communication establishment with an AP in home.

The controller 90 may operate the drain pump 920 based on reception of a command for operating the drain pump 920 from a user terminal through the communicator 95.

According to various embodiments of the disclosure, the controller 90 may control the communicator 95 to transmit a message notifying clogging of the first filter 931 and/or the second filter 932 to the user terminal based on a detection of clogging of the first filter 931 and/or the second filter 932.

The user may recognize clogging of the first filter 931 and/or the second filter 932 through the user terminal.

The user terminal may provide an interface including a user interface element for operating the drain pump 920 based on reception of the message notifying clogging of the first filter 931 and/or the second filter 932.

The user terminal may transmit a command for operating the drain pump 920 to the communicator 95 based on a selection of the user interface element for operating the drain pump 920, and the controller 90 may operate the drain pump 920 based on reception of the command for operating the drain pump 920 from the user terminal through the communicator 95.

According to the disclosure, the user who has recognized clogging of the first filter 931 and/or the second filter 932 through the user terminal may easily operate the drain pump 920 before managing the first filter device 900*a* and/or the second filter device 900*b*.

Also, the user terminal may provide an interface including a user interface element for stopping the drain pump 920 based on the transmission of the command for operating the drain pump 920 to the communicator 95.

The user terminal may transmit a command for stopping the drain pump 920 to the communicator 95 based on a selection of the user interface element for stopping the drain pump 920, and the controller 90 may stop the drain pump 920 based on reception of the command for stopping the drain pump 920 from the user terminal through the communicator 95.

According to the disclosure, the drain pump 920 may operate according to a user's intention for managing the first and second filter devices 900*a* and 900*b*, without the first sensor 951 and/or the second sensor 952.

Figure 42:
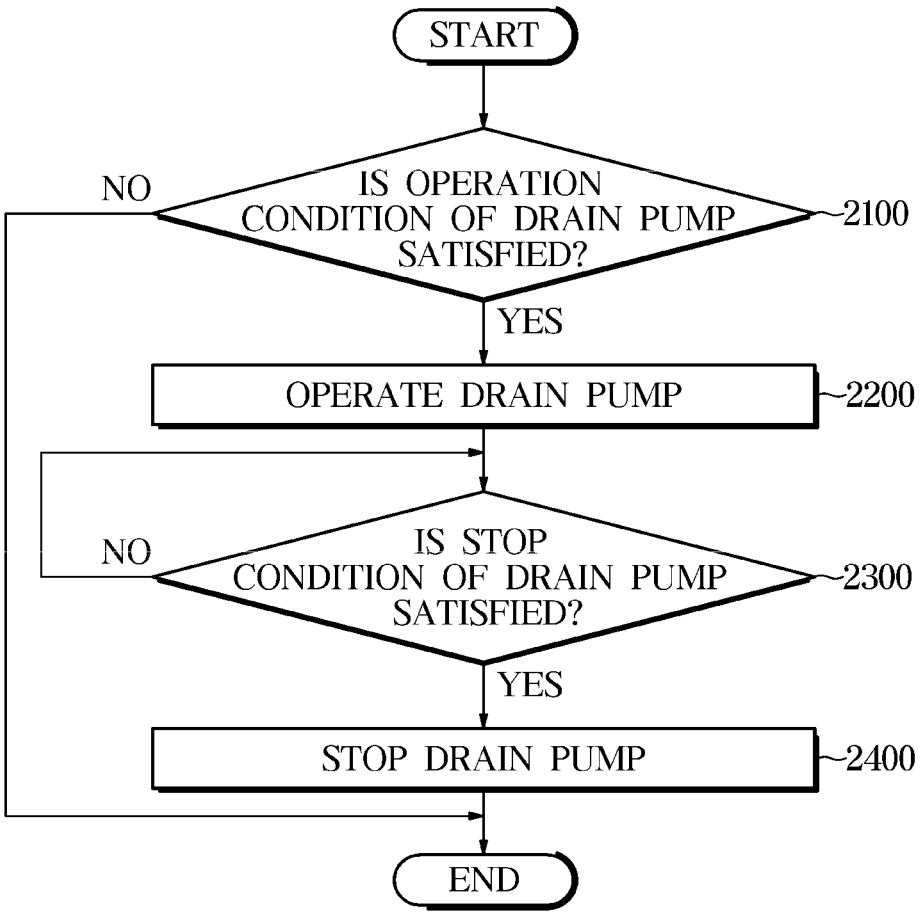
FIG. 42 is a flowchart showing a method for controlling a washing machine according to an embodiment of the disclosure.

FIG. 42 is a flowchart showing a method for controlling a washing machine according to an embodiment of the disclosure.

Referring to FIG. 42, the controller 90 according to an embodiment of the disclosure may operate the drain pump 920 based on an identification (YES in operation 2100) that an operation condition of the drain pump 920 is satisfied (operation 2200).

1) The operation condition of the drain pump 920 may include at least one of the following conditions.

- 1-1) A detection of separation of the first filter 931 from the first case 901 by the first sensor 951
- 1-2) A detection of separation of the second filter 932 from the second case 902 by the second sensor 952
- 1-3) A detection of openness of the first cover 19*a* by the first sensor 951
- 1-4) A detection of openness of the second cover 19*b* by the second sensor 952
- 1-5) Reception of a command input through the input device 15
- 1-6) Reception of a command for operating the drain pump 920 from a user terminal through the communicator 95

The controller 90 may stop operating the drain pump 920 based on an identification (YES in operation 2300) that a stop condition of the drain pump 920 is satisfied while the drain pump 920 operates (operation 2400).

2) The stop condition of the drain pump 920 may include at least one of the following conditions.

- 2-1) A detection of coupling of the first filter 931 from the first case 901 by the first sensor 951
- 2-2) A detection of coupling of the second filter 932 from the second case 902 by the second sensor 952
- 2-3) A detection of closing of the first cover 19*a* by the first sensor 951
- 2-4) A detection of closing of the second cover 19*b* by the second sensor 951
- 2-5) Reception of a command input through the input device 15
- 2-6) Reception of a command for stopping the drain pump 920 from a user terminal through the communicator 95.
- 2-7) A case in which an operation time of the drain pump 920 exceeds a preset time while the drain pump 920 operates according to conditions 1-3 and 1-4

According to the disclosure, while a user manages the first filter 931, water remaining in the first case 901 may be efficiently prevented from being discharged to the outside through the first filter inserting opening 901*a*. According to the disclosure, while the user manages the second filter 932, water remaining in the second case 902 may be efficiently prevented from being discharged to the outside through the second filter inserting opening 902*a*.

Figure 43:
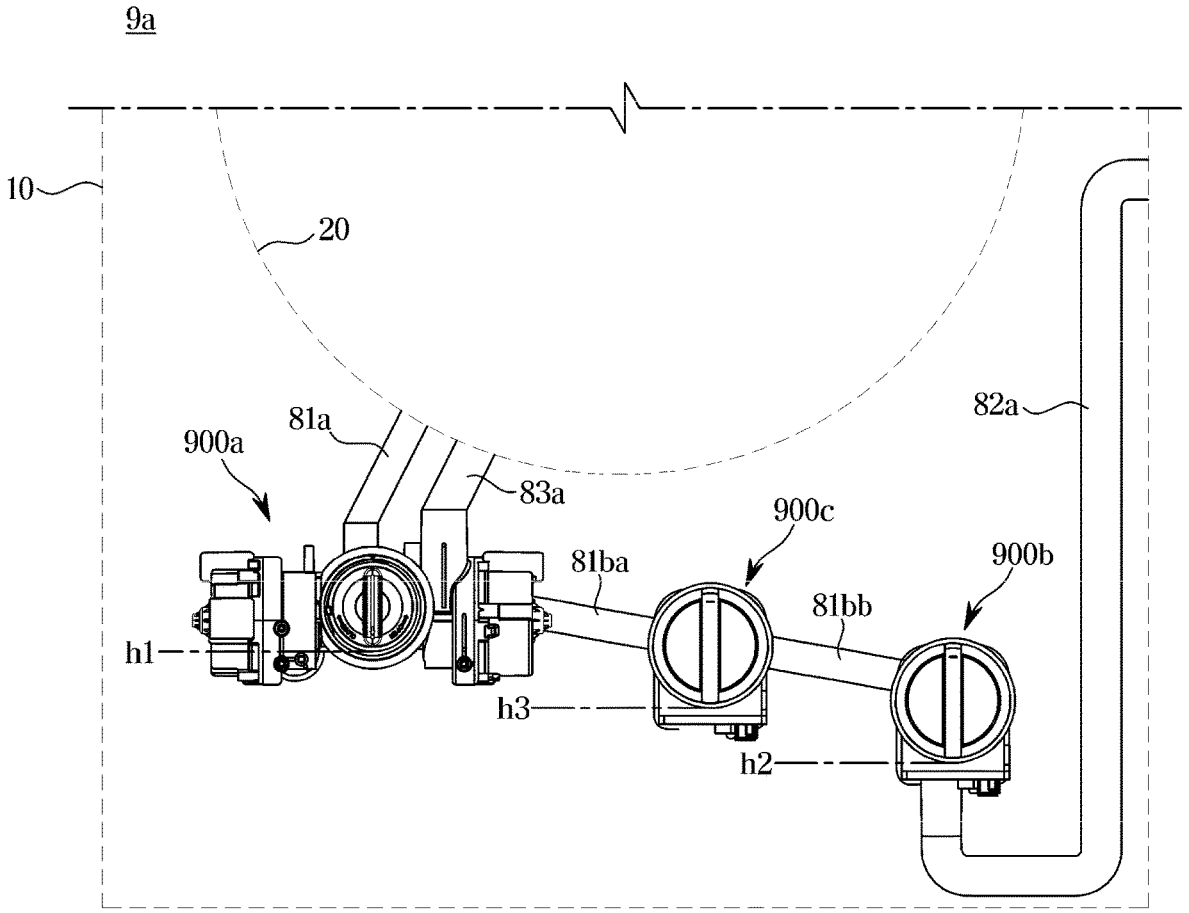
FIG. 43 shows an arrangement relationship of a tub, a first filter device, a second filter device, and a third filter device of a washing machine according to an embodiment of the disclosure, in the front direction.

FIG. 43 shows an arrangement relationship of a tub, a first filter device, a second filter device, and a third filter device of a washing machine according to an embodiment of the disclosure, in the front direction.

A washing machine 9*a* according to an embodiment of the disclosure will be described with reference to FIG. 43. In the following description about the washing machine 9*a* shown in FIG. 43, the same components as those of the washing machine 9 shown in FIGS. 37 to 40 may be assigned like reference numerals and detailed descriptions thereof will be omitted.

Referring to FIG. 43, the washing machine 9*a* may include a first filter device 900*a*, a second filter device 900*b*, and a third filter device 900*c*. The first filter device 900*a* shown in FIG. 43 may have the same configuration as the first filter device 900*a* shown in FIG. 38. The second filter device 900*b* shown in FIG. 43 may have the same configuration as the second filter device 900*b* shown in FIG. 38.

The third filter device 900*c* shown in FIG. 43 may have a configuration that is similar to that of the second filter device 900*b* shown in FIG. 38. The third filter device 900*c* shown in FIG. 43 may have a configuration in which the drain pump 920 is omitted from the second filter device 900*b* shown in FIG. 38.

The third filter device 900*c* may be connected to the first filter device 900*a* and the second filter device 900*b*. The third filter device 900*c* may be connected to the first filter device 900*a* by a first middle guide 81*ba*. The third filter device 900*c* may be connected to the second filter device 900*b* by a second middle guide 81*bb*.

The third filter device 900*c* may be positioned between the first filter device 900*a* and the second filter device 900*b* in the direction of gravity. A height h3 of a lower end of the third filter device 900*c* may be lower than a height h1 of a lower end of the first filter device 900*a*. The height h3 of the lower end of the third filter device 900*c* may be higher than a height h2 of a lower end of the second filter device 900*b*. The height h3 of the lower end of the third filter device 900*c* may be a height between the height h1 of the lower end of the first filter device 900*a* and the height h2 of the lower end of the second filter device 900*b*.

Because the third filter device 900*c* is positioned lower than the first filter device 900*a*, remaining water generated in the first filter device 900*a* may move to the third filter device 900*c* by gravity. Because the third filter device 900*c* is positioned higher than the second filter device 900*b*, remaining water generated in the third filter device 900*c* may move to the second filter device 900*b* by gravity.

According to this configuration, the washing machine 9*a* may prevent remaining water existing in the first filter device 900*a* from being discharged to the outside of the housing 10 while the first filter device 900*a* is managed (maintained and/or repaired), and accordingly, the washing machine 9*a* may prevent surroundings from being contaminated. Also, the washing machine 9*a* according to various embodiments of the disclosure may prevent remaining water existing in the third filter device 900*c* from being discharged to the outside of the housing 10 while the third filter device 900*c* is managed (maintained and/or repaired), and accordingly, the washing machine 9*a* may prevent surroundings from being contaminated.

In the washing machine 9*a* according to an embodiment of the disclosure, the drain pump 920 may be positioned in the second filter device 900*b* located at a most downstream of a flow of water that is discharged from the washing machine 9*a*. Because the drain pump 920 is provided in the second filter device 900*b* located at the most downstream of a flow of water that is discharged from the washing machine 9*a*, the washing machine 9*a* may remove remaining water generated in the first filter device 900*a* and the third filter device 900*c*, as well as remaining water generated in the second filter device 900*b*, while the drain pump 920 operates.

The washing machine 9*a* according to an embodiment of the disclosure may prevent remaining water existing in the first filter device 900*a* and/or the second filter device 900*b* and/or the third filter device 900*c* from being discharged to the outside of the housing 10 by operating the drain pump 920 while the first filter device 900*a* is managed (maintained and/or repaired), while the second filter device 900*b* is managed (maintained and/or repaired), and/or while the third filter device 900*b* is managed (maintained and/or repaired), and accordingly, the washing machine 9*a* may prevent surroundings from being contaminated.

FIG. 43 shows a case in which there are three filter devices. However, in a case in which four filter devices are provided, likewise, the washing machine 9*a* may prevent remaining water existing in the filter devices from being discharged to the outside of the housing 10 while the filter devices are managed (maintained and/or repaired) by positioning the drain pump 920 at a most downstream of a flow of water that is discharged from the washing machine 9*a* and sequentially lowering heights of the filter devices, and accordingly, the washing machine 9*a* may prevent surroundings from being contaminated.

According to an embodiment of the disclosure, a washing machine may include a housing; a tub provided inside the housing; a case connected to the tub; and a filter detachably installed in the case. The washing machine may include: a drain pump configured to discharge water stored in the tub to outside of the housing and discharge water of the case to outside of the case; a sensor configured to detect coupling of the filter to the case; and a controller configured to operate the pump based on a detection of separation of the filter from the case by the sensor.

The controller may stop operating the pump based on a detection of coupling of the filter to the case by the sensor. The washing machine may further include a remaining water space formed inside the case and positioned below the filter in a direction of gravity. The sensor may be one among an optical sensor, a magnetic sensor, an infrared sensor, or a pressure sensor.

According to an embodiment of the disclosure, a method for controlling a washing machine, the washing machine including a filter detachably installed in a case connected to a tub, may includes operating a pump configured to discharge water stored in the case to outside of the case based on a detection of separation of the filter from the case. The method may include operating the pump based on a user input.

According to an aspect of the disclosure, because the washing machine prevents remaining water of the drain device from being discharged while the filter device is separated from the case of the drain device, the washing machine may prevent surroundings from being contaminated while the filter device is managed.

According to an aspect of the disclosure, because the washing machine prevents foreign materials collected in the filter device from being discharged together with remaining water of the drain device while the filter device is separated from the drain device, the washing machine may prevent surroundings from being contaminated while the filter device is managed.

Effects that may be achieved by the disclosure are not limited to the above-mentioned effects, and other effects not mentioned will be clearly understood by one of ordinary skill in the technical field to which the disclosure belongs from the following descriptions.

So far, specific embodiments have been shown and described, however, the disclosure is not limited to these embodiments. It should be interpreted that various modifications may be made by one of ordinary skill in the technical art to which the disclosure belongs, without deviating from the gist of the technical concept of the disclosure, which is defined in the following claims.

What is claimed is:

1. A washing machine comprising:

a housing;

a tub arranged inside the housing;

a drain case connected to the tub and configured to receive water from the tub;

a filter detachably installed in the drain case and configured to filter material from the water;

a remaining water pump connected to the drain case; and a drain pump arranged in the drain case and configured to discharge the water received in the drain case; and a controller configured to:

when an operation to remove the filter from the drain case is detected while the washing machine is not engaged in a draining operation, control the remaining water pump to discharge remaining water in the drain case to outside of the drain case, wherein the remaining water pump is configured to be driven independently from the drain pump.

2. The washing machine of claim 1, wherein the drain pump is configured to discharge the water received in the drain case from the tub to outside of the housing.

3. The washing machine of claim 1, further comprising:

a drain guide configured to guide water pumped by the drain pump; and a remaining water guide arranged separately from the drain guide and configured to guide the remaining water pumped by the remaining water pump.

4. The washing machine of claim 1, wherein the remaining water pump is installed in the drain case.

5. The washing machine of claim 1, wherein the remaining water pump is installed in the housing.

6. The washing machine of claim 1, further comprising:

a remaining water space formed inside the drain case and positioned below the filter in a direction of gravity.

7. The washing machine of claim 6, wherein a bottom of the drain case includes a portion formed to be inclined downward toward the remaining water space.

8. The washing machine of claim 6, wherein the drain case includes:

an inlet through which the water is received from the tub, and a drain opening through which the water is discharged to outside of the drain case, and the remaining water space is closer to the drain opening than the inlet of the drain case.

9. The washing machine of claim 1, further comprising:

a sensor configured to detect installation of the filter in the drain case, wherein the controller is configured to control the remaining water pump to discharge the remaining water based on a detection, by the sensor, of dismounting of the filter from the drain case.

10. The washing machine of claim 9, wherein the controller is configured to stop operating the remaining water pump based on a detection, by the sensor, of coupling of the filter to the drain case.

11. The washing machine of claim 1, further comprising:

a communicator configured to communicate with a user terminal, wherein the controller is configured to control the remaining water pump to discharge the remaining water based on reception, through the communicator, of a command for operating the remaining water pump from the user terminal.

12. The washing machine of claim 1, further comprising:

an input device configured to receive a command from a user to operate the remaining water pump, wherein the controller is configured to control the remaining water pump to discharge remaining water based on reception, through the input device, of the command from the user to operate the remaining water pump.

13. The washing machine of claim 12, further comprising:

a cover arranged on a front surface of the housing and configured to be movable to provide access to the drain case through the front surface of the housing, wherein the input device is adjacent to the cover.

14. The washing machine of claim 13, wherein the input device is configured to receive a command from the user to stop operating the remaining water pump, and the controller is configured to stop operating the remaining water pump based on reception, through the input device, of the command from the user to stop operating the remaining water pump.

15. A washing machine comprising:

a housing;

a tub arranged inside the housing;

a drain case connected to the tub and configured to receive water from the tub;

a filter detachably installed in the drain case and configured to filter material from the a pump connected to the drain case;

a communicator configured to communicate with a user terminal; and a controller configured to:

when an operation to remove the filter from the drain case is detected while the washing machine is not engaged in a draining operation, control the pump to discharge remaining water in the drain case to outside of the drain case, and based on reception, through the communicator, of a command for operating the pump from the user terminal, control the pump to discharge the remaining water.

16. A washing machine comprising:

a housing;

a tub arranged inside the housing;

a drain case connected to the tub and configured to receive water from the tub;

a filter detachably installed in the drain case and configured to filter material from the water;

a pump connected to the drain case;

an input device configured to receive a command from a user to operate the pump; and a controller configured to:

when an operation to remove the filter from the drain case is detected while the washing machine is not engaged in a draining operation, control the pump to discharge remaining water in the drain case to outside of the drain case, and based on reception, through the input device, of the command from the user to operate the pump, control the pump to discharge the remaining water.

17. The washing machine of claim 16, further comprising:

a cover arranged on a front surface of the housing and configured to be movable to provide access to the drain case through the front surface of the housing, wherein the input device is adjacent to the cover.

18. The washing machine of claim 16, wherein the input device is configured to receive a command from the user to stop operating the pump, and the controller is configured to stop operating the pump based on reception, through the input device, of the command from the user to stop operating the pump.

* * * * *